US011130306B2

(12) United States Patent
Shigeyama et al.

(10) Patent No.: US 11,130,306 B2
(45) Date of Patent: Sep. 28, 2021

(54) CARDBOARD BOX DIVIDING DEVICE AND CARDBOARD BOX PRODUCTION DEVICE

(71) Applicant: MITSUBISHI HEAVY INDUSTRIES MACHINERY SYSTEMS, LTD., Hyogo (JP)

(72) Inventors: Naoki Shigeyama, Hyogo (JP); Takanori Iwai, Hyogo (JP); Masakazu Ohira, Hyogo (JP); Yasunari Suzuki, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 0 days.

(21) Appl. No.: 16/771,715

(22) PCT Filed: Dec. 14, 2018

(86) PCT No.: PCT/JP2018/046064
§ 371 (c)(1),
(2) Date: Jun. 11, 2020

(87) PCT Pub. No.: WO2019/117286
PCT Pub. Date: Jun. 20, 2019

(65) Prior Publication Data

US 2020/0398513 A1 Dec. 24, 2020

(30) Foreign Application Priority Data

Dec. 15, 2017 (WO) ..... PCT/JP2017/045215

(51) Int. Cl.
*B26D 7/01* (2006.01)
*B31B 50/20* (2017.01)
(Continued)

(52) U.S. Cl.
CPC ..... *B31B 50/20* (2017.08); *B26D 7/015* (2013.01); *B26D 7/0675* (2013.01); *B26D 2007/322* (2013.01); *B65H 2301/4229* (2013.01)

(58) Field of Classification Search
CPC ..... B26D 7/0675; B26D 7/015; B26D 2007/322; B26D 1/02; B26D 1/08; B31B 50/20; B65H 2301/4229; B25B 1/2492
(Continued)

(56) References Cited

U.S. PATENT DOCUMENTS 5,375,492 A 12/1994 Smitterberg et al.
5,483,856 A * 1/1996 Smitterberg ..... B26D 1/02 83/23
(Continued)

FOREIGN PATENT DOCUMENTS

JP H06138632 A 5/1994
JP H08500297 A 1/1996
(Continued)

OTHER PUBLICATIONS

International Search Report and Written Opinion of International Application No. PCT/JP2018/046064 dated Feb. 19, 2019; 16pp.

*Primary Examiner* — Kenneth E Peterson
*Assistant Examiner* — Liang Dong
(74) *Attorney, Agent, or Firm* — Hauptman Ham, LLP

(57) ABSTRACT

A cardboard box dividing device includes lower conveyors on which a plurality of connected cardboard box bodies are stacked and transported; a pressing device pressing, from above, the plurality of connected cardboard box bodies stacked on the lower conveyors; a cutting blade disposed along a width direction of the connected cardboard box body and dividing the plurality of connected cardboard box bodies stacked on the lower conveyors into a front part and a rear
(Continued)

part; a lifting/lowering device relatively moving the plurality of connected cardboard box bodies on the lower conveyors and the cutting blade along an up-down direction; and a control device controlling the pressing device based on a lifting/lowering height of a loading upper conveyor at a time when a pressing reaction force at a time when the loading upper conveyor presses the plurality of stacked connected cardboard box bodies reaches a preset reference pressing reaction force.

13 Claims, 27 Drawing Sheets

(51) Int. Cl.
*B26D 7/06* (2006.01)
*B26D 7/32* (2006.01)

(58) Field of Classification Search
USPC ..... 83/155, 155.1; 198/626.3, 626.4, 626.6
See application file for complete search history.

(56) References Cited

U.S. PATENT DOCUMENTS

| | | | | |
|---|---|---|---|---|
| 5,660,095 | A | 8/1997 | Smitterberg et al. | |
| 6,655,566 | B1 * | 12/2003 | Martin ..... | B26D 7/1827 225/101 |
| 2007/0065203 | A1 | 3/2007 | Kikuchi | |
| 2015/0024917 | A1 | 1/2015 | Nadachi et al. | |

FOREIGN PATENT DOCUMENTS

| | | | |
|---|---|---|---|
| JP | 2007044819 | A | 2/2007 |
| JP | 2008036805 | A | 2/2008 |
| JP | 2013169690 | A | 9/2013 |

* cited by examiner

CARDBOARD BOX DIVIDING DEVICE AND CARDBOARD BOX PRODUCTION DEVICE

RELATED APPLICATIONS

The present application is a National Phase of International Application Number PCT/JP2018/046064 filed Dec. 14, 2018, and claims priority to International Application Number PCT/JP2017/045215 filed Dec. 15, 2017.

TECHNICAL FIELD

The present invention relates to a cardboard box dividing device dividing a cardboard box folded into a flat shape after various types of processing on a cardboard sheet into a plurality of pieces and a cardboard box production device to which this cardboard box dividing device is applied.

BACKGROUND ART

A general carton-forming machine produces a flat cardboard box by processing and folding a cardboard sheet and includes a sheet feeding section, a printing section, a slotter creaser section, a die cutting section, a folding section, and a counter-ejector section. The sheet feeding section ejects cardboard sheets stacked on a table one by one and sends the cardboard sheet to the printing section at a constant speed. The printing section, which has a printing unit, performs printing on the cardboard sheet. The slotter creaser section forms a creasing line as a folding line on the printed cardboard sheet and processes a groove forming a flap and a gluing margin strip for bonding. The die cutting section performs punching of a hand hole or the like on the cardboard sheet in which the creasing line, the groove, and the gluing margin strip are formed. The folding section produces the flat cardboard box by applying glue to the gluing margin strip while moving the cardboard sheet in which the creasing line, the groove, the gluing margin strip, and the hand hole or the like are processed, folding the cardboard sheet along the creasing line, and bonding the gluing margin strip. Then, the counter-ejector section stacks the cardboard boxes in which the cardboard sheet is folded and glued, sorts the cardboard boxes into a predetermined number of batches, and discharges the batches.

It is desired to improve cardboard box production efficiency in such carton-forming machines. Accordingly, a technique has been proposed by which a carton-forming machine produces a flat cardboard box in which two cardboard boxes are continuous in a transport direction and a dividing device produces one cardboard box by dividing the two flat cardboard boxes into two pieces. In the case of this technique, the carton-forming machine is capable of continuously producing two cardboard boxes, and thus the time required to produce one cardboard box can be shortened and production efficiency can be improved as compared with the related art. Examples of such cardboard box dividing devices include the cardboard box dividing device that is described in PTL 1.

CITATION LIST

Patent Literature

[PTL 1] U.S. Pat. No. 5,660,095

SUMMARY OF INVENTION

Technical Problem

In the above-described cardboard box dividing device of PTL 1, a flat cardboard box in which two cardboard boxes are continuous in a transport direction is produced first, and then a cardboard box having a predetermined size is produced by the two flat cardboard boxes being divided into two pieces. In this case, a plurality of the flat cardboard boxes, which are long in the transport direction, are stacked and unstable, and thus the upper portions of the plurality of stacked cardboard boxes need to be held when the plurality of stacked cardboard boxes are cut. In this case, a holding member descends with respect to the plurality of cardboard boxes stopped on a conveyor and stops at a predetermined pressing position during cutting, and thus the plurality of cardboard boxes are held. However, the plurality of stacked cardboard boxes have different stacking heights or the numbers of stacks vary during production depending on the type of the cardboard box to be produced, and thus it was difficult to control the holding member so as to stop at an optimum pressing position. In addition, the hardness (softness) of the cardboard box varies with the type of the cardboard box to be produced, and it was difficult to control the position of the holding member also in this respect. When the force by which the holding member holds the plurality of cardboard boxes is excessively weak, the cardboard box deviates during cutting and a decline in cutting precision occurs. On the other hand, when the force by which the holding member holds the plurality of cardboard boxes is excessively strong, a cutting blade stops without being capable of cutting the cardboard box.

The present invention has been made to solve the above-described problem, and an object of the present invention is to provide a cardboard box dividing device and a cardboard box production device with which it is possible to stably cut a cardboard box and improve production precision by holding the cardboard box at an appropriate pressure when the cardboard box is cut.

Solution to Problem

A cardboard box dividing device of the present invention for achieving the above object is a cardboard box dividing device for cutting and dividing, along a width direction intersecting with a transport direction, a connected cardboard box laminate in which a plurality of connected cardboard box bodies continuous along the transport direction are stacked in a thickness direction. The cardboard box dividing device includes a lower conveyor on which the plurality of connected cardboard box bodies are stacked and transported, a pressing device pressing, from above, the plurality of connected cardboard box bodies stacked on the lower conveyor, a cutting blade disposed along a width direction of the connected cardboard box body and dividing the plurality of connected cardboard box bodies stacked on the lower conveyor into a front part and a rear part, a lifting/lowering device relatively moving the plurality of connected cardboard box bodies on the lower conveyor and the cutting blade along an up-down direction, and a control device controlling the pressing device based on a lifting/lowering height of a pressing measurement member at a time when a pressing reaction force at a time when the pressing measurement member presses the plurality of stacked connected cardboard box bodies reaches a preset reference pressing reaction force.

Accordingly, the plurality of stacked connected cardboard box bodies are mounted onto the lower conveyor and transported, are pressed from above by the pressing device at a predetermined cutting position stopped on the lower conveyor, and are cut and divided by the cutting blade by the lifting/lowering device relatively moving the plurality of connected cardboard box bodies and the cutting blade in that state. At this time, the control device pre-obtains the lifting/lowering height of the pressing measurement member at a time when the pressing measurement member presses the plurality of stacked connected cardboard box bodies and the pressing reaction force at this time reaches the reference pressing reaction force and controls the pressing device on the basis of the lifting/lowering height of the pressing measurement member, and the plurality of connected cardboard box bodies are pressed with an appropriate pressure. As a result, the cardboard box is held at an appropriate pressure when cut, and thus the cardboard box can be stably cut and production precision can be improved.

In the cardboard box dividing device of the present invention, a height detector detecting a lifting/lowering height of the pressing measurement member at a time when a pressing reaction force acting on the pressing measurement member from the plurality of stacked connected cardboard box bodies reaches the reference pressing reaction force is provided and the control device controls the pressing device based on a detection result of the height detector.

Accordingly, since the height detector detects the lifting/lowering height of the pressing measurement member at a time when the pressing reaction force acting on the pressing measurement member from the connected cardboard box body reaches the reference pressing reaction force and the control device controls the pressing device on the basis of the lifting/lowering height of the pressing measurement member, the lifting/lowering height of the pressing measurement member at a time when the pressing reaction force reaches the reference pressing reaction force can be detected with high precision and the connected cardboard box body can be held at an appropriate pressure when cut.

In the cardboard box dividing device of the present invention, the pressing device has a pressing member supported so as to be capable of ascending and descending and a pressing drive device lifting and lowering the pressing member and the control device adjusts a pressing position of the pressing member by the pressing drive device based on a lifting/lowering height of the pressing measurement member at a time when a pressing reaction force from the connected cardboard box body reaches the reference pressing reaction force.

Accordingly, since the pressing position of the pressing member by the pressing drive device is adjusted on the basis of the lifting/lowering height of the pressing measurement member at a time when the pressing reaction force from the connected cardboard box body reaches the reference pressing reaction force, the connected cardboard box body can be held at an appropriate pressure by the pressing member when cut.

In the cardboard box dividing device of the present invention, a loading lower conveyor is disposed upstream of the lower conveyor in a transport direction of the connected cardboard box body and the pressing measurement member is disposed so as to face the loading lower conveyor from above.

Accordingly, since the pressing measurement member is disposed above the loading lower conveyor and upstream of the lower conveyor, it is possible to obtain an appropriate pressing position of the connected cardboard box body by the pressing device before the cutting blade cuts the connected cardboard box body and it is possible to expedite the cutting work of the connected cardboard box body.

In the cardboard box dividing device of the present invention, the pressing measurement member has a configuration in which an upper pressing member and a lower pressing member are allowed to approach and separate from each other and are urged and supported in a direction of separation by an urging member, the upper pressing member is allowed to move along an up-down direction by a pressing member moving device, and the control device controls the pressing device based on a lifting/lowering height of the lower pressing member at a time when a pressing reaction force acting on the lower pressing member from the connected cardboard box body reaches the reference pressing reaction force.

Accordingly, since the upper pressing member and the lower pressing member are lowered by the pressing member moving device, the plurality of stacked connected cardboard box bodies are pressed by the lower pressing member, the lower pressing member moves to the upper pressing member side against the urging support force of the urging member at this time, and the pressing reaction force reaches the reference pressing reaction force. As a result, it is possible to easily detect that the pressing reaction force reaches the reference pressing reaction force by the movement of the lower pressing member and structural simplification can be achieved.

In the cardboard box dividing device of the present invention, the urging member is a fluid pressure cylinder, the lower pressing member is capable of ascending and descending with respect to the upper pressing member, and the lower pressing member is urged downward and supported with respect to the upper pressing member.

Accordingly, since the urging member is a fluid pressure cylinder, the lower pressing member can be lifted and lowered with respect to the upper pressing member by the fluid pressure cylinder, and the lower pressing member is urged downward and supported with respect to the upper pressing member, the fluid pressure cylinder is capable of functioning as a device for lifting and lowering the lower pressing member and functioning as a device for detecting the pressing reaction force. Device size reduction can be achieved by the urging member having the plurality of functions.

In the cardboard box dividing device of the present invention, an urging support force adjusting device adjusting an urging support force of the lower pressing member by the fluid pressure cylinder is provided.

Accordingly, the urging support force of the lower pressing member by the fluid pressure cylinder is adjusted by the urging support force adjusting device, and thus it is possible to adjust the reference pressing reaction force in accordance with the type of the connected cardboard box body, and it is possible to obtain an appropriate pressing position of the connected cardboard box body by the pressing device regardless of the type of the connected cardboard box body.

In the cardboard box dividing device of the present invention, the control device lowers the pressing measurement member when a pressing reaction force acting on the pressing measurement member from the connected cardboard box body is yet to reach the reference pressing reaction force in a case where the connected cardboard box body is loaded on the loading lower conveyor and controls the pressing device based on a lifting/lowering height of the pressing measurement member at a time when a pressing reaction force acting on the pressing measurement member from the connected cardboard box body reaches the reference pressing reaction force.

Accordingly, the connected cardboard box body is pressed by the pressing measurement member being lowered when the height of the connected cardboard box body loaded on the loading lower conveyor is low and the pressing device is controlled on the basis of the lifting/lowering height at a time when the pressing reaction force acting on the pressing measurement member reaches the reference pressing reaction force, and thus it is possible to obtain an appropriate pressing position of the connected cardboard box body by the pressing device even when the height of the connected cardboard box body is low.

In the cardboard box dividing device of the present invention, the control device lifts the pressing measurement member when a pressing reaction force acting on the pressing measurement member from the connected cardboard box body reaches the reference pressing reaction force in a case where the connected cardboard box body is loaded on the loading lower conveyor and controls the pressing device based on a lifting/lowering height of the pressing measurement member at a time when a pressing reaction force acting on the pressing measurement member from the connected cardboard box body falls below the reference pressing reaction force.

Accordingly, the pressing measurement member is lifted and separated from the connected cardboard box body when the height of the connected cardboard box body loaded on the loading lower conveyor is high and the pressing device is controlled on the basis of the lifting/lowering height at a time when the pressing reaction force acting on the pressing measurement member falls below the reference pressing reaction force, and thus it is possible to obtain an appropriate pressing position of the connected cardboard box body by the pressing device even when the height of the connected cardboard box body is high.

In the cardboard box dividing device of the present invention, the pressing measurement member is a loading upper conveyor disposed so as to face the loading lower conveyor from above.

Accordingly, since the loading upper conveyor is used as a pressing measurement member, there is no need to separately prepare a pressing measurement member, and it is possible to suppress an increase in structural complexity.

The cardboard box dividing device of the present invention further includes a loading upper conveyor disposed so as to face the loading lower conveyor from above and supporting upper portions of a plurality of stacked connected cardboard box bodies, a loading upper conveyor moving device moving the loading upper conveyor up and down, a connected cardboard box body transport conveyor disposed upstream of the loading lower conveyor in a transport direction of the connected cardboard box body, and a connected body height detector detecting a height of a plurality of connected cardboard box bodies stacked on the connected cardboard box body transport conveyor, in which the control device controls the loading upper conveyor moving device based on a detection result of the connected body height detector.

Accordingly, since the loading upper conveyor moving device is controlled on the basis of the height of the plurality of connected cardboard box bodies stacked on the connected cardboard box body transport conveyor, the loading upper conveyor can be moved up and down in accordance with the height of the plurality of connected cardboard box bodies transported to the loading lower conveyor and the loading upper conveyor, and the loading lower conveyor and the loading upper conveyor are capable of stably receiving the plurality of connected cardboard box bodies regardless of the height of the plurality of connected cardboard box bodies.

In the cardboard box dividing device of the present invention, the control device gradually reduces a pressing force of the plurality of connected cardboard box bodies by the pressing device at a time when the cutting blade divides the plurality of connected cardboard box bodies into front and rear parts.

Accordingly, since the pressing force of the plurality of connected cardboard box bodies by the pressing device is gradually reduced when the cutting blade divides the plurality of connected cardboard box bodies into the front and rear parts, the pressing force of the connected cardboard box body is reduced as the number of the connected cardboard box bodies divided by the cutting blade decreases, the reaction force acting on the cutting blade from the connected cardboard box body becomes an appropriate value, and damage during the division of the connected cardboard box body can be suppressed.

In addition, a cardboard box production device of the present invention includes a sheet feeding section supplying a double box sheet, a slotter creaser section performing creasing line processing on a surface of the double box sheet and performing grooving, a folding section forming a connected cardboard box body by folding the double box sheet and bonding end portions, a counter-ejector section discharging a predetermined number of the connected cardboard box bodies at a time after stacking the connected cardboard box bodies while counting the connected cardboard box bodies, and the cardboard box dividing device for cutting and dividing the connected cardboard box body along the width direction intersecting with the transport direction.

Accordingly, the creasing line processing and the grooving are performed on the double box sheet from the sheet feeding section by the slotter creaser section, the connected cardboard box body is formed by the double box sheet being folded by the folding section and the end portions being bonded, the box bodies are stacked while being counted by the counter-ejector section, the connected cardboard box body is cut by the dividing device, and the cardboard boxes are produced as a result. During the cutting by the dividing device, the lifting/lowering height of the pressing measurement member at a time when the pressing measurement member presses the plurality of stacked connected cardboard box bodies and the pressing reaction force at this time reaches the reference pressing reaction force is pre-obtained and the pressing device is controlled on the basis of the lifting/lowering height of the pressing measurement member, and the plurality of connected cardboard box bodies are pressed with an appropriate pressure. As a result, the cardboard box is held at an appropriate pressure when cut, and thus the cardboard box can be stably cut and production precision can be improved.

Advantageous Effects of Invention

According to the cardboard box dividing device and the cardboard box production device of the present invention, a cardboard box is held at an appropriate pressure when cut, and thus the cardboard box can be stably cut and production precision can be improved.

DESCRIPTION OF EMBODIMENTS

Hereinafter, a preferred embodiment of a cardboard box dividing device and a cardboard box production device according to the present invention will be described in detail with reference to the accompanying drawings. It should be noted that the present invention is not limited by this embodiment and, in a case where there are a plurality of embodiments, those configured by the embodiments being combined are also included.

Figure 1:
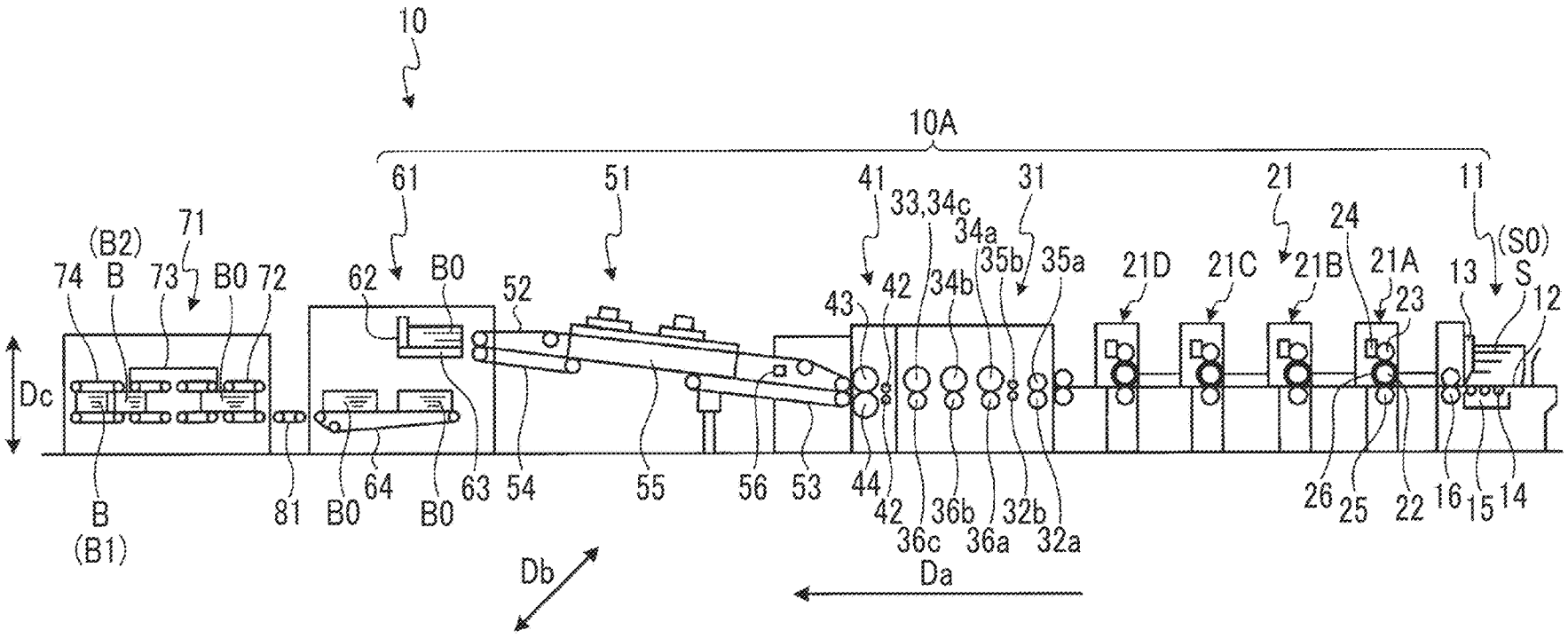
FIG. 1 is a schematic configuration diagram illustrating a cardboard box production device of the present embodiment.

FIG. 1 is a schematic configuration diagram illustrating the cardboard box production device of the present embodiment. In the following description, Da represents the transport direction of a cardboard box, Db represents the width direction of the cardboard box in a transport state (horizontal direction orthogonal to the transport direction Da), and Dc represents the thickness direction of the cardboard box in the transport state (vertical direction orthogonal to the transport direction Da).

As illustrated in FIG. 1, in the present embodiment, a cardboard box production device 10 includes a carton-forming machine 10A and a cardboard box dividing device (hereinafter, referred to as a dividing device) 71. The carton-forming machine 10A includes a sheet feeding section 11, a printing section 21, a slotter creaser section 31, a die cutting section 41, a folding section 51, and a counter-ejector section 61. The sheet feeding section 11, the printing section 21, the slotter creaser section 31, the die cutting section 41, the folding section 51, and the counter-ejector section 61 are disposed so as to form a linear shape along the transport direction Da in which a cardboard sheet S and a cardboard box B are transported, the dividing device 71 is disposed downstream of the counter-ejector section 61 in the transport direction Da, and a transport conveyor 81 is disposed between the counter-ejector section 61 and the dividing device 71.

The carton-forming machine 10A produces the cardboard box B by processing a single box sheet of the cardboard sheet S. The cardboard box production device 10 produces the cardboard box B by processing a double box sheet S0 of the cardboard sheet S. In this case, the carton-forming machine 10A produces a connected cardboard box body B0, in which two cardboard boxes B are connected along the transport direction Da, by processing the double box sheet S0, and the dividing device 71 produces the cardboard box B (B1 and B2) by cutting this connected cardboard box body B0 into two pieces.

First, each device constituting the cardboard box production device 10 of the present embodiment will be described.

The sheet feeding section 11 ejects one cardboard sheet S (single box sheet or double box sheet) at a time and sends the cardboard sheet S to the printing section 21 at a constant speed. This sheet feeding section 11 has a table 12, a front pad 13, a supplying roller 14, a suction device 15, and a feed roll 16. Multiple cardboard sheets S can be stacked and placed on the table 12, and the table 12 is supported so as to be capable of ascending and descending. The front pad 13 is capable of positioning the front end position of the cardboard sheet S stacked on the table 12, and a gap through which one cardboard sheet S is capable of passing is ensured between the lower end portion of the front pad 13 and the table 12. A plurality of the supplying rollers 14 are disposed in the transport direction Da of the cardboard sheet S so as to correspond to the table 12 and, when the table 12 is lowered, the cardboard sheet S that is at the lowest position among the multiple stacked cardboard sheets S can be ejected forward. The suction device 15 suctions the stacked cardboard sheet S downward, that is, to the table 12 or supplying roller 14 side. The feed roll 16 is capable of supplying the cardboard sheet S ejected by the supplying roller 14 to the printing section 21.

The printing section 21 performs multicolor printing (four-color printing in the present embodiment) on the surface of the cardboard sheet S. Four printing units 21A, 21B, 21C, and 21D are disposed in series in the printing section 21, and the printing section 21 is capable of performing printing on the surface of the cardboard sheet S by using four ink colors. Each of the printing units 21A, 21B, 21C, and 21D has substantially the same configuration and has a printing cylinder 22, an ink supply roll (anilox roll) 23, an ink chamber 24, and a receiving roll 25. The printing cylinder 22 has an outer peripheral portion to which a printing plate 26 is attached and is rotatably provided. The ink supply roll 23 is disposed so as to be in contact with the printing plate 26 in the vicinity of the printing cylinder 22 and is rotatably provided. The ink chamber 24, which stores ink, is provided in the vicinity of the ink supply roll 23. The receiving roll 25 transports the cardboard sheet S while imparting a predetermined printing pressure by sandwiching the cardboard sheet S between the printing cylinder 22 and the receiving roll 25 and is rotatably provided so as to face the lower part of the printing cylinder 22. It should be noted that a pair of upper and lower feed rolls (not illustrated) are provided in front of and behind each of the printing units 21A, 21B, 21C, and 21D.

The slotter creaser section 31 performs creasing line processing, cutting, grooving, and gluing margin strip processing on the cardboard sheet S. The slotter creaser section 31 has a first creasing line roll 32*a*, a second creasing line roll 32*b*, a slitter head 33, a first slotter head 34*a*, a second slotter head 34*b*, and a third slotter head 34*c*.

The first creasing line roll 32*a* is formed in a circular shape, and a plurality of the first creasing line rolls 32*a* are disposed at predetermined intervals in the width direction Db of the cardboard sheet S. The second creasing line roll 32*b* is formed in a circular shape, and a plurality of the second creasing line rolls 32*b* are disposed at predetermined intervals in the width direction Db of the cardboard sheet S. The first creasing line roll 32*a* that is disposed on the lower side performs creasing line processing on the back surface (lower surface) of the cardboard sheet S, and the second creasing line roll 32*b* that is disposed on the lower side performs creasing line processing on the back surface (lower surface) of the cardboard sheet S similarly to the first creasing line roll 32*a*. Each of the creasing line rolls 32*a* and 32*b* is provided with receiving rolls 35*a* and 35*b* rotatable in synchronization at facing upper positions.

The first slotter head 34*a* is formed in a circular shape, and a plurality of the first slotter heads 34*a* are disposed at predetermined intervals in the width direction Db of the cardboard sheet S. The first slotter head 34*a* performs grooving at a predetermined position in the transported cardboard sheet S and is capable of performing gluing margin strip processing. The second slotter head 34*b* is formed in a circular shape, and a plurality of the second slotter heads 34*b* are disposed at predetermined intervals in the width direction Db of the cardboard sheet S. The second slotter head 34*b* performs grooving at a predetermined position in the transported cardboard sheet S and is capable of performing gluing margin strip processing.

Each of the slitter head 33 and the third slotter head 34*c* is formed in a circular shape, and a plurality of the slitter heads 33 and a plurality of the third slotter heads 34*c* are disposed at predetermined intervals in the width direction Db of the cardboard sheet S. The slitter head 33 is capable of cutting the end portion of the transported cardboard sheet S in the width direction Db. The third slotter head 34*c* performs grooving at a predetermined position in the transported cardboard sheet S and is capable of performing gluing margin strip processing. Each of the slotter heads 34*a*, 34*b*, and 34*c* is provided with lower blades 36*a*, 36*b*, and 36*c* rotatable in synchronization at facing lower positions.

The die cutting section 41 performs punching of a hand hole or the like on the cardboard sheet S. The die cutting section 41 has a pair of upper and lower feed pieces 42, an anvil cylinder 43, and a knife cylinder 44. The feed pieces 42 sandwich the cardboard sheet S from above and below, transport the cardboard sheet S, and are rotatably provided. Each of the anvil cylinder 43 and the knife cylinder 44 is formed in a circular shape, and the anvil cylinder 43 and the knife cylinder 44 can be rotated in synchronization by a drive device (not illustrated). In this case, an anvil is mounted onto the outer peripheral portion of the anvil cylinder 43, and a knife attachment base (punching blade) is attached at a predetermined position in the outer peripheral portion of the knife cylinder 44.

The folding section 51 forms the flat cardboard box B by folding the cardboard sheet S while moving the cardboard sheet S in the transport direction Da and bonding both end portions in the width direction Db. The folding section 51 has an upper transport belt 52, lower transport belts 53 and 54, and a molding device 55. The upper transport belt 52 and the lower transport belts 53 and 54 sandwich the cardboard sheet S and the cardboard box B from above and below and transport the cardboard sheet S and the cardboard box B. The molding device 55 has a pair of left and right forming belts and folds each end portion of the cardboard sheet S in the width direction Db while bending the end portion downward with this forming belt. In addition, the folding section 51 is provided with a gluing device 56. This gluing device 56 has a glue gun and is capable of performing glue application at a predetermined position in the cardboard sheet S by discharging glue at a predetermined timing.

The counter-ejector section 61 stacks the cardboard box B while counting the cardboard box B, sorts the cardboard box B into a predetermined number of batches, and then discharges the batches. The counter-ejector section 61 has a hopper device 62. This hopper device 62 has an elevator 63 on which the cardboard box B is stacked, the elevator 63 can be lifted and lowered, and this elevator 63 is provided with a front abutment plate (not illustrated) and an angle adjustment plate (not illustrated) as shaping means. It should be noted that an unloading conveyor 64 is provided below the hopper device 62.

The dividing device 71, which is movable to a use position and a retreat position, is used when the carton-forming machine 10A has produced the connected cardboard box body B0, in which the two cardboard boxes B are connected along the transport direction Da, by processing the double box sheet S0. The dividing device 71 moves to the retreat position when the carton-forming machine 10A produces the cardboard box B by processing the single box sheet. On the other hand, the dividing device 71 moves to the use position when the carton-forming machine 10A produces the connected cardboard box body B0 by processing the double box sheet S0. The dividing device 71 produces the cardboard box B (B1 and B2) by cutting the connected cardboard box body B0 into two pieces. The dividing device 71 has a loading device 72, a cutting device 73, and an unloading device 74. The loading device 72 receives a plurality of the connected cardboard box bodies B0 transported by the transport conveyor 81 from the counter-ejector section 61 and supplies the connected cardboard box bodies B0 to the cutting device 73. The cutting device 73 produces the cardboard boxes B1 and B2 by dividing the connected cardboard box body B0 into one front part and one rear part. The unloading device 74 receives the cardboard boxes B1 and B2 divided into two from the cutting device 73 and unloads the cardboard boxes B1 and B2.

Figure 28:
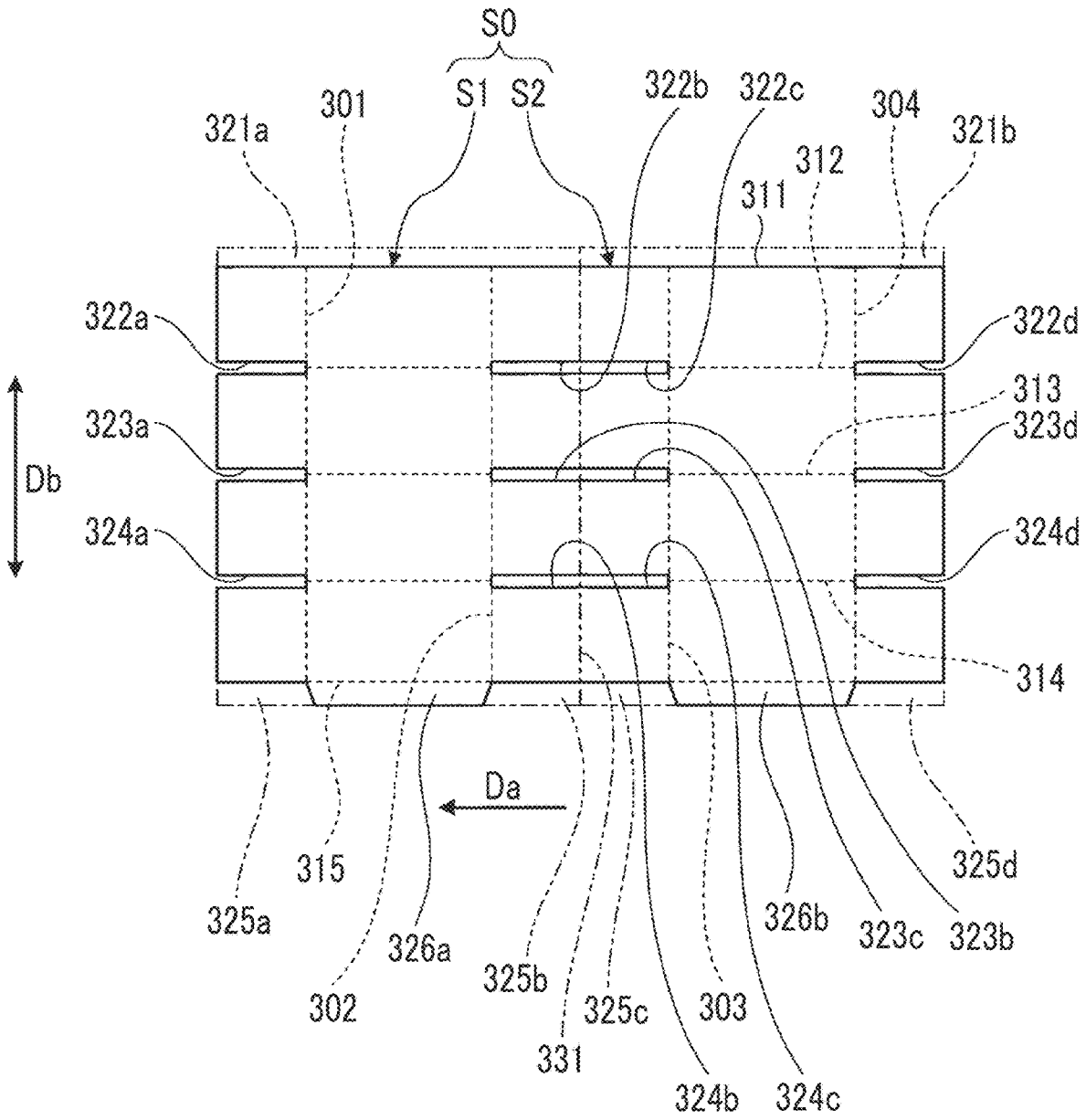
FIG. 28 is a plan view illustrating a double box sheet that is yet to be folded.

Next, a method for producing the cardboard box B (B1 and B2) by processing the double box sheet S0 by means of the cardboard box production device 10 of the present embodiment will be briefly described. FIG. 28 is a plan view illustrating the double box sheet that is yet to be folded.

As illustrated in FIG. 28, the double box sheet S0 is formed by glue application of corrugated core paper between a bottom liner and a top liner and cut in advance into a size that allows the two cardboard boxes B to be produced. In other words, the double box sheet S0 has a size obtained by single box sheets S1 and S2 being connected. The double box sheet S0 has four folding lines 301, 302, 303, and 304 formed in a previous step. The folding lines 301, 302, 303, and 304 are for folding a flap when the cardboard box B produced by the carton-forming machine 10A is assembled later.

As illustrated in FIG. 1, the double box sheet S0 on which each of the folding lines 301, 302, 303, and 304 is formed is stacked on the table 12 in the sheet feeding section 11. The double box sheet S0 stacked on the table 12 is positioned by the front pad 13 and ejected by the plurality of supplying rollers 14 by the table 12 being lowered. Then, the double box sheet S0 is supplied to the printing section 21 at a predetermined constant speed by a pair of the feed rolls 16.

In each of the printing units 21A, 21B, 21C, and 21D in the printing section 21, ink is supplied from the ink chamber 24 to the surface of the ink supply roll 23, and the ink on the surface of the ink supply roll 23 is transferred to the printing plate 26 when the printing cylinder 22 and the ink supply roll 23 rotate. When the double box sheet S0 is subsequently transported between the printing cylinder 22 and the receiving roll 25, the double box sheet S0 is sandwiched by the printing plate 26 and the receiving roll 25, and printing is performed on the surface by the printing pressure being imparted here. The printed double box sheet S0 is transported to the slotter creaser section 31 by the feed roll.

When the double box sheet S0 passes through the first creasing line roll 32*a* in the slotter creaser section 31, creasing lines 312, 313, 314, and 315 are formed on the back surface (top liner) side as illustrated in FIG. 28. In addition, when the double box sheet S0 passes through the second creasing line roll 32*b*, the creasing lines 312, 313, 314, and 315 are formed again on the back surface (top liner) side of the cardboard sheet S similarly to the first creasing line roll 32*a*.

When the double box sheet S0 in which the creasing lines 312, 313, 314, and 315 are formed passes through the slitter head 33, end portions 321*a* and 321*b* are cut at a cutting position 311. In addition, when the double box sheet S0 passes through the first, second, and third slotter heads 34*a*, 34*b*, and 34*c*, grooves 322*a*, 322*b*, 322*c*, 322*d*, 323*a*, 323*b*, 323*c*, 323*d*, 324*a*, 324*b*, 324*c*, and 324*d* are formed at the positions of the creasing lines 312, 313, and 314. At this time, gluing margin strips 326*a* and 326*b* are formed by end portions 325*a*, 325*b*, 325*c*, and 325*d* being cut at the position of the creasing line 315. Subsequently, the double box sheet S0 is transported to the die cutting section 41 as illustrated in FIG. 1.

In the die cutting section 41, a hand hole (not illustrated) is formed when the double box sheet S0 passes between the anvil cylinder 43 and the knife cylinder 44. However, the hand hole processing is appropriately performed in accordance with the type of the double box sheet S0, and the knife attachment base (punching blade) for performing the hand hole processing is removed from the knife cylinder when the hand hole is unnecessary. In the present embodiment, the hand hole processing of the double box sheet S0 by the die cutting section 41 is omitted, and the double box sheet S0 passes between the anvil cylinder 43 and the knife cylinder 44 that rotate.

In the folding section 51, the gluing device 56 applies glue to the gluing margin strips 326*a* and 326*b* as illustrated in FIG. 28 while the double box sheet S0 is moved in the transport direction Da by the upper transport belt 52 and the lower transport belts 53 and 54, and then the double box sheet S0 is folded downward from the creasing lines 312 and 314 by the molding device 55. When this folding is advanced to nearly 180 degrees, the folding force becomes stronger, the gluing margin strips 326*a* and 326*b* and the end portion of the double box sheet S0 are pressed and adhere to each other, both end portions of the double box sheet S0 are bonded, and the connected cardboard box body B0 is formed. Then, this connected cardboard box body B0 is transported to the counter-ejector section 61 as illustrated in FIG. 1.

In the counter-ejector section 61, the connected cardboard box body B0 is sent to the hopper device 62, the leading edge portion of the connected cardboard box body B0 in the transport direction Da hits the front abutment plate, and the connected cardboard box body B0 is stacked onto the elevator 63 in a state where the connected cardboard box body B0 is shaped by the angle adjustment plate. Then, when a predetermined number of the cardboard boxes B are stacked on the elevator 63, this elevator 63 descends and a predetermined number of the connected cardboard box bodies B0 are discharged as one batch by the unloading conveyor 64. Then, the predetermined number of stacked connected cardboard box bodies B0 are sent to the dividing device 71 by the transport conveyor 81.

In the dividing device 71, the plurality of connected cardboard box bodies B0 transported by the transport conveyor 81 from the counter-ejector section 61 are supplied to the loading device 72. The loading device 72 receives the plurality of stacked connected cardboard box bodies B0 and supplies the stacked connected cardboard box bodies B0 to the cutting device 73. The cutting device 73 produces the cardboard boxes B1 and B2 by dividing the plurality of connected cardboard box bodies B0 into one front part and one rear part by cutting the plurality of connected cardboard box bodies B0 at the position of a two-dot chain line 331 (see FIG. 28) along the width direction Db. The unloading device 74 receives and unloads the cardboard boxes B1 and B2 divided into two by the cutting device 73.

Figure 2:
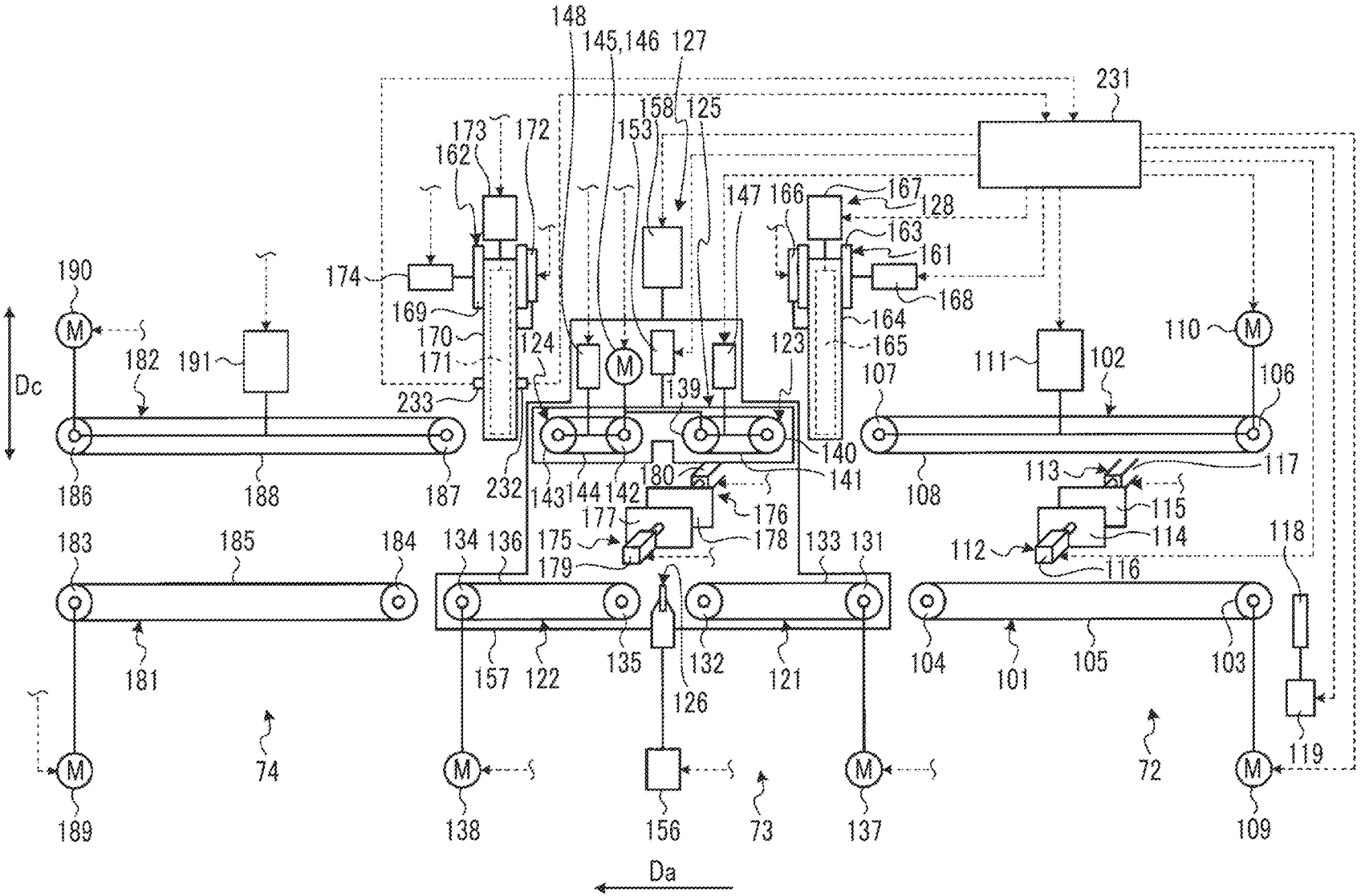
FIG. 2 is a schematic configuration diagram illustrating a cardboard box dividing device of the present embodiment.

Here, the dividing device 71 in the cardboard box production device 10 of the present embodiment will be described in detail first. FIG. 2 is a schematic configuration diagram illustrating the cardboard box dividing device of the present embodiment, FIG. 3 is a plan view illustrating an upper conveyor in the cardboard box dividing device, and FIG. 4 is a plan view illustrating a lower conveyor in the cardboard box dividing device.

Figure 3:
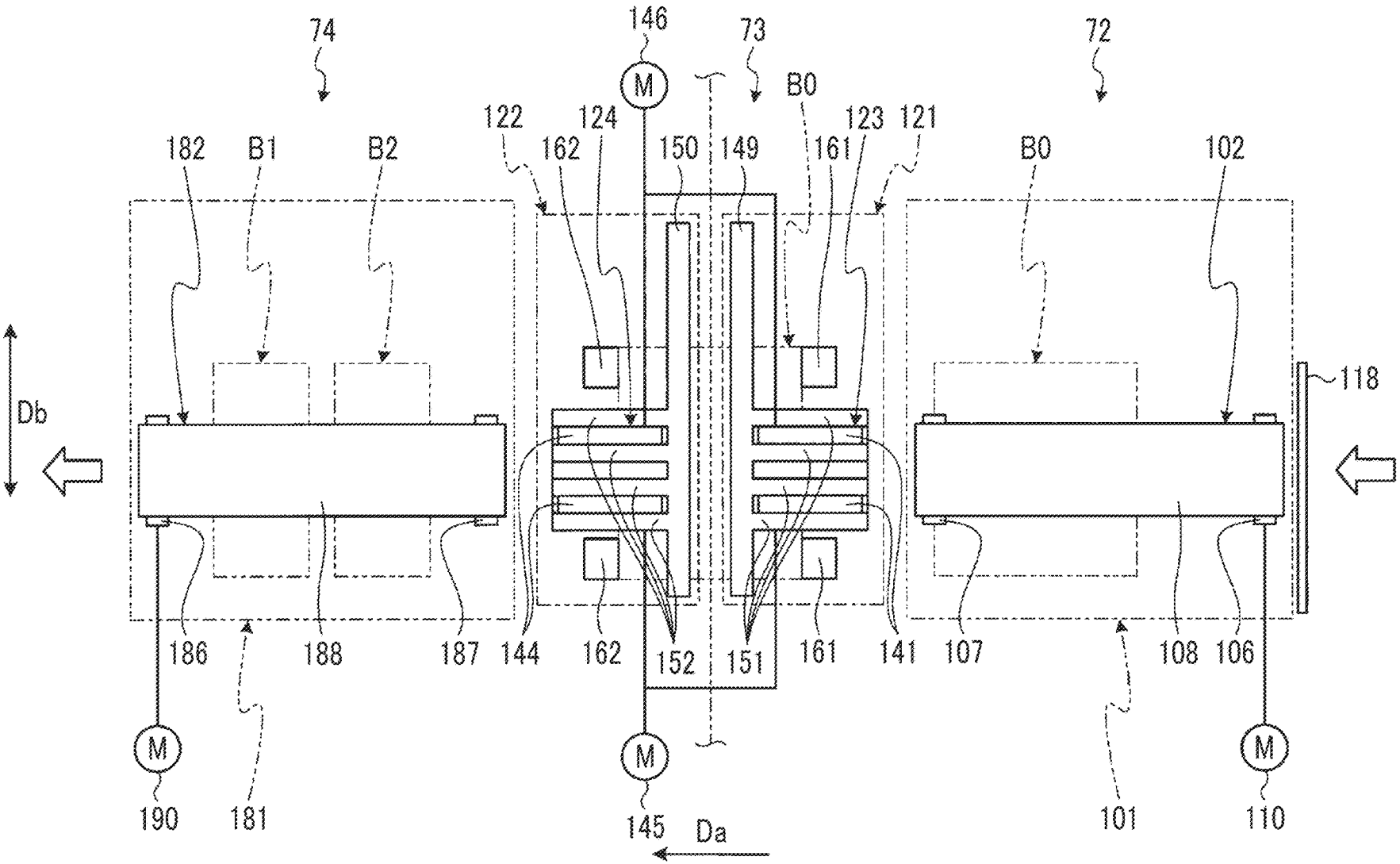
FIG. 3 is a plan view illustrating an upper conveyor in the cardboard box dividing device.
Figure 4:
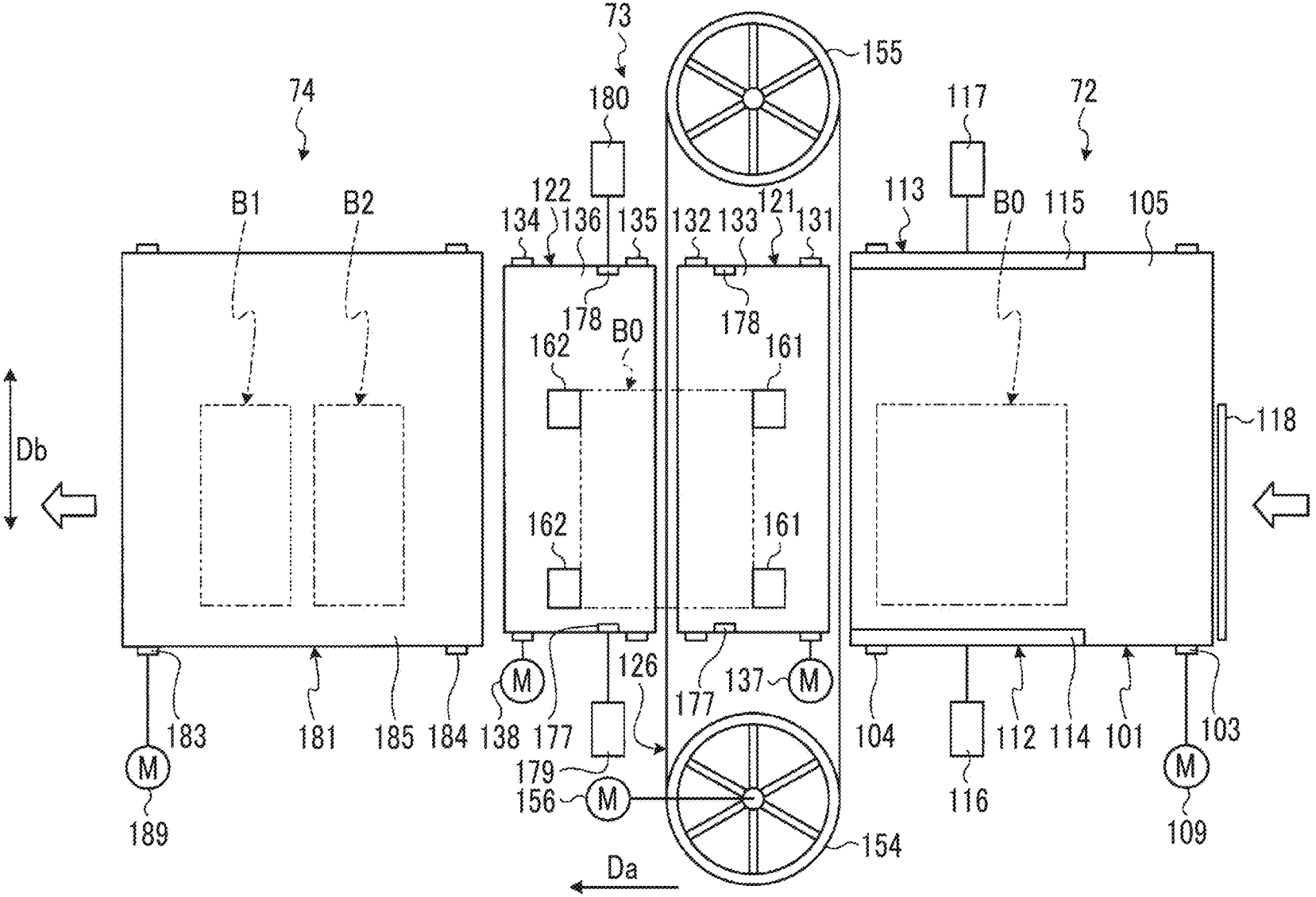
FIG. 4 is a plan view illustrating a lower conveyor in the cardboard box dividing device.

As illustrated in FIGS. 2 to 4, the dividing device 71 has the loading device 72, the cutting device 73, and the unloading device 74. The loading device 72, the cutting device 73, and the unloading device 74 are disposed along the transport direction Da of the connected cardboard box body B0 or the cardboard box B (B1 and B2). The loading device 72 supplies the plurality of stacked connected cardboard box bodies B0 to the cutting device 73 and has a loading lower conveyor 101 and a loading upper conveyor 102. The loading lower conveyor 101 and the loading upper conveyor 102 are disposed so as to face each other at a predetermined interval in the thickness direction Dc of the cardboard sheet S. Although the loading lower conveyor 101 and the loading upper conveyor 102 have substantially the same length in the transport direction Da, the length of the loading upper conveyor 102 in the width direction Db is shorter than the length of the loading lower conveyor 101 in the width direction Db.

The loading lower conveyor 101 is configured by an endless transport belt 105 stretching between a driving roller 103 and a driven roller 104. The loading upper conveyor 102 is configured by an endless transport belt 108 stretching between a driving roller 106 and a driven roller 107. It should be noted that the slack of the transport belts 105 and 108 is prevented by a plurality of rollers (not illustrated) being respectively disposed between the driving rollers 103 and 106 and the driven rollers 104 and 107 in the loading lower conveyor 101 and the loading upper conveyor 102. The loading lower conveyor 101 is provided with a drive motor 109 capable of driving and rotating the driving roller 103. The loading upper conveyor 102 is provided with a drive motor 110 capable of driving and rotating the driving roller 106. In addition, the loading upper conveyor 102 is supported such that the loading upper conveyor 102 can be moved up and down by a loading upper conveyor moving device 111.

The loading device 72 has a left side portion alignment device 112 and a right side portion alignment device 113. The left side portion alignment device 112 and the right side portion alignment device 113 are disposed so as to face each other in the width direction Db. Alignment plates 114 and 115, which face each other in the width direction Db, and drive cylinders 116 and 117, which respectively move the alignment plates 114 and 115 along the width direction Db, constitute the left side portion alignment device 112 and the right side portion alignment device 113, respectively. It should be noted that the positions of the left side portion alignment device 112 and the right side portion alignment device 113 can be adjusted in the width direction Db in accordance with the width dimension of the connected cardboard box body B0 to be processed.

The loading device 72 has an opening-closing door 118. The opening-closing door 118 has a plate shape disposed along the width direction Db and the thickness direction Dc upstream of the loading lower conveyor 101 in the transport direction Da. The opening-closing door 118 can be moved along the thickness direction Dc by a drive cylinder 119 and is movable to a closed position positioned above the loading lower conveyor 101 and an open position positioned below the loading lower conveyor 101.

The cutting device 73 cuts a connected cardboard box laminate in which a plurality of the connected cardboard box bodies B0 are stacked in the thickness direction Dc along the width direction Db and divides the laminate into the two cardboard boxes B1 and B2. The cutting device 73 has an inlet side lower conveyor 121 and an outlet side lower conveyor 122 as lower conveyors, an inlet side upper conveyor 123 and an outlet side upper conveyor 124 as upper conveyors, a pressing device 125, a cutting blade 126, a lifting/lowering device 127, and a positioning device 128.

The inlet side lower conveyor 121 and the outlet side lower conveyor 122 stack and transport the plurality of connected cardboard box bodies B0, the inlet side lower conveyor 121 and the outlet side lower conveyor 122 have the same length as the loading lower conveyor 101 in the width direction Db, and the length of each of the inlet side lower conveyor 121 and the outlet side lower conveyor 122 is approximately half of the length of the loading lower conveyor 101 in the transport direction Da. The inlet side lower conveyor 121 and the outlet side lower conveyor 122 have the same length in the width direction Db and have the same length in the transport direction Da. The inlet side lower conveyor 121 and the outlet side lower conveyor 122 are disposed with a predetermined gap in the transport direction Da.

The inlet side lower conveyor 121 is configured by an endless transport belt 133 stretching between a driving roller 131 and a driven roller 132. The outlet side lower conveyor 122 is configured by an endless transport belt 136 stretching between a driving roller 134 and a driven roller 135. It should be noted that the slack of the transport belts 133 and 136 is prevented by a plurality of rollers (not illustrated) being respectively disposed between the driving rollers 131 and 134 and the driven rollers 132 and 135 in the inlet side lower conveyor 121 and the outlet side lower conveyor 122. The inlet side lower conveyor 121 is provided with a drive motor 137 capable of driving and rotating the driving roller 131. The outlet side lower conveyor 122 is provided with a drive motor 138 capable of driving and rotating the driving roller 134.

The inlet side upper conveyor 123 and the outlet side upper conveyor 124 support and transport the upper portions of the plurality of connected cardboard box bodies B0 stacked on the inlet side lower conveyor 121 and the outlet side lower conveyor 122, a plurality of (two in the present embodiment) conveyors constitute the inlet side upper conveyor 123 and the outlet side upper conveyor 124, and the plurality of conveyors are shorter in length than the inlet side lower conveyor 121 and the outlet side lower conveyor 122 in the width direction Db and the transport direction Da. The inlet side upper conveyor 123 and the outlet side upper conveyor 124 are disposed with a predetermined gap in the transport direction Da.

The inlet side upper conveyor 123 is disposed so as to face the inlet side lower conveyor 121 from above and is configured by an endless transport belt 141 stretching between a driving roller 139 and a driven roller 140. The outlet side upper conveyor 124 is disposed so as to face the outlet side lower conveyor 122 from above and is configured by an endless transport belt 144 stretching between a driving roller 142 and a driven roller 143. As for the inlet side upper conveyor 123 and the outlet side upper conveyor 124, two conveyors are disposed side by side at a predetermined interval in the width direction Db. In addition, the inlet side upper conveyor 123 and the outlet side upper conveyor 124 that are on the left side with respect to the transport direction Da are provided with a drive motor 145 capable of driving and rotating each of the driving rollers 139 and 142, and the inlet side upper conveyor 123 and the outlet side upper conveyor 124 that are on the right side with respect to the transport direction Da are provided with a drive motor 146 capable of driving and rotating each of the driving rollers 139 and 142.

The inlet side upper conveyor 123 and the outlet side upper conveyor 124 are supported such that the inlet side upper conveyor 123 and the outlet side upper conveyor 124 can be moved up and down by an inlet side upper conveyor moving device 147 and an outlet side upper conveyor moving device 148.

The pressing device 125 presses, from above, the plurality of connected cardboard box bodies B0 stacked on the inlet side lower conveyor 121 and the outlet side lower conveyor 122. The pressing device 125 has width direction pressing members 149 and 150 that are along the width direction Db above the inlet side lower conveyor 121 and the outlet side lower conveyor 122 and a plurality of transport direction pressing members 151 and 152 that are along the transport direction Da. The width direction pressing member 149 is disposed in the downstream portion of the inlet side upper conveyor 123 and is configured by the plurality of transport direction pressing members 151 extending from the width direction pressing member 149 to the upstream side in the transport direction Da. The width direction pressing member 150 is disposed in the upstream portion of the outlet side upper conveyor 124 and is configured by the plurality of transport direction pressing members 152 extending from the width direction pressing member 150 to the downstream side in the transport direction Da. The pressing device 125 is supported such that the pressing device 125 can be moved up and down by a pressing drive device 153.

The cutting blade 126 is disposed along the width direction Db between the inlet side lower conveyor 121 and the outlet side lower conveyor 122, and a blade portion is formed along the upper portion of the cutting blade 126. The cutting blade 126, which has an endless shape, is supported by being wound around a driving pulley 154 and a driven pulley 155 disposed on both sides of the inlet side lower conveyor 121 in the width direction Db. A cutting blade drive device 156 is capable of driving and rotating the driving pulley 154, and the cutting blade drive device 156 is capable of moving the cutting blade 126 in the width direction Db between the inlet side lower conveyor 121 and the outlet side lower conveyor 122 by the driving pulley 154 rotating. It should be noted that the cutting blade 126 has a cutting position between the inlet side lower conveyor 121 and the outlet side lower conveyor 122 and simply moves between the inlet side lower conveyor 121 and the loading lower conveyor 101.

The lifting/lowering device 127 relatively moves the cutting blade 126 and the plurality of connected cardboard box bodies B0 on the inlet side lower conveyor 121 and the outlet side lower conveyor 122 along the up-down direction. In the present embodiment, the lifting/lowering device 127 causes the cutting blade 126 to be immovable in the up-down direction and is capable of lifting and lowering the inlet side lower conveyor 121, the outlet side lower conveyor 122, the inlet side upper conveyor 123, the outlet side upper conveyor 124, and the pressing device 125 along the up-down direction. The inlet side lower conveyor 121, the outlet side lower conveyor 122, the inlet side upper conveyor 123, the outlet side upper conveyor 124, and the pressing device 125 are supported by a lifting/lowering base 157. A lifting/lowering drive device 158 is capable of lifting and lowering the lifting/lowering base 157 along the up-down direction, and the inlet side lower conveyor 121, the outlet side lower conveyor 122, the inlet side upper conveyor 123, the outlet side upper conveyor 124, and the pressing device 125 are lifted and lowered by the lifting/lowering base 157 being lifted and lowered. In other words, by the lifting/lowering base 157 being lowered, the plurality of connected cardboard box bodies B0 supported by the inlet side lower conveyor 121, the outlet side lower conveyor 122, the inlet side upper conveyor 123, the outlet side upper conveyor 124, and the pressing device 125 are lowered and the plurality of connected cardboard box bodies B0 are cut by the cutting blade 126.

The positioning device 128 positions, in the transport direction Da, the plurality of connected cardboard box bodies B0 supplied on the inlet side lower conveyor 121 and the outlet side lower conveyor 122. The positioning device 128 has two upstream side positioning members 161 and two downstream side positioning members 162. The upstream side positioning member 161 is movable along the transport direction Da and the thickness direction Dc of the connected cardboard box body B0 in the upstream portion of the inlet side lower conveyor 121. The downstream side positioning member 162 is movable along the transport direction Da and the thickness direction Dc of the connected cardboard box body B0 in the downstream portion of the outlet side lower conveyor 122. The upstream side positioning member 161 and the downstream side positioning member 162 can be independently moved by a positioning drive device.

The upstream side positioning member 161 forms a telescopic structure in which a supporting cylinder 163, an outer cylinder 164, and an inner cylinder 165 are mutually fitted. A first drive device 166 is capable of lifting and lowering the outer cylinder 164 along the thickness direction Dc with respect to the fixed supporting cylinder 163, and a second drive device 167 is capable of lifting and lowering the inner cylinder 165 along the thickness direction Dc with respect to the outer cylinder 164. In addition, a third drive device 168 is capable of moving the supporting cylinder 163 along with the outer cylinder 164 and the inner cylinder 165 along the transport direction Da. The downstream side positioning member 162 forms a telescopic structure in which a supporting cylinder 169, an outer cylinder 170, and an inner cylinder 171 are mutually fitted. A first drive device 172 is capable of lifting and lowering the outer cylinder 170 along the thickness direction Dc with respect to the fixed supporting cylinder 169, and a second drive device 173 is capable of lifting and lowering the inner cylinder 171 along the thickness direction Dc with respect to the outer cylinder 170. In addition, a third drive device 174 is capable of moving the supporting cylinder 169 along with the outer cylinder 170 and the inner cylinder 171 along the transport direction Da.

The upstream side positioning member 161 forms the telescopic structure in which the supporting cylinder 163, the outer cylinder 164, and the inner cylinder 165 are mutually fitted, and thus the width of the outer cylinder 164 in the transport direction Da is smaller than the width of the supporting cylinder 163 in the transport direction Da and the width of the inner cylinder 165 in the transport direction Da is smaller than the width of the outer cylinder 164 in the transport direction Da. In addition, likewise, the downstream side positioning member 162 forms the telescopic structure in which the supporting cylinder 169, the outer cylinder 170, and the inner cylinder 171 are mutually fitted, and thus the width of the outer cylinder 170 in the transport direction Da is smaller than the width of the supporting cylinder 169 in the transport direction Da and the width of the inner cylinder 171 in the transport direction Da is smaller than the width of the outer cylinder 170 in the transport direction Da. Here, the drive devices 166, 167, 168, 172, 173, and 174 constitute the positioning drive device.

The cutting device 73 has a left side portion alignment device 175 and a right side portion alignment device 176. The left side portion alignment device 175 and the right side portion alignment device 176 are disposed so as to face each other in the width direction Db. Alignment plates 177 and 178, which face each other in the width direction Db, and drive cylinders 179 and 180, which respectively move the alignment plates 177 and 178 along the width direction Db, constitute the left side portion alignment device 175 and the right side portion alignment device 176, respectively. In the present embodiment, the left side portion alignment device 175 is disposed beside the inlet side lower conveyor 121 and the outlet side lower conveyor 122, and the alignment plate 177 extends to below the inlet side lower conveyor 121 and the outlet side lower conveyor 122. On the other hand, the right side portion alignment device 176 is disposed above the inlet side lower conveyor 121 and the outlet side lower conveyor 122, and the alignment plate 178 extends to the upper surfaces of the inlet side lower conveyor 121 and the outlet side lower conveyor 122. Accordingly, in the left side portion alignment device 175, no gap is generated between the lower end portion of the alignment plate 177 and the respective upper surfaces of the lower conveyors 121 and 122, and thus it is possible to appropriately perform paper alignment in the width direction Db by aligning the plurality of connected cardboard box bodies B0 stacked on the lower conveyors 121 and 122 with the alignment plate 177 when the alignment plates 177 and 178 have moved so as to approach each other. In addition, the position of the right side portion alignment device 176 can be adjusted in the width direction Db in accordance with the width dimension of the connected cardboard box body B0 to be processed.

The unloading device 74 receives the plurality of stacked cardboard boxes B1 and B2 cut by the cutting device 73, unloads the cardboard boxes B1 and B2 to the outside, and has an unloading lower conveyor 181 and an unloading upper conveyor 182. The unloading lower conveyor 181 and the unloading upper conveyor 182 are disposed so as to face each other at a predetermined interval in the thickness direction Dc of the cardboard sheet S. Although the unloading lower conveyor 181 and the unloading upper conveyor 182 have substantially the same length in the transport direction Da, the length of the unloading upper conveyor 182 in the width direction Db is shorter than the length of the unloading lower conveyor 181 in the width direction Db.

The unloading lower conveyor 181 is configured by an endless transport belt 185 stretching between a driving roller 183 and a driven roller 184. The unloading upper conveyor 182 is configured by an endless transport belt 188 stretching between a driving roller 186 and a driven roller 187. It should be noted that the slack of the transport belts 185 and 188 is prevented by a plurality of rollers (not illustrated) being respectively disposed between the driving rollers 183 and 186 and the driven rollers 184 and 187 in the unloading lower conveyor 181 and the unloading upper conveyor 182. The unloading lower conveyor 181 is provided with a drive motor 189 capable of driving and rotating the driving roller 183. The unloading upper conveyor 182 is provided with a drive motor 190 capable of driving and rotating the driving roller 186. In addition, the unloading upper conveyor 182 is supported such that the unloading upper conveyor 182 can be moved up and down by an unloading upper conveyor moving device 191.

Figure 5:
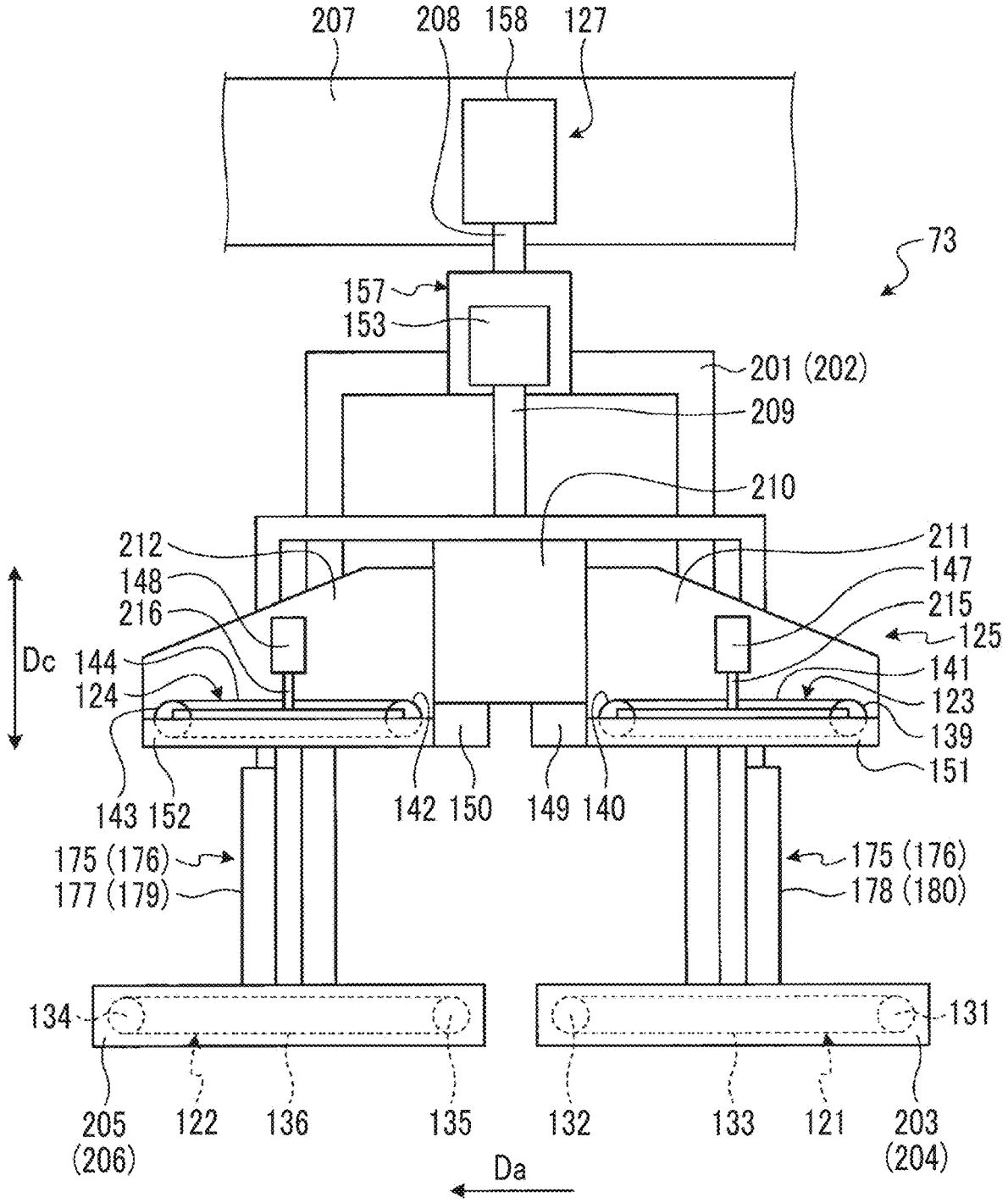
FIG. 5 is a schematic front view illustrating a cardboard box cutting device.

The cutting device 73 will be described in detail. FIG. 5 is a schematic front view illustrating the cardboard box cutting device, and FIG. 6 is a schematic side view illustrating the cardboard box cutting device.

Figure 6:
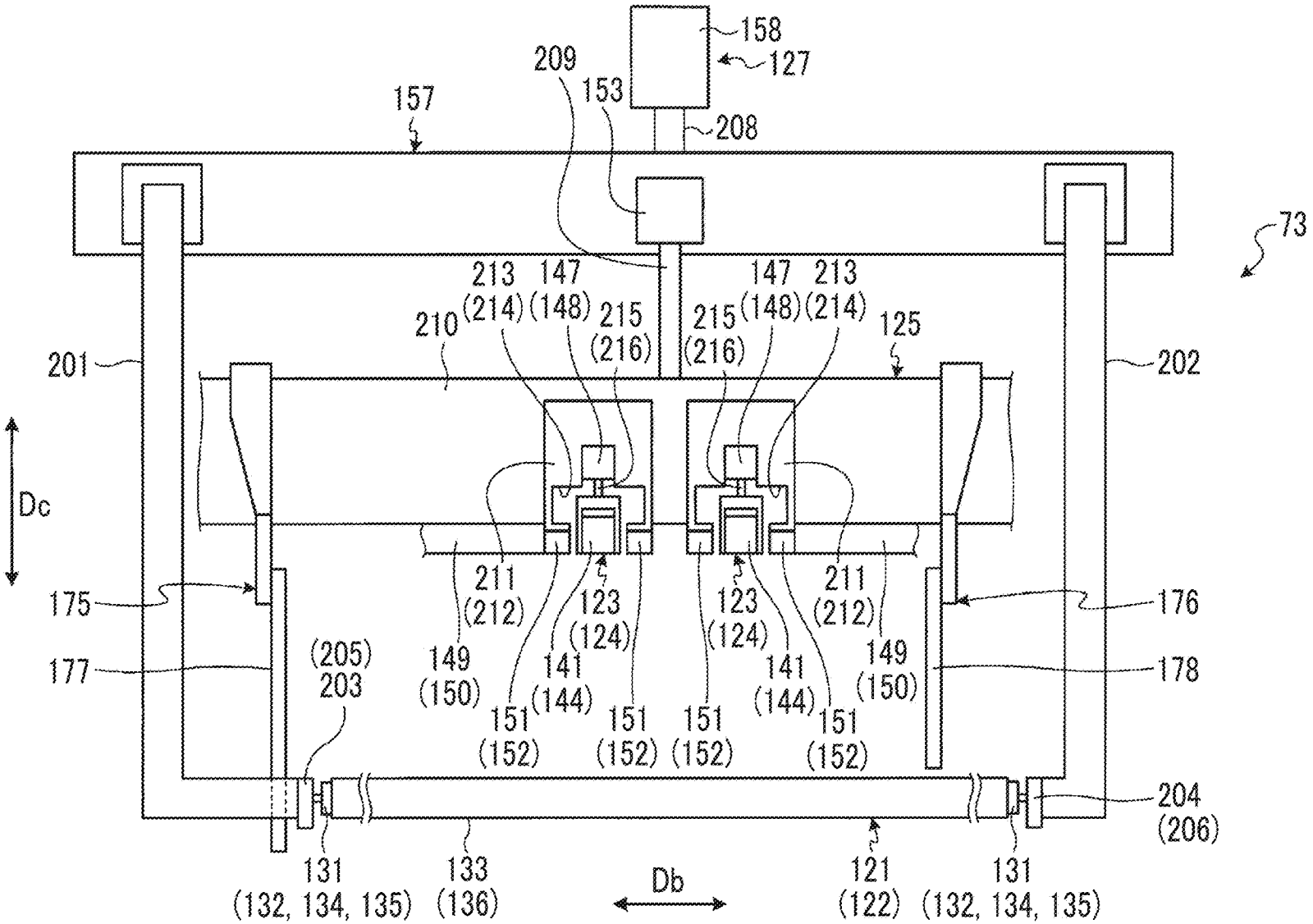
FIG. 6 is a schematic side view illustrating the cardboard box cutting device.

As illustrated in FIGS. 5 and 6, the lifting/lowering base 157 has a beam shape along the horizontal direction, and frame bodies 203, 204, 205, and 206 in the inlet side lower conveyor 121 and the outlet side lower conveyor 122 are connected via a pair of left and right connecting members 201 and 202. The lifting/lowering drive device 158 is provided in a device frame 207, and the leading edge portion of a drive rod 208 is connected to the lifting/lowering base 157.

In addition, the lifting/lowering base 157 is provided with the pressing drive device 153, and the leading edge portion of a drive rod 209 is connected to a support frame 210 of the pressing device 125. The support frame 210 is disposed along the width direction Db, two attachment frames 211 are fixed on the upstream side in the transport direction Da, and two attachment frames 212 are fixed on the downstream side. In addition, the width direction pressing member 149 and the transport direction pressing member 151 are fixed to the lower surface of the attachment frame 211, and the width direction pressing member 150 and the transport direction pressing member 152 are fixed to the lower surface of the attachment frame 212. It should be noted that the left side portion alignment device 175 and the right side portion alignment device 176 are supported by the support frame 210 and each of the alignment plates 177 and 178 hangs downward. The alignment plate 178 is movable in the width direction Db.

The inlet side upper conveyor 123 and the outlet side upper conveyor 124 are disposed in the pressing members 149, 150, 151, and 152. In the present embodiment, the inlet side upper conveyor 123 and the outlet side upper conveyor 124 are disposed in the attachment frames 211 and 212 supporting the pressing members 149, 150, 151, and 152. The attachment frames 211 and 212 are provided with space sections 213 and 214, which open downward. The inlet side upper conveyor moving device 147 is fixed to the space section 213, and the inlet side upper conveyor 123 is connected to the leading edge portion of a drive rod 215. The outlet side upper conveyor moving device 148 is fixed to the space section 214, and the outlet side upper conveyor 124 is connected to the leading edge portion of a drive rod 216.

Accordingly, when the lifting/lowering drive device 158 is driven, the drive rod 208 expands and contracts, the lifting/lowering base 157 can be lifted and lowered, and the inlet side lower conveyor 121, the outlet side lower conveyor 122, the inlet side upper conveyor 123, the outlet side upper conveyor 124, and the pressing device 125 supported by the lifting/lowering base 157 can be lifted and lowered. In addition, when the pressing drive device 153 is driven, the drive rod 209 expands and contracts and the pressing device 125, the inlet side upper conveyor 123, and the outlet side upper conveyor 124 can be lifted and lowered with respect to the lifting/lowering base 157. Further, when the conveyor moving devices 147 and 148 are driven, the drive rods 215 and 216 expand and contract and the inlet side upper conveyor 123 and the outlet side upper conveyor 124 can be lifted and lowered with respect to the pressing device 125.

As illustrated in FIG. 2, the operation of the loading device 72, the cutting device 73, and the unloading device 74 constituting the dividing device 71 can be controlled by a control device 231. The control device 231 is capable of performing drive control on the loading upper conveyor moving device 111, the drive cylinders 116, 117, and 119, and the drive motors 109 and 110 of the loading device 72. The control device 231 is capable of performing drive control on the conveyor moving devices 147 and 148, the pressing drive device 153, the lifting/lowering drive device 158, the drive devices 166, 167, 168, 172, 173, and 174, and the drive motors 137, 138, 145, and 146 of the cutting device 73. The control device 231 is capable of performing drive control on the unloading upper conveyor moving device 191 and the drive motors 189 and 190 of the unloading device 74.

Figure 7:
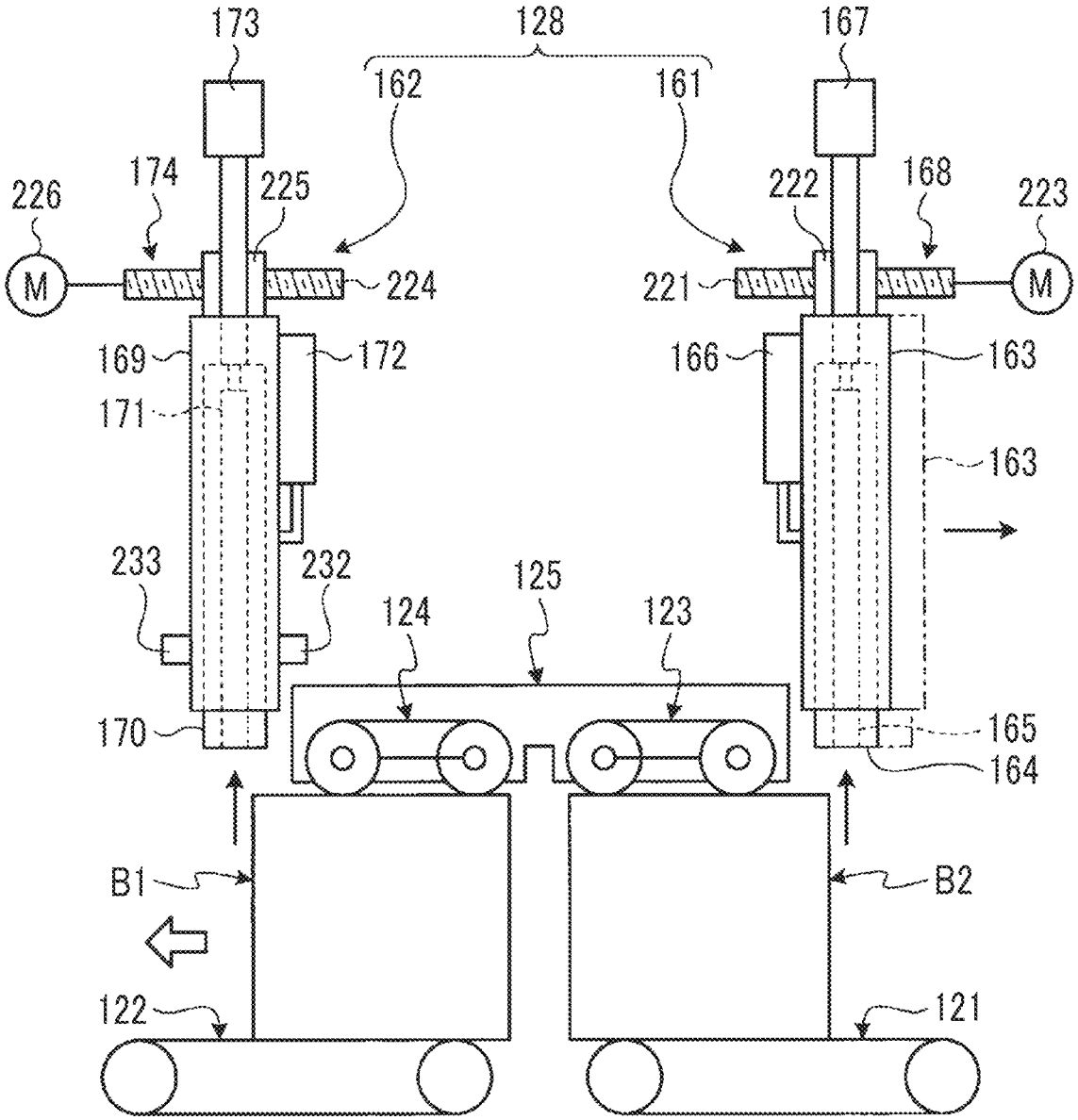
FIG. 7 is a schematic front view illustrating a cardboard box positioning device.
Figure 8:
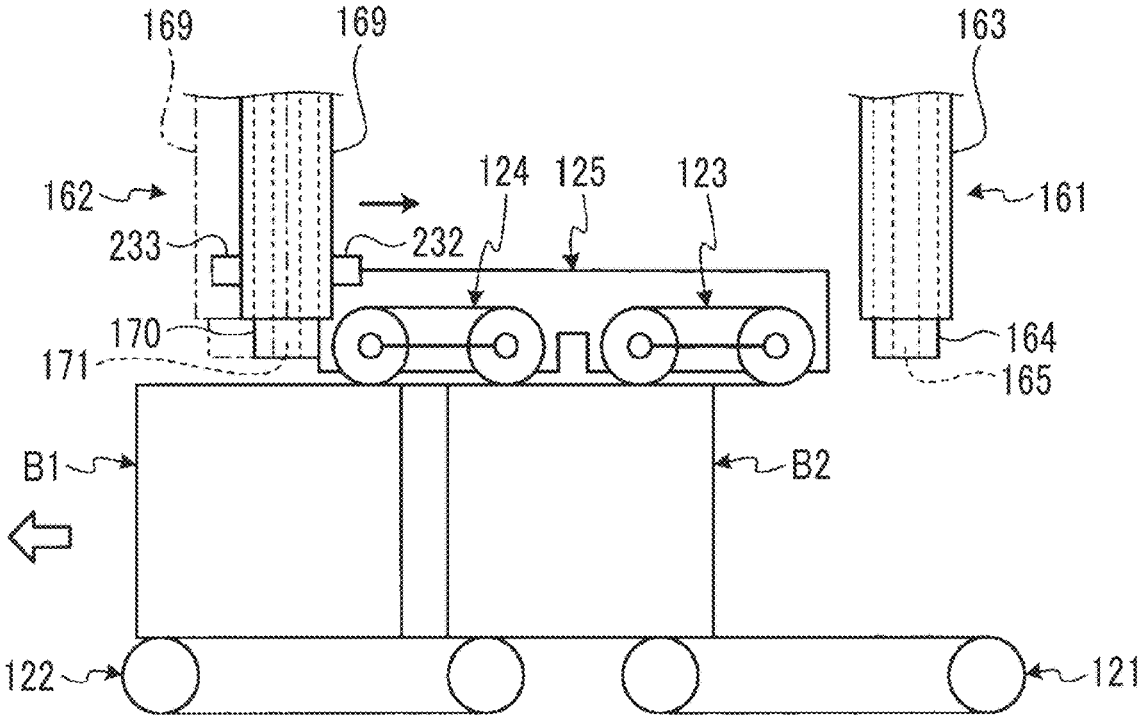
FIG. 8 is a schematic diagram illustrating the operation of the cardboard box positioning device.
Figure 9:
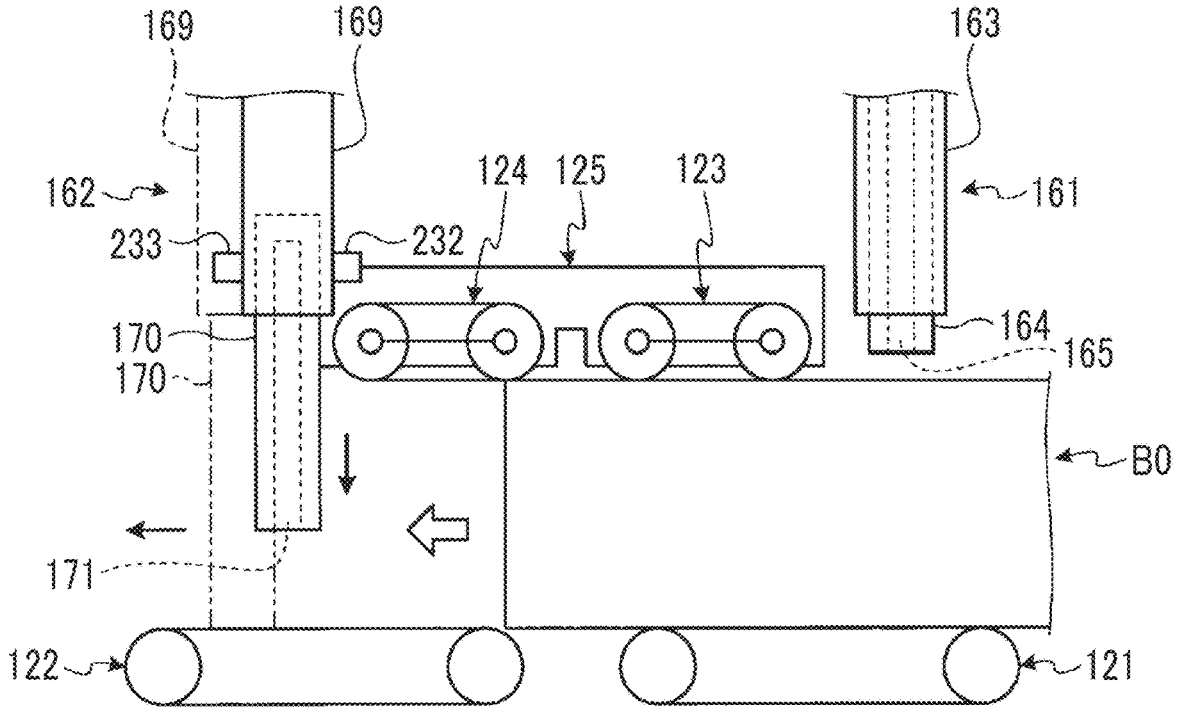
FIG. 9 is a schematic diagram illustrating the operation of the cardboard box positioning device.

Here, the operation control that the control device 231 performs on the upstream side positioning member 161 and the downstream side positioning member 162 constituting the positioning device 128 will be described. FIG. 7 is a schematic front view illustrating the cardboard box positioning device, and FIGS. 8 and 9 are schematic diagrams illustrating the operation of the cardboard box positioning device.

As illustrated in FIG. 7, in the upstream side positioning member 161, the first drive device 166 is capable of lifting and lowering the outer cylinder 164 with respect to the supporting cylinder 163, the second drive device 167 is capable of lifting and lowering the inner cylinder 165 with respect to the outer cylinder 164, and the third drive device 168 is capable of moving the supporting cylinder 163, the outer cylinder 164, and the inner cylinder 165 along the transport direction Da. Here, an air cylinder or the like constitutes the first drive device 166 and the second drive device 167, and the third drive device 168 is constituted by a screw shaft 221, a moving body 222 fixed to the supporting cylinder 163 and screwed with the screw shaft 221, and a motor 223 driving and rotating the screw shaft 221. In addition, in the downstream side positioning member 162, the first drive device 172 is capable of lifting and lowering the outer cylinder 170 with respect to the supporting cylinder 169, the second drive device 173 is capable of lifting and lowering the inner cylinder 171 with respect to the outer cylinder 170, and the third drive device 174 is capable of moving the supporting cylinder 169, the outer cylinder 170, and the inner cylinder 171 in the transport direction Da. Here, an air cylinder or the like constitutes the first drive device 172 and the second drive device 173, and the third drive device 174 is constituted by a screw shaft 224, a moving body 225 fixed to the supporting cylinder 169 and screwed with the screw shaft 224, and a motor 226 driving and rotating the screw shaft 224. The positioning drive device of the present invention is each of the drive devices 166, 167, 168, 172, 173, and 174 and is capable of independently moving the upstream side positioning member 161 and the downstream side positioning member 162.

In other words, the control device 231 operates the outer cylinders 164 and 170 and the inner cylinders 165 and 171 along the thickness direction Dc with respect to the supporting cylinders 163 and 169 by performing drive control on the first drive devices 166 and 172 and the second drive devices 167 and 173 as the lifting/lowering base 157 is lifted and lowered.

The control device 231 moves the downstream side positioning member 162 by a predetermined distance to the upstream side in the transport direction Da by performing drive control on the third drive device 174 after the cutting blade 126 cuts the plurality of connected cardboard box bodies B0 into front and rear parts and the lifting/lowering base 157, the upstream side positioning member 161, and the downstream side positioning member 162 are lifted. Specifically, the control device 231 moves the downstream side positioning member 162 by the predetermined distance to the upstream side in the transport direction Da by performing drive control on the third drive device 174 during the passage of the cut cardboard boxes B1 and B2 below the downstream side positioning member 162 by the inlet side lower conveyor 121 and the outlet side lower conveyor 122 when the upstream side positioning member 161 and the downstream side positioning member 162 are at a rise position.

In addition, the control device 231 lowers the outer cylinder 170 and the inner cylinder 171 by performing drive control on the first drive device 172 and moves the downstream side positioning member 162 by a predetermined distance to the downstream side in the transport direction Da by performing drive control on the third drive device 174 after the passage of the cut cardboard boxes B1 and B2 below the downstream side positioning member 162 by the inlet side lower conveyor 121 and the outlet side lower conveyor 122.

Here, the downstream side positioning member 162 is provided with an arrival detection sensor 232, which detects the arrival of the connected cardboard box body B0 (leading edge in the transport direction Da), on the supporting cylinder 169, and is provided with a passage detection sensor 233, which detects the passage of the cardboard boxes B1 and B2. The arrival detection sensor 232 and the passage detection sensor 233 output detection results to the control device 231. Accordingly, the control device 231 stops operating the inlet side lower conveyor 121, the outlet side lower conveyor 122, the inlet side upper conveyor 123, and the outlet side upper conveyor 124 when the arrival detection sensor 232 detects the arrival of the connected cardboard box body B0. In addition, the control device 231 starts to lower the outer cylinder 170 and the inner cylinder 171 in the downstream side positioning member 162 when the passage detection sensor 233 detects the passage of the cardboard boxes B1 and B2 below the downstream side positioning member 162.

In other words, the cut cardboard boxes B1 and B2 are lifted together with the inlet side lower conveyor 121 and the outlet side lower conveyor 122 when the connected cardboard box body B0 is cut by the cutting blade 126 by the connected cardboard box body B0 supported by the inlet side lower conveyor 121 and the outlet side lower conveyor 122 being lowered. At this time, the upstream side positioning member 161 and the downstream side positioning member 162 are lifted and lowered so as to follow the lifting and lowering of the inlet side lower conveyor 121 and the outlet side lower conveyor 122 as the inlet side lower conveyor 121 and the outlet side lower conveyor 122 are lifted and lowered. In addition, when the upstream side positioning member 161 and the downstream side positioning member 162 are lifted together with the cardboard boxes B1 and B2, the upstream side positioning member 161 is moved to the upstream side in the transport direction Da by a predetermined distance as indicated by a two-dot chain line in FIG. 7.

Then, the downstream side positioning member 162 indicated by a two-dot chain line in FIG. 8 is moved by a predetermined distance (such as the position indicated by a solid line in FIG. 8) to the upstream side in the transport direction Da when the passage detection sensor 233 detects the passage of the cardboard boxes B1 and B2 below the downstream side positioning member 162 after the upstream side positioning member 161 and the downstream side positioning member 162 are lifted as illustrated in FIG. 8. Subsequently, the outer cylinder 170 is lowered with the inner cylinder 171 held in the outer cylinder 170 and the downstream side positioning member 162 is moved by a predetermined distance (such as the position indicated by a two-dot chain line in FIG. 9) to the downstream side in the transport direction Da as illustrated in FIG. 9 when the passage detection sensor 233 detects the completion of the passage of the cardboard boxes B1 and B2 below the downstream side positioning member 162.

By the way, as illustrated in FIG. 2, the plurality of stacked connected cardboard box bodies B0 in the dividing device 71 have different stacking heights (have different numbers of stacks) or the numbers of stacks vary during production depending on the type of the cardboard box B to be produced. As for the pressing device 125, the pressing drive device 153 is capable of lifting and lowering the width direction pressing members 149 and 150 and the transport direction pressing members 151 and 152. The width direction pressing members 149 and 150 and the transport direction pressing members 151 and 152 perform pressing support on the plurality of connected cardboard box bodies B0 stacked on the inlet side lower conveyor 121 and the outlet side lower conveyor 122 by descending. At this time, the width direction pressing members 149 and 150 and the transport direction pressing members 151 and 152 stop at predetermined lowering positions (pressing positions), and thus the plurality of connected cardboard box bodies B0 can be pressed and supported with an appropriate pressure. However, the pressing positions in the width direction pressing members 149 and 150 and the transport direction pressing members 151 and 152 vary when the plurality of stacked connected cardboard box bodies B0 change in stacking height.

Figure 10:
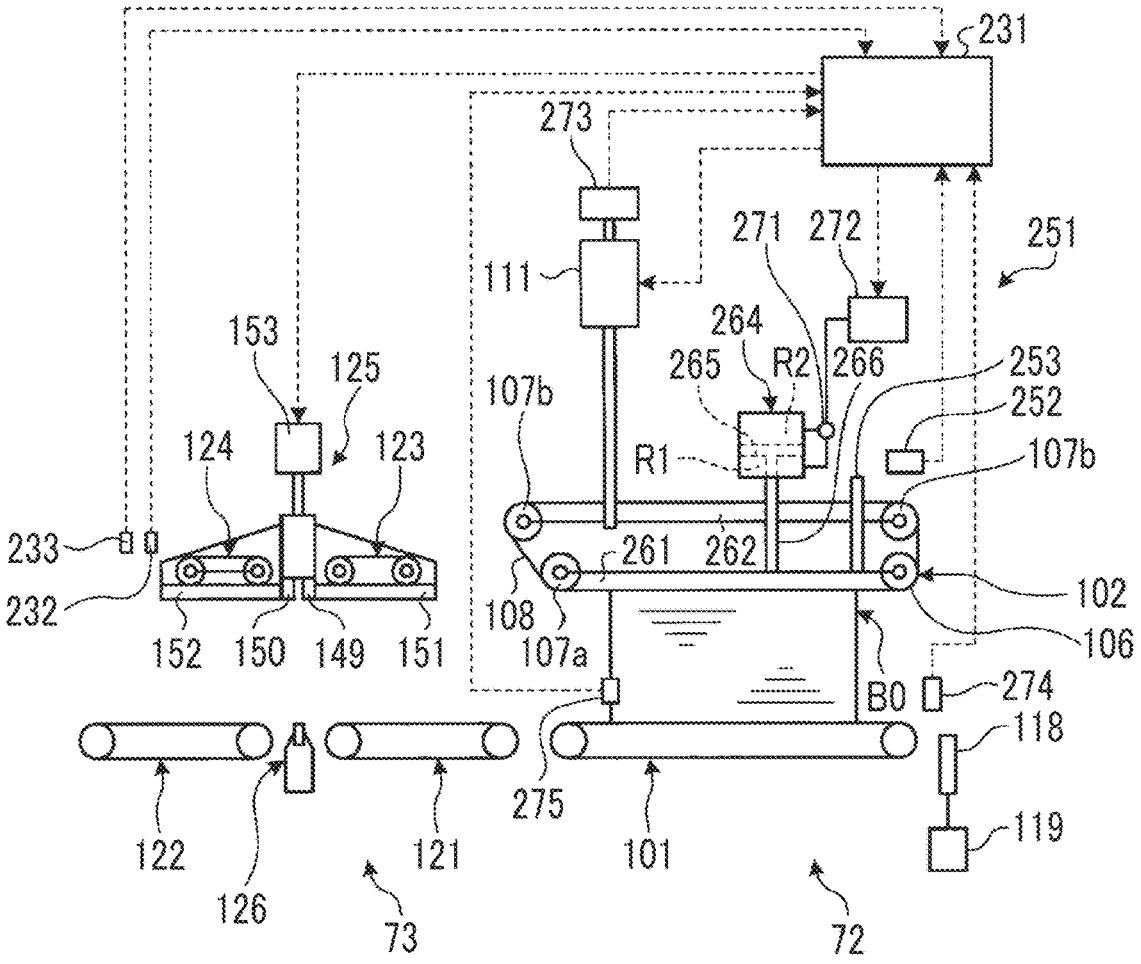
FIG. 10 is a schematic diagram illustrating a cardboard box pressing position setting device.

In this regard, in the present embodiment, an optimum pressing position is set in accordance with the stacking height of the plurality of stacked connected cardboard box bodies B0 before the width direction pressing members 149 and 150 and the transport direction pressing members 151 and 152 in the pressing device 125 performs the pressing support on the plurality of connected cardboard box bodies B0 stacked on the inlet side lower conveyor 121 and the outlet side lower conveyor 122. FIG. 10 is a schematic diagram illustrating a cardboard box pressing position setting device, FIG. 11 is a front view illustrating a detailed structure of the loading upper conveyor, and FIG. 12 is a schematic diagram of the loading upper conveyor illustrating cardboard box pressing position detection operation.

As illustrated in FIG. 10, a pressing position setting device 251 has the loading upper conveyor 102 as a pressing measurement member pressing the plurality of stacked connected cardboard box bodies B0 from above, a height sensor 252 as a height detector detecting the lifting/lowering height of the loading upper conveyor 102 at a time when a pressing reaction force acting on the loading upper conveyor 102 from the connected cardboard box body B0 reaches a preset reference pressing reaction force, and the control device 231 controlling the pressing device 125 on the basis of the detection result of the height sensor 252. In other words, the control device 231 controls the pressing device 125 on the basis of the lifting/lowering height of the loading upper conveyor 102 at a time when the pressing reaction force at a time when the loading upper conveyor 102 presses the plurality of stacked connected cardboard box bodies B0 reaches the reference pressing reaction force.

Figure 11:
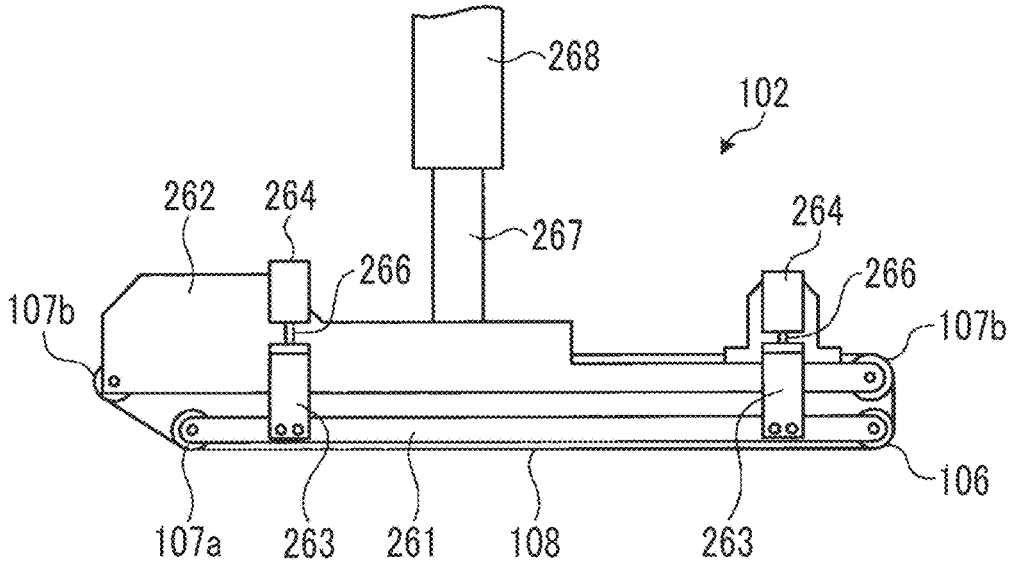
FIG. 11 is a front view illustrating a detailed structure of a loading upper conveyor.
Figure 12:
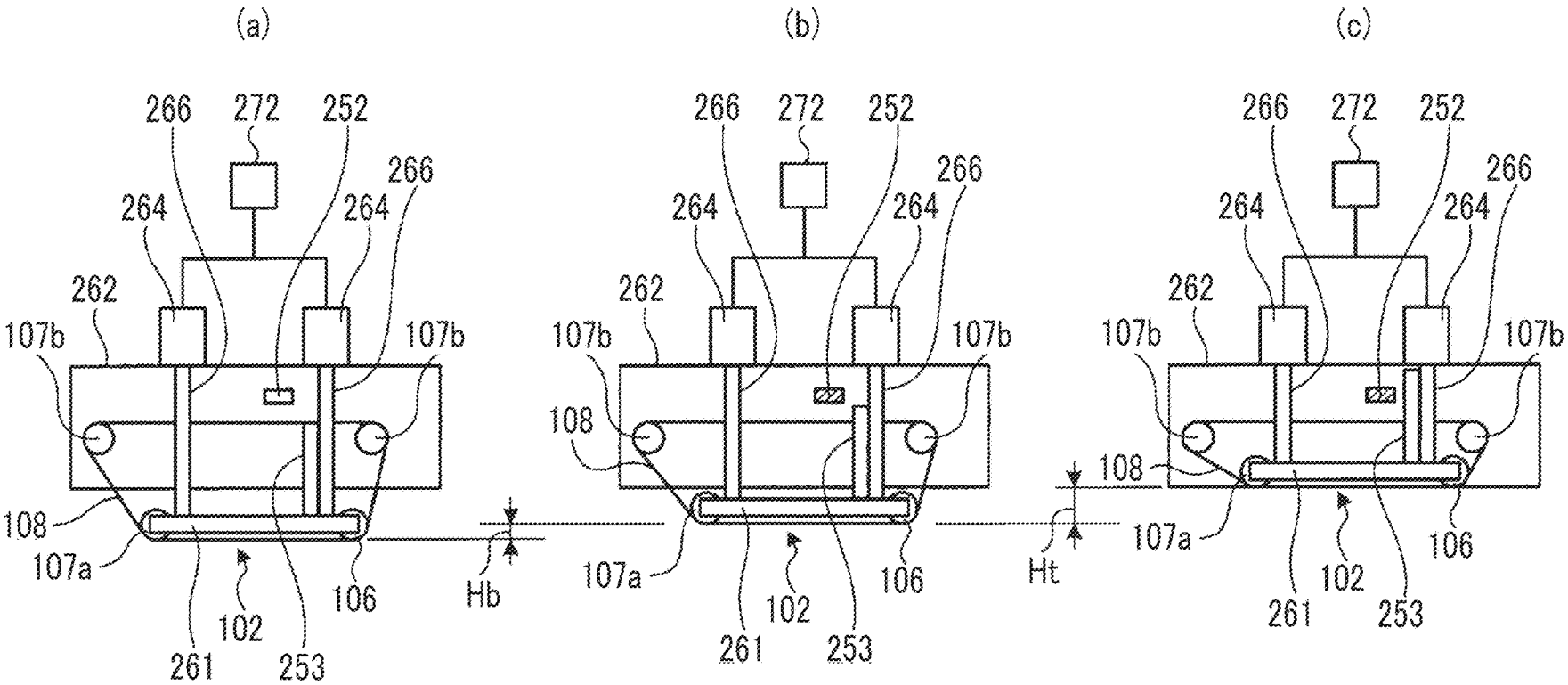
FIG. 12 is a schematic diagram of the loading upper conveyor illustrating cardboard box pressing position detection operation.

As illustrated in FIGS. 10 and 11, the loading upper conveyor 102 has a configuration in which a lower frame (lower pressing member) 261 and an upper frame (upper pressing member) 262 are disposed with a predetermined gap in the up-down direction, the lower frame 261 is provided with the driving roller 106 and a driven roller 107*a*, the upper frame 262 is provided with two driven rollers 107*b*, and the transport belt 108 is wound around the driving roller 106 and each of the driven rollers 107*a* and 107*b*. The lower frame 261 is fixed such that a pressing piece 263 extends to the upper frame 262 side on the upstream side and the downstream side in the transport direction Da. On the other hand, as for the upper frame 262, an air cylinder 264 as an urging member is fixed toward the lower frame 261 side on the upstream side and the downstream side in the transport direction Da. This air cylinder 264 has an internal space partitioned into two rooms R1 and R2 by a piston 265, a drive rod 266 connected to the piston 265 extends toward the lower frame 261 side, and the leading edge portion of the drive rod 266 is connected to the pressing piece 263.

The lower end portion of a connecting rod 267, which is along the up-down direction, is connected to the intermediate portion of the upper frame 262 in the transport direction Da, and the connecting rod 267 is supported by a frame 268 of the loading upper conveyor 102 so as to be movable up and down. The loading upper conveyor moving device 111 is disposed in the frame 268, and the leading edge portion of a drive rod is connected to the upper end portion of the connecting rod 267. Accordingly, the upper frame 262 and the lower frame 261 of the loading upper conveyor 102 can be moved along the up-down direction by the loading upper conveyor moving device 111.

An electropneumatic converter 272 as an urging support force adjusting device is connected to the air cylinder 264. The electropneumatic converter 272 is connected to the lower side room R1 and the upper room R2 partitioned in the air cylinder 264 and can be switched by a switching valve 271. The electropneumatic converter 272 is a signal converter converting an electric signal into an air pressure signal. The control device 231 is capable of adjusting the pressure of the rooms R1 and R2 in the air cylinder 264 by controlling the electropneumatic converter 272. In other words, the pressing force by which the drive rod 266 presses the pressing piece 263 of the lower frame 261 increases when the pressure of the room R2 in the air cylinder 264 is adjusted so as to increase by the electropneumatic converter 272. On the other hand, the drive rod 266 shrinks and the lower frame 261 is lifted via the pressing piece 263 and moved to the upper frame 262 side when the pressure of the room R2 in the air cylinder 264 is adjusted so as to decrease by the electropneumatic converter 272.

The loading upper conveyor moving device 111 has a drive motor (not illustrated), and a rotary encoder 273 of this drive motor is connected. The rotary encoder 273 detects the rotation speed of the drive motor. By the detection result being output to the control device 231, the control device 231 is capable of calculating the lifting/lowering position of the loading upper conveyor 102 (lower frame 261). As for the loading upper conveyor 102, a detection piece 253 extends upward and is fixed to the lower frame 261 and the height sensor 252 is fixed to the upper frame 262. When the lower frame 261 approaches the upper frame 262, the detection piece 253 of the lower frame 261 ascends and can be detected by the height sensor 252. The height sensor 252 outputs this detection result to the control device 231.

In addition, an inlet sensor 274 is provided on the upstream side of the loading upper conveyor 102 in the transport direction Da. This inlet sensor 274 detects the connected cardboard box body B0 supplied to the loading upper conveyor 102 and outputs the detection result to the control device 231. In addition, a loading device arrival sensor 275 is provided on the downstream side of the loading upper conveyor 102 in the transport direction Da. This loading device arrival sensor 275 detects the connected cardboard box body B0 supplied to the loading upper conveyor 102 and outputs the detection result to the control device 231. Further, the arrival detection sensor 232 detecting the arrival of the connected cardboard box body B0 and the passage detection sensor 233 detecting the passage of the cardboard boxes B1 and B2 are provided on the downstream side of the pressing device 125 in the transport direction Da. The arrival detection sensor 232 and the passage detection sensor 233 output detection results to the control device 231.

The control device 231 adjusts the pressure that the electropneumatic converter 272 imparts to the room R2 of the air cylinder 264 in accordance with the type of the cardboard box B to be produced. Data on the type of the cardboard box B to be produced is input to the control device 231 from a control device (not illustrated) of the carton-forming machine 10A. For example, the reference pressure in the room R2 is adjusted so as to increase in a case where the reference pressure in the room R2 is set and the cardboard box B is hard (high in hardness), and the reference pressure in the room R2 is adjusted so as to decrease in a case where the cardboard box B is soft (low in hardness). The hardness of the cardboard box B is determined by the thickness or paper quality of the bottom liner, the top liner, and the medium constituting the cardboard sheet S, the pitch of the waves in the medium, or the like.

As illustrated in FIG. 12, the loading upper conveyor 102 is usually at the position illustrated in FIG. 12(*a*) by the two air cylinders 264 (by the pressure that the electropneumatic converter 272 imparts to the room R2). In other words, the lower frame 261 is positioned below the upper frame 262 by a predetermined distance. Here, when the loading upper conveyor 102 is lowered and the connected cardboard box body B0 is pressed from above, the pressing reaction force from the connected cardboard box body B0 increases at a predetermined lowering position. When this pressing reaction force subsequently reaches the reference pressing reaction force, the pressing piece 263 (see FIG. 11) of the lower frame 261 presses the drive rod 266 of the air cylinder 264 and the lower frame 261 approaches the upper frame 262 by the air cylinder 264 shrinking. As illustrated in FIG. 12(*b*), at this time, the detection piece 253 of the lower frame 261 ascends and can be detected by the height sensor 252. A height Hb is ensured between the normal position of the lower frame 261 illustrated in FIG. 12(*a*) and the detection position of the lower frame 261 illustrated in FIG. 12(*b*).

In addition, even after the height sensor 252 detects the detection piece 253, the pressing reaction force from the connected cardboard box body B0 further increases when the loading upper conveyor 102 is lowered and the connected cardboard box body B0 is pressed. As illustrated in FIG. 12(*c*), at this time, the height sensor 252 is capable of continuing to detect the detection piece 253. A height Ht is ensured between the detection position of the lower frame 261 illustrated in FIG. 12(*b*) and the uppermost position of the lower frame 261 illustrated in FIG. 12(*c*).

The above-described reference pressing reaction force is set by the pressure imparted to the room R2 of the air cylinder 264 adjusted by the electropneumatic converter 272. As described above, the reference pressure in the room R1 is set and adjusted in accordance with the hardness of the cardboard box B. In other words, the reference pressing reaction force is the pressure at which the loading upper conveyor 102 (pressing device 125) presses and holds the plurality of stacked connected cardboard box bodies B0, and the connected cardboard box body B0 deviates in the horizontal direction during cutting and the cutting precision of each connected cardboard box body B0 decreases when this pressing force is excessively low. On the other hand, when this pressing force is excessively high, each connected cardboard box body B0 firmly adheres to an excessive degree and the cutting blade 126 stops without being capable of cutting the cardboard box. It is desirable that the optimum pressing force (reference pressing reaction force) is pre-obtained by an experiment or the like.

Figure 13:
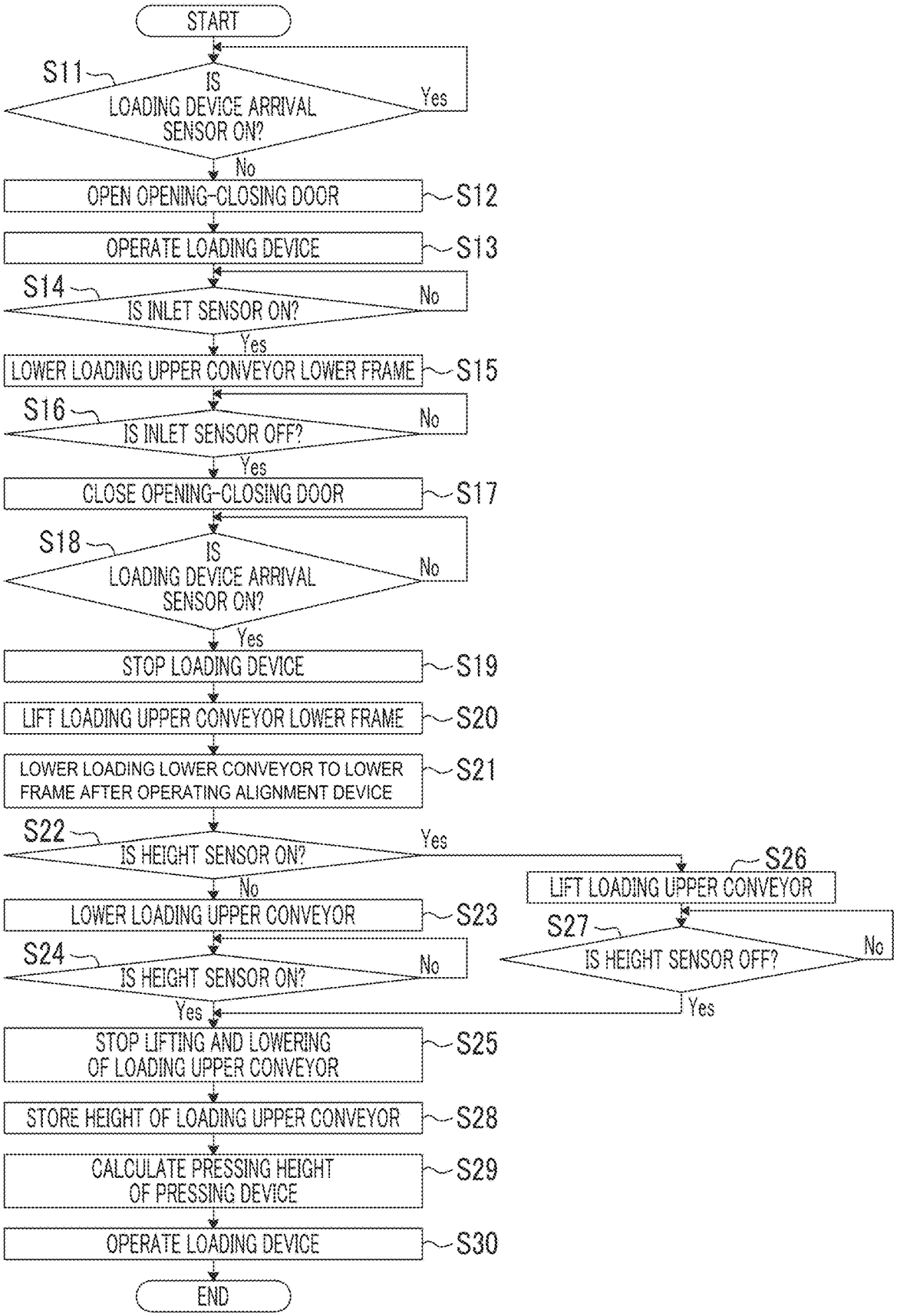
FIG. 13 is a flowchart illustrating a cardboard box pressing position setting method.
Figure 15:
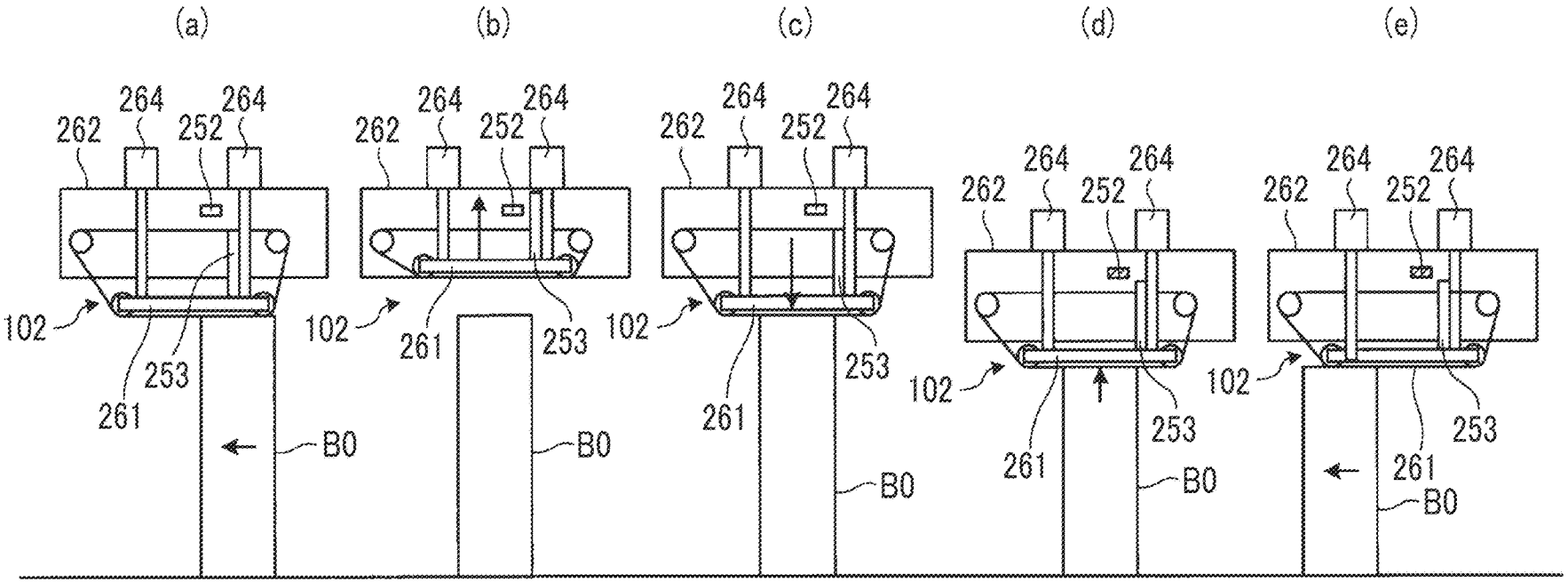
FIG. 15 is a schematic diagram of the loading upper conveyor illustrating pressing position setting operation for a cardboard box having a low stacking height.
Figure 16:
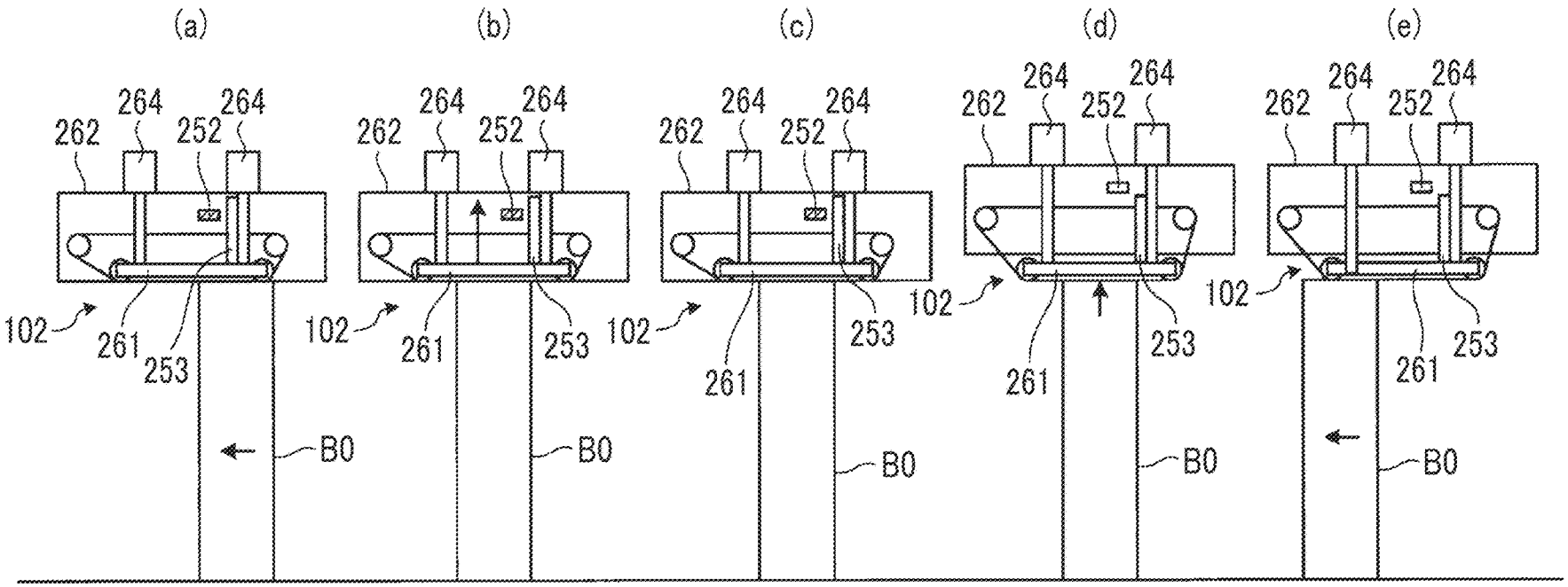
FIG. 16 is a schematic diagram of the loading upper conveyor illustrating pressing position setting operation for a cardboard box having a high stacking height.

Here, a method by which the pressing position setting device 251 sets the pressing position will be described. FIG. 13 is a flowchart illustrating the cardboard box pressing position setting method, FIG. 14 is a schematic diagram of the loading upper conveyor illustrating cardboard box pressing position setting operation, FIG. 15 is a schematic diagram of the loading upper conveyor illustrating pressing position setting operation for a cardboard box having a low stacking height, and FIG. 16 is a schematic diagram of the loading upper conveyor illustrating pressing position setting operation for a cardboard box having a high stacking height.

As illustrated in FIGS. 10 and 13, in step S11 of the pressing position setting method of the pressing position setting device 251, the control device 231 determines whether or not the loading device arrival sensor 275 has detected (ON) the connected cardboard box body B0. Here, this processing is repeated when it is determined that the loading device arrival sensor 275 has detected the connected cardboard box body B0 (Yes). On the other hand, when it is determined that the loading device arrival sensor 275 has not detected the connected cardboard box body B0 (No), the opening-closing door 118 is moved from the closed position to the open position by the drive cylinder 119 in step S12 and the loading device 72 is operated and the connected cardboard box body B0 is loaded onto the loading lower conveyor 101 in step S13.

Figure 14:
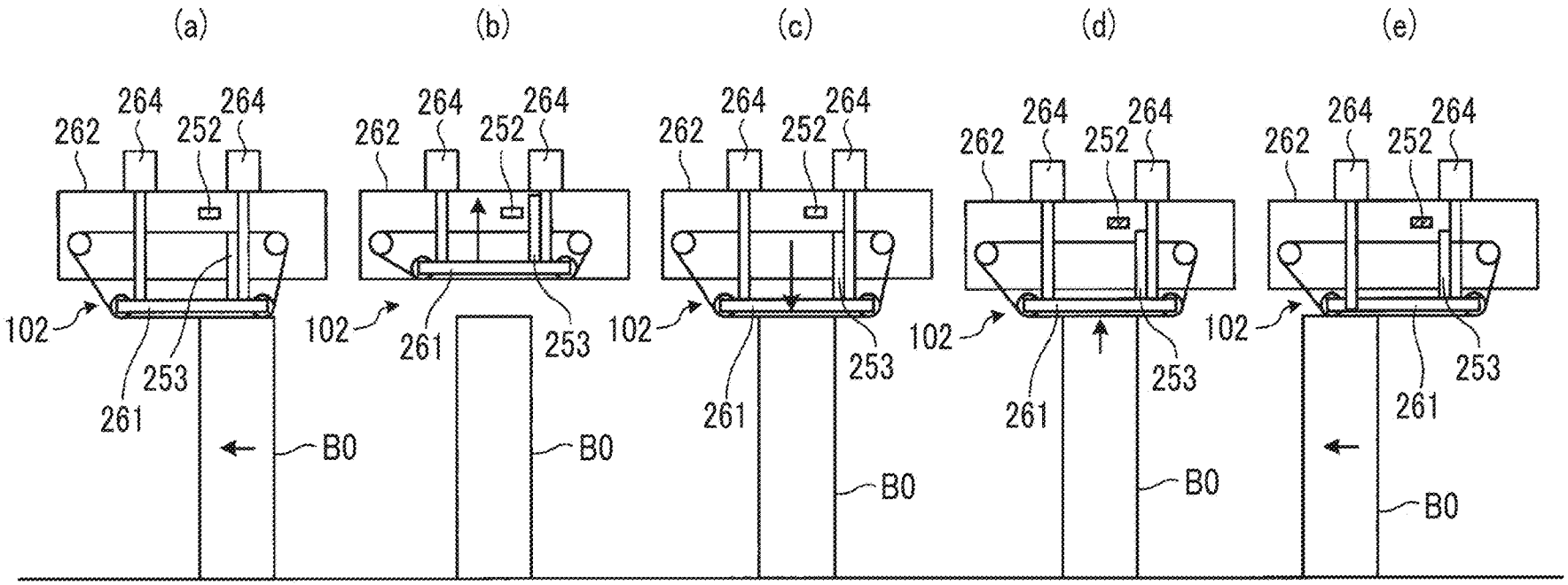
FIG. 14 is a schematic diagram of the loading upper conveyor illustrating cardboard box pressing position setting operation.

As illustrated in FIGS. 10, 13, and 14(*a*), in step S14, the inlet sensor 274 is turned ON and it is detected that the connected cardboard box body B0 has been loaded. Here, this processing continues when it is determined that the inlet sensor 274 has not detected the connected cardboard box body B0 (No). On the other hand, when it is determined that the inlet sensor 274 has detected the connected cardboard box body B0 (Yes), the lower frame 261 of the loading upper conveyor 102 is lowered by the electropneumatic converter 272 controlling the air cylinder 264 in step S15. Then, the plurality of stacked connected cardboard box bodies B0 are loaded in a state of being sandwiched by the loading lower conveyor 101 and the loading upper conveyor 102.

In step S16, it is determined whether or not the inlet sensor 274 has passed (OFF) through the inlet of the loading device 72 of the connected cardboard box body B0. Here, this processing continues when it is determined that the inlet sensor 274 has detected the connected cardboard box body B0 (No). On the other hand, when it is determined that the inlet sensor 274 has not detected the connected cardboard box body B0 (Yes), the opening-closing door 118 is moved from the open position to the closed position by the drive cylinder 119 in step S17. Then, in step S18, it is determined whether or not the loading device arrival sensor 275 has detected (ON) the connected cardboard box body B0. Here, this processing is repeated when it is determined that the loading device arrival sensor 275 has not detected the connected cardboard box body B0 (No). On the other hand, when it is determined that the loading device arrival sensor 275 has detected the connected cardboard box body B0 (Yes), the operation of the loading device 72 is stopped and the connected cardboard box body B0 is stopped on the loading lower conveyor 101 in step S19.

As illustrated in FIGS. 10, 13, and 14(*b*), in the subsequent step S20, the lower frame 261 of the loading upper conveyor 102 is lifted by the air cylinder 264 being controlled. In step S21, each of the alignment devices 112 and 113 is operated, the plurality of stacked connected cardboard box bodies B0 are aligned in the width direction on the loading lower conveyor 101, and then the air cylinder 264 is controlled again. As a result, the lower frame 261 of the loading upper conveyor 102 is lowered. In step S22, it is determined whether or not the height sensor 252 has detected (ON) the detection piece 253. Here, when it is determined that the height sensor 252 has not detected the detection piece 253 (No), the loading upper conveyor 102 is lowered by the loading upper conveyor moving device 111 in step S23 as illustrated in FIGS. 10, 13, and 14(*c*). At this time, the electropneumatic converter 272 supplies the room R2 of the air cylinder 264 with air having the reference pressure indicated by the control device 231. In step S24, it is determined again whether or not height sensor 252 has detected (ON) detection piece 253. Here, this processing continues when it is determined that the height sensor 252 has not detected the detection piece 253 (No).

On the other hand, as illustrated in FIGS. 10, 13, and 14(*d*), the lifting and lowering (lowering) of the loading upper conveyor 102 is stopped in step S25 when it is determined that the height sensor 252 has detected the detection piece 253 (Yes). In other words, when the lower frame 261 presses the connected cardboard box body B0 on the loading lower conveyor 101 from above by the loading upper conveyor 102 being lowered, the pressing force by which the lower frame 261 presses the connected cardboard box body B0, that is, the pressing reaction force that the lower frame 261 receives from the connected cardboard box body B0 increases. Then, the pressing reaction force acting on the lower frame 261 from the connected cardboard box body B0 reaches the reference pressing reaction force at a predetermined lowering position of the lower frame 261. Then, the lower frame 261 ascends such that the loading upper conveyor 102 shrinks the air cylinder 264 with respect to the upper frame 262, and the height sensor 252 of the upper frame 262 detects the detection piece 253 of the lower frame 261. The lowering of the loading upper conveyor 102 is stopped here.

It should be noted that the operation illustrated in FIG. 14 is operation at a time when the hardness of the connected cardboard box body B0 is relatively high or in a case where the connected cardboard box body B0 has a standard stacking height. When the loading upper conveyor 102 is lowered, the pressing reaction force acting on the lower frame 261 from the connected cardboard box body B0 reaches the reference pressing reaction force at an early stage, and the lowering of the loading upper conveyor 102 is stopped by the height sensor 252 detecting the detection piece 253. On the other hand, the operation illustrated in FIG. 15 is operation at a time when the hardness of the connected cardboard box body B0 is relatively low. The operation from FIG. 15(*a*) to FIG. 15(*c*) is the same as the operation from FIG. 14(*a*) to FIG. 14(*c*). However, as illustrated in FIG. 15(*d*), the hardness of the connected cardboard box body B0 is low or the stacking height is low, and thus the amount of lowering of the loading upper conveyor 102 is large. After the loading upper conveyor 102 descends significantly, the pressing reaction force acting on the lower frame 261 from the connected cardboard box body B0 reaches the reference pressing reaction force, and the lowering of the loading upper conveyor 102 is stopped by the height sensor 252 detecting the detection piece 253.

In addition, when it is determined in step S22 that the height sensor 252 has detected the detection piece 253 (Yes), the loading upper conveyor 102 is lifted in step S26 as illustrated in FIGS. 10, 13, and 16. In step S27, it is determined whether or not the height sensor 252 has finished detecting (OFF) the detection piece 253. Here, this processing continues when it is determined that the height sensor 252 detects the detection piece 253 (No).

On the other hand, when it is determined that the height sensor 252 has finished detecting the detection piece 253 (Yes), the lifting and lowering (lifting) of the loading upper conveyor 102 is stopped in step S25. In other words, as illustrated in FIGS. 13 and 16(*a*) to 16(*c*), when the plurality of stacked connected cardboard box bodies B0 are loaded on the loading lower conveyor 101 and the stacking height of the connected cardboard box body B0 is high, the pressing reaction force acting on the lower frame 261 from the connected cardboard box body B0 reaches the reference pressing reaction force at this time and the height sensor 252 detects (ON) the detection piece 253. Accordingly, in step S19, the operation of the loading device 72 is stopped and the connected cardboard box body B0 is stopped on the loading lower conveyor 101. Then, in step S20, the lower frame 261 of the loading upper conveyor 102 is lifted by the air cylinder 264 being controlled. Then, in step S21, each of the alignment devices 112 and 113 is operated and the plurality of stacked connected cardboard box bodies B0 are aligned in the width direction on the loading lower conveyor 101. Then, the lower frame 261 of the loading upper conveyor 102 is lowered by the air cylinder 264 being controlled again.

As illustrated in FIG. 16(*d*), when the loading upper conveyor 102 is lifted with the height sensor 252 detecting the detection piece 253, the pressing force by which the lower frame 261 presses the upper portion of the connected cardboard box body B0 on the loading lower conveyor 101, that is, the pressing reaction force that the lower frame 261 receives from the connected cardboard box body B0 decreases. Then, the pressing reaction force acting on the lower frame 261 from the connected cardboard box body B0 at a predetermined rise position of the lower frame 261 falls below the reference pressing reaction force. Then, the lower frame 261 is lowered such that the loading upper conveyor 102 extends the air cylinder 264 with respect to the upper frame 262 and the height sensor 252 of the upper frame 262 does not detect the detection piece 253 of the lower frame 261. The lifting of the loading upper conveyor 102 is stopped here.

Returning to FIGS. 10 and 13, in step S28, the control device 231 stores the height of the lower frame 261 at a time when the lifting and lowering of the loading upper conveyor 102 is stopped. In this case, the loading upper conveyor 102 is lifted and lowered by the loading upper conveyor moving device 111, and the rotary encoder 273 detects the rotation speed of the drive motor of the loading upper conveyor moving device 111 and outputs the rotation speed to the control device 231. Accordingly, the control device 231 calculates the lifting/lowering position of the loading upper conveyor 102 (lower frame 261) on the basis of the detection result of the rotary encoder 273. In step S29, the control device 231 calculates the pressing height of each of the pressing members 149, 150, 151, and 152 in the pressing device 125 on the basis of the lifting/lowering position of the loading upper conveyor 102 (lower frame 261). In the present embodiment, the height of the loading lower conveyor 101 is the same as the height of the inlet side lower conveyor 121 and the outlet side lower conveyor 122, and thus the control device 231 controls the pressing drive device 153 such that the stored lower surface height of the lower frame 261 at the lifting/lowering position of the loading upper conveyor 102 and the lower surface height of each of the pressing members 149, 150, 151, and 152 are the same.

Subsequently, as illustrated in FIGS. 10, 13, 14(*e*), 15(*e*), and 16(*e*), the plurality of stacked connected cardboard box bodies B0 are supplied to the cutting device 73 by the loading device 72 being operated in step S30.

Figure 17:
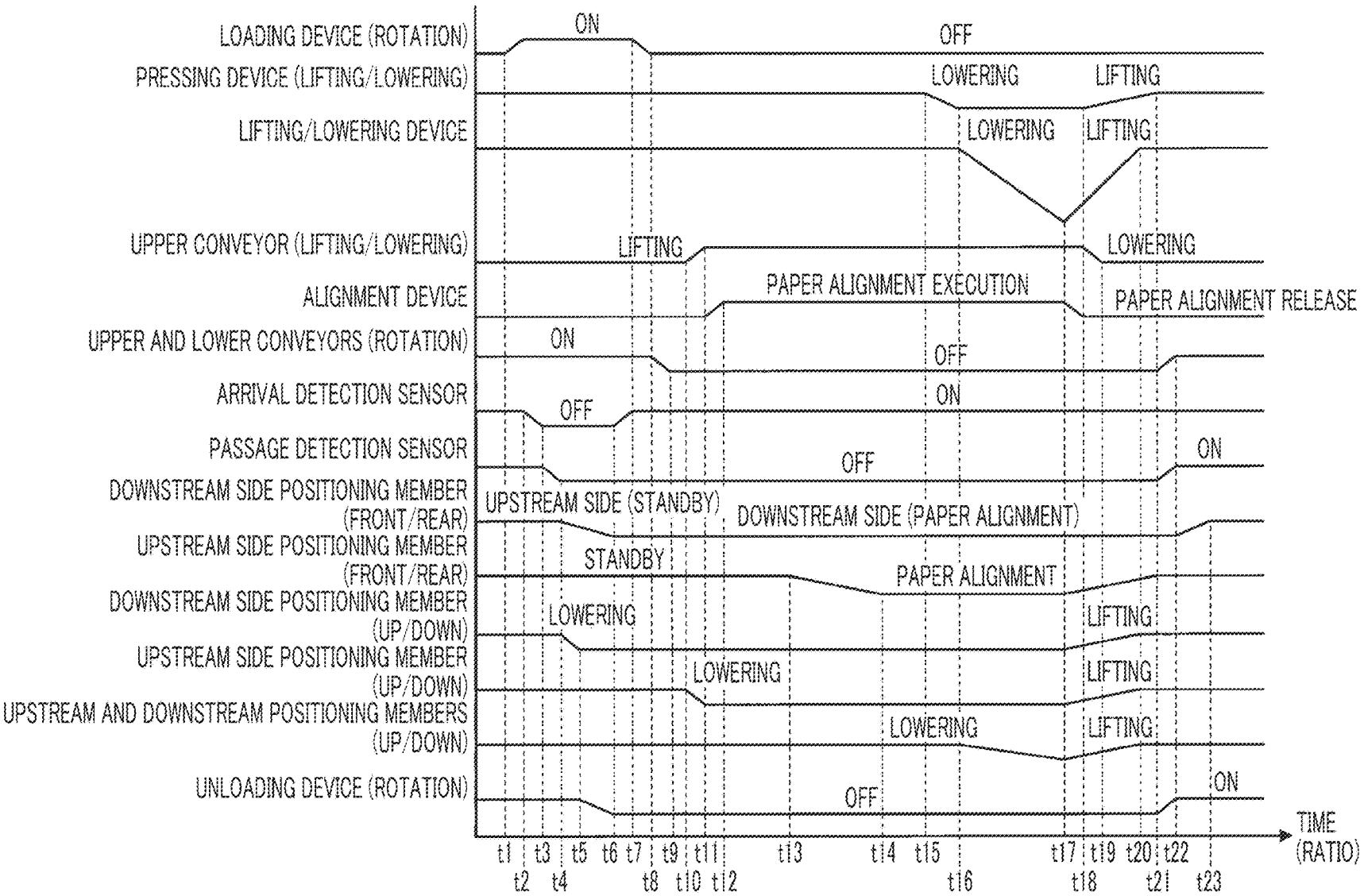
FIG. 17 is a time chart illustrating operation in the cardboard box dividing device.
Figure 19:
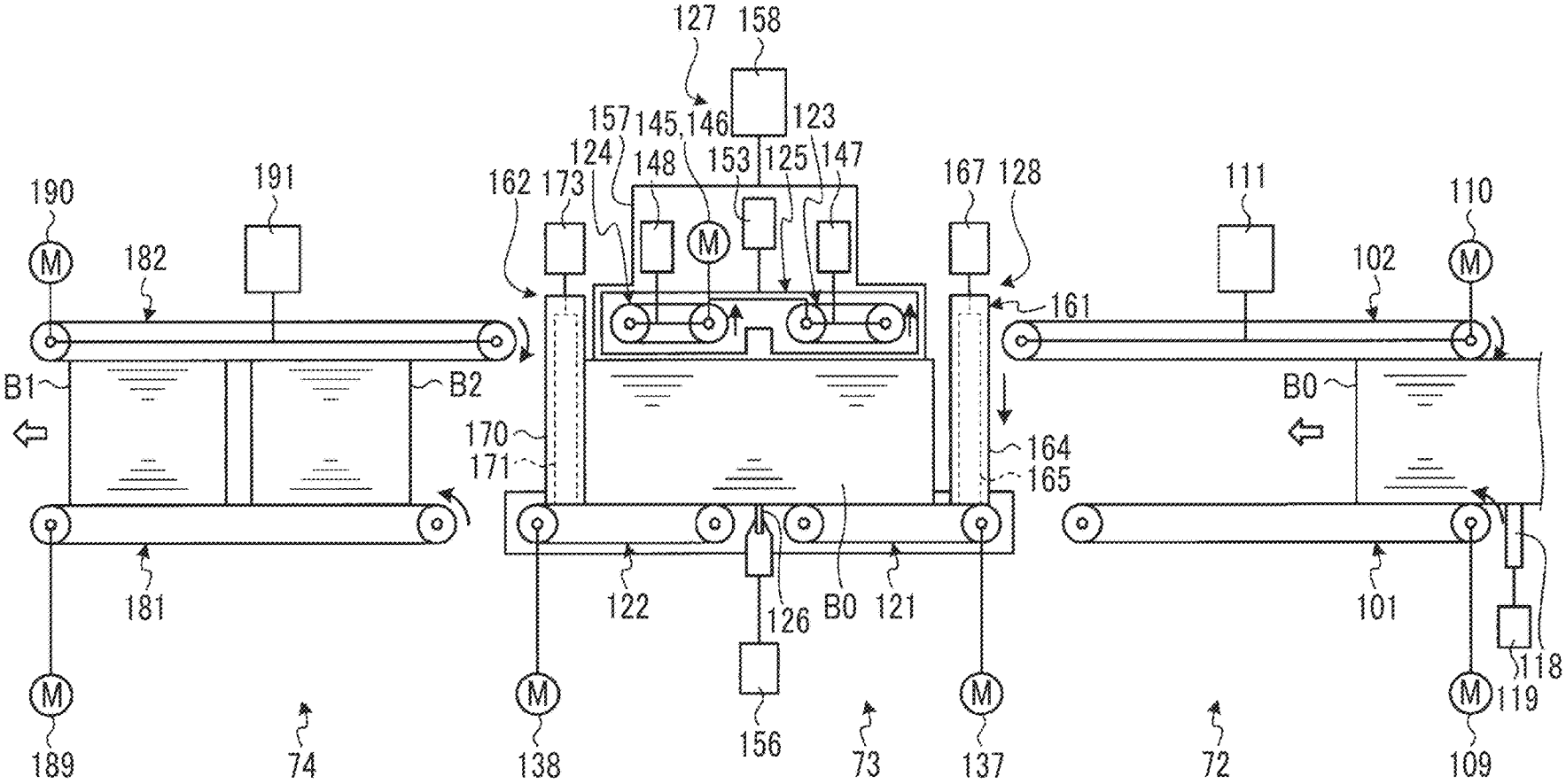
FIG. 19 is a schematic diagram illustrating the retreat state of the upper conveyor.
Figure 20:
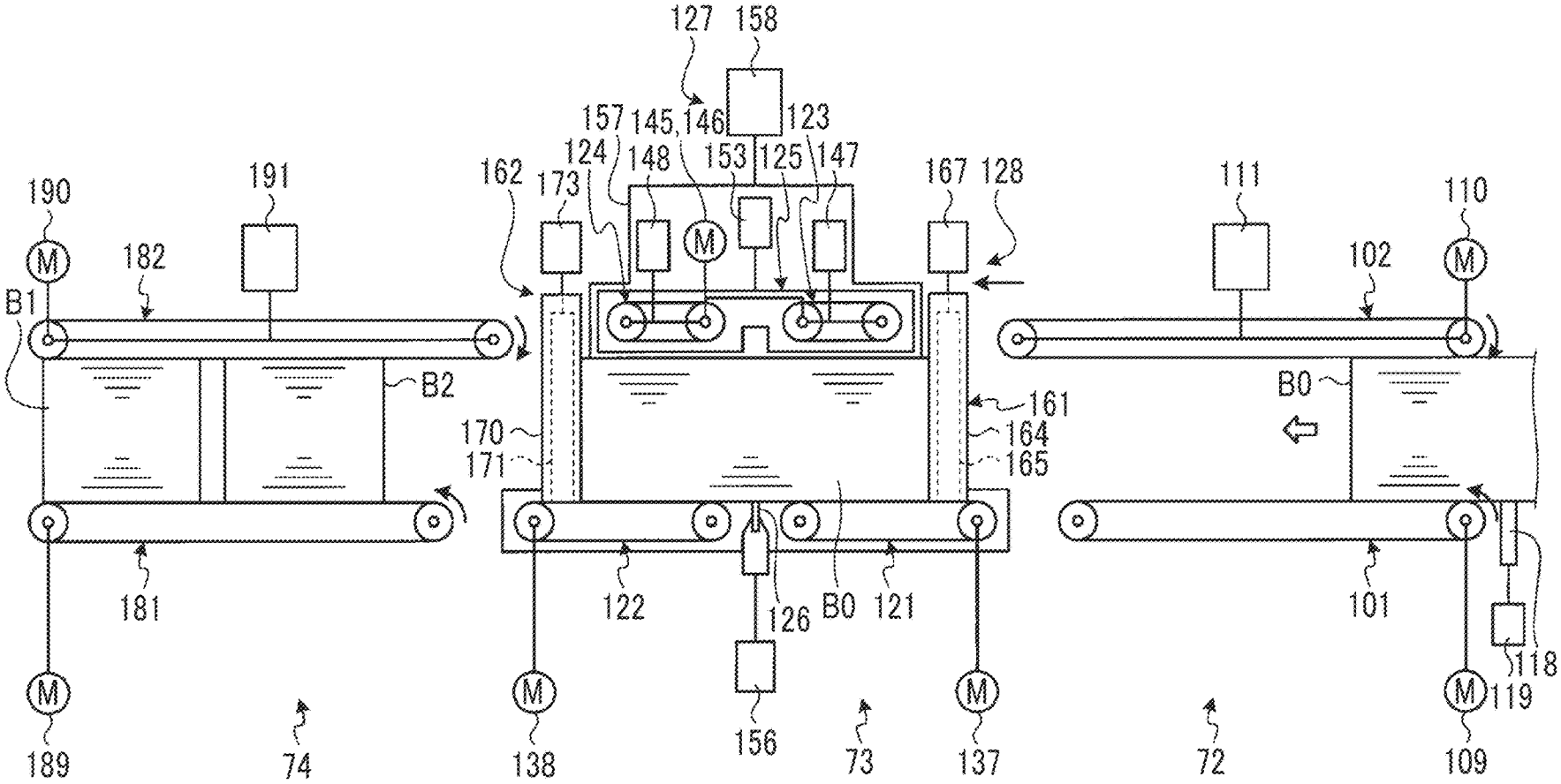
FIG. 20 is a schematic diagram illustrating the state of positioning by a positioning member.
Figure 21:
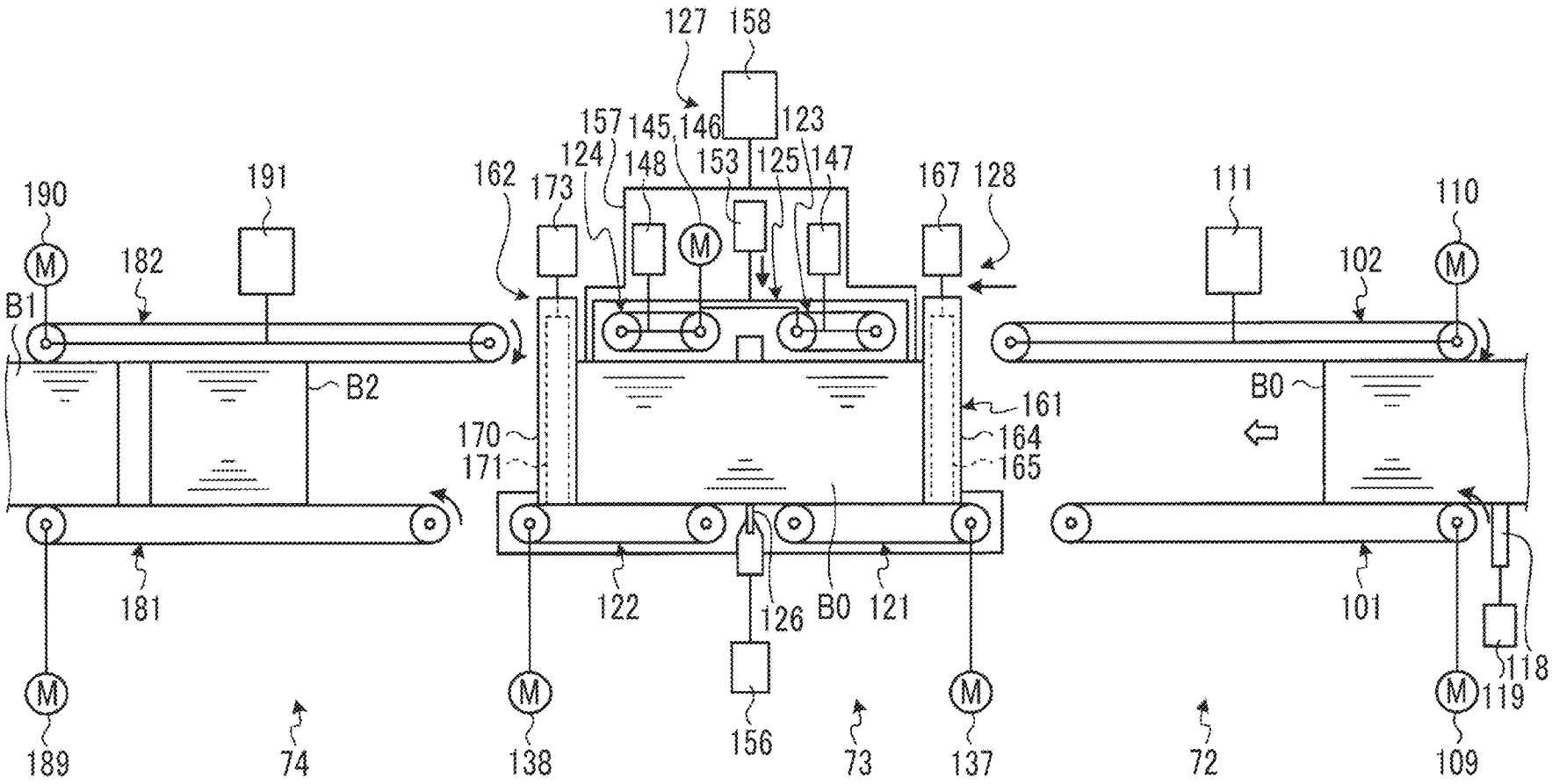
FIG. 21 is a schematic diagram illustrating the state of pressing by a pressing device.
Figure 22:
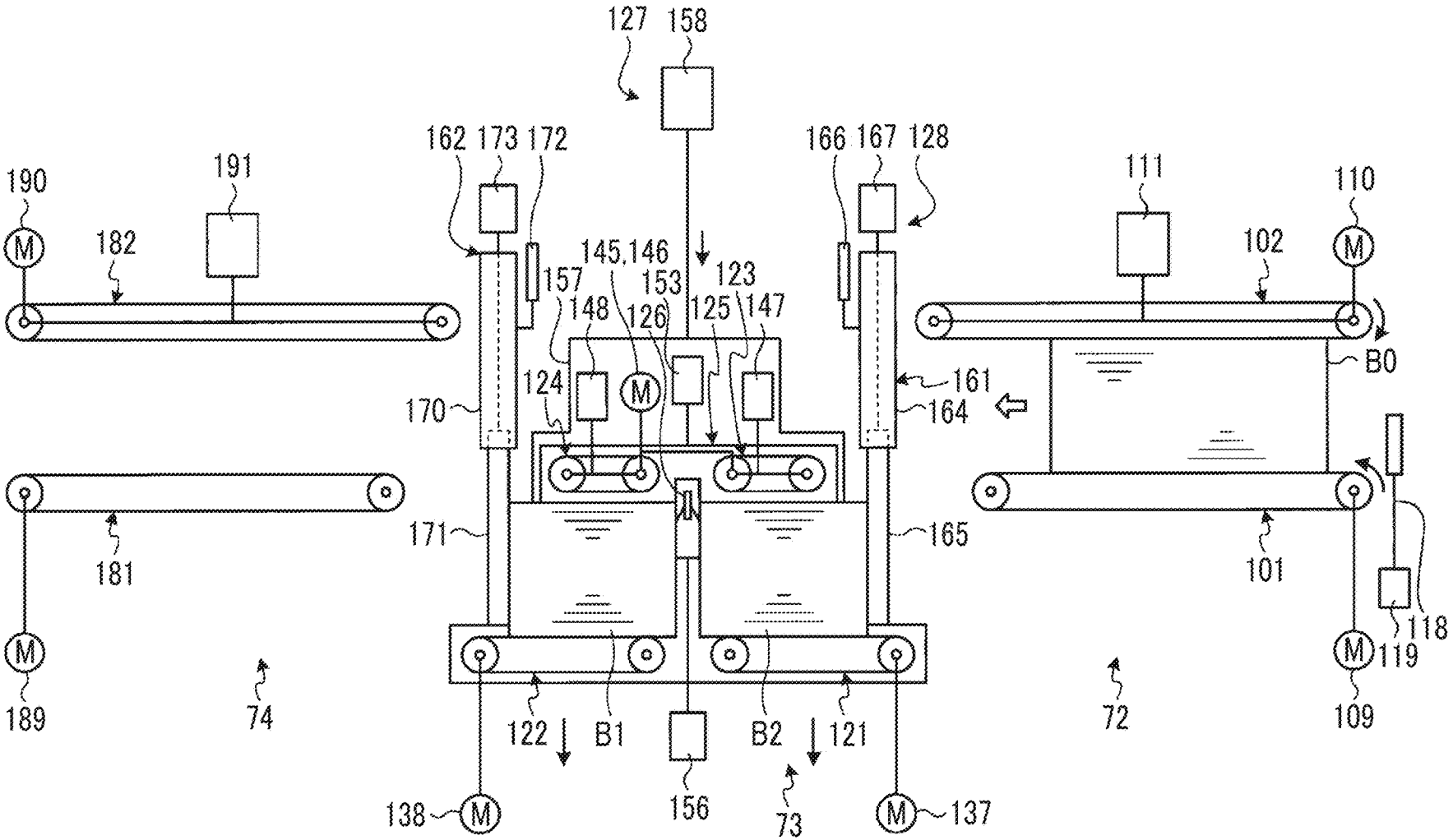
FIG. 22 is a schematic diagram illustrating the state of cutting by the lowering of the connected cardboard box body.
Figure 23:
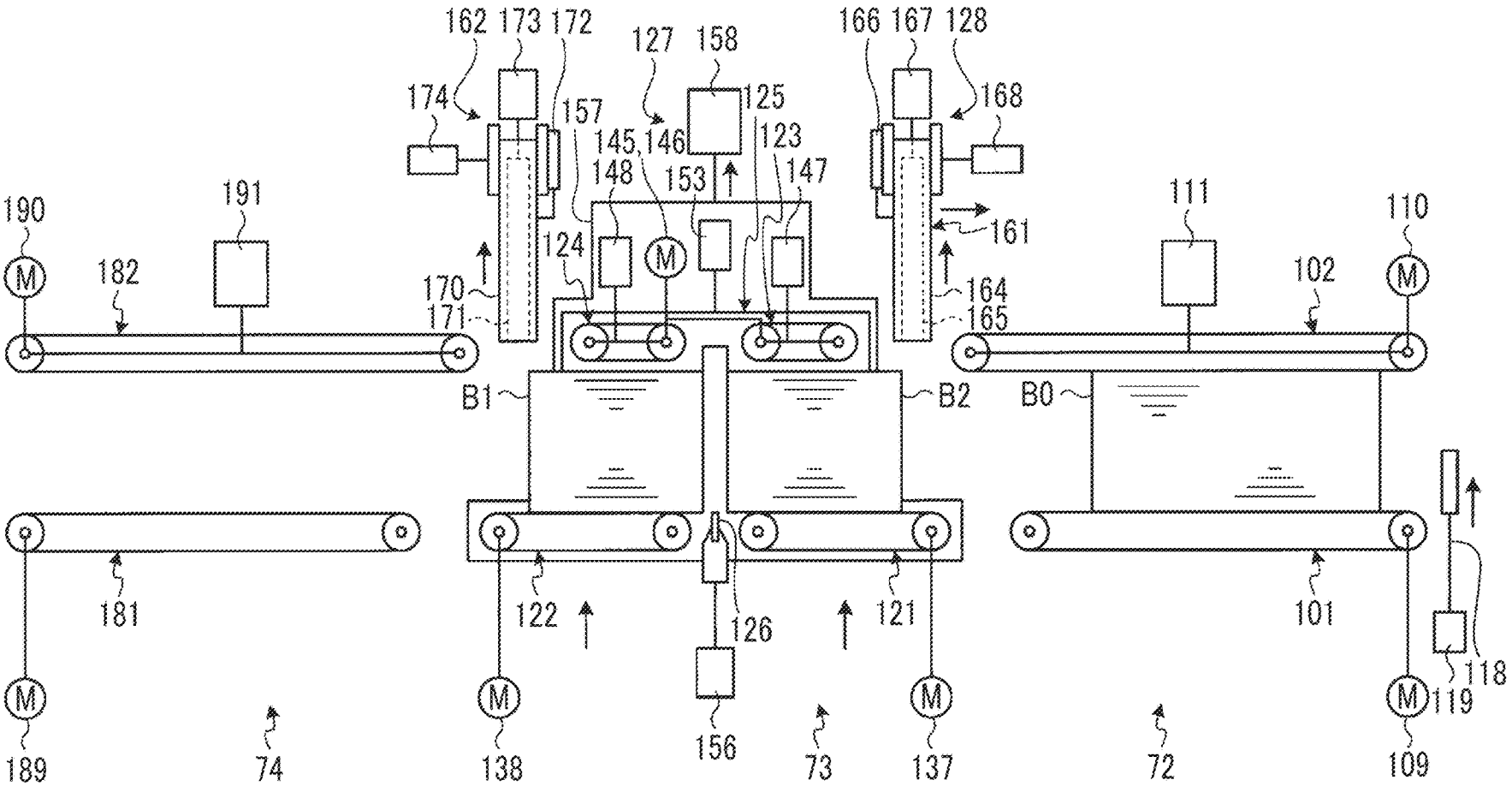
FIG. 23 is a schematic diagram illustrating the lifting state of a cardboard box.
Figure 24:
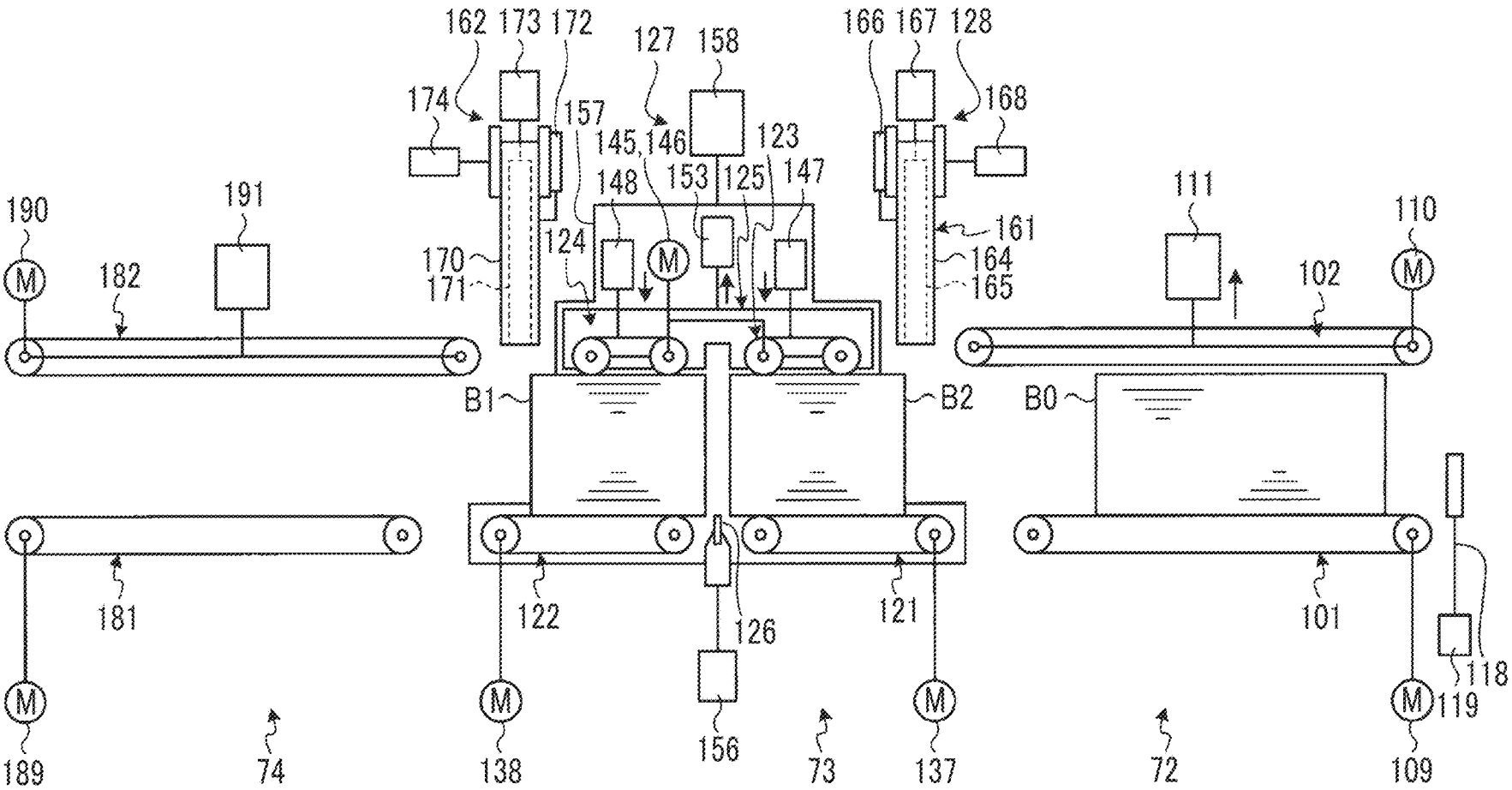
FIG. 24 is a schematic diagram illustrating the support state of the upper conveyor.
Figure 25:
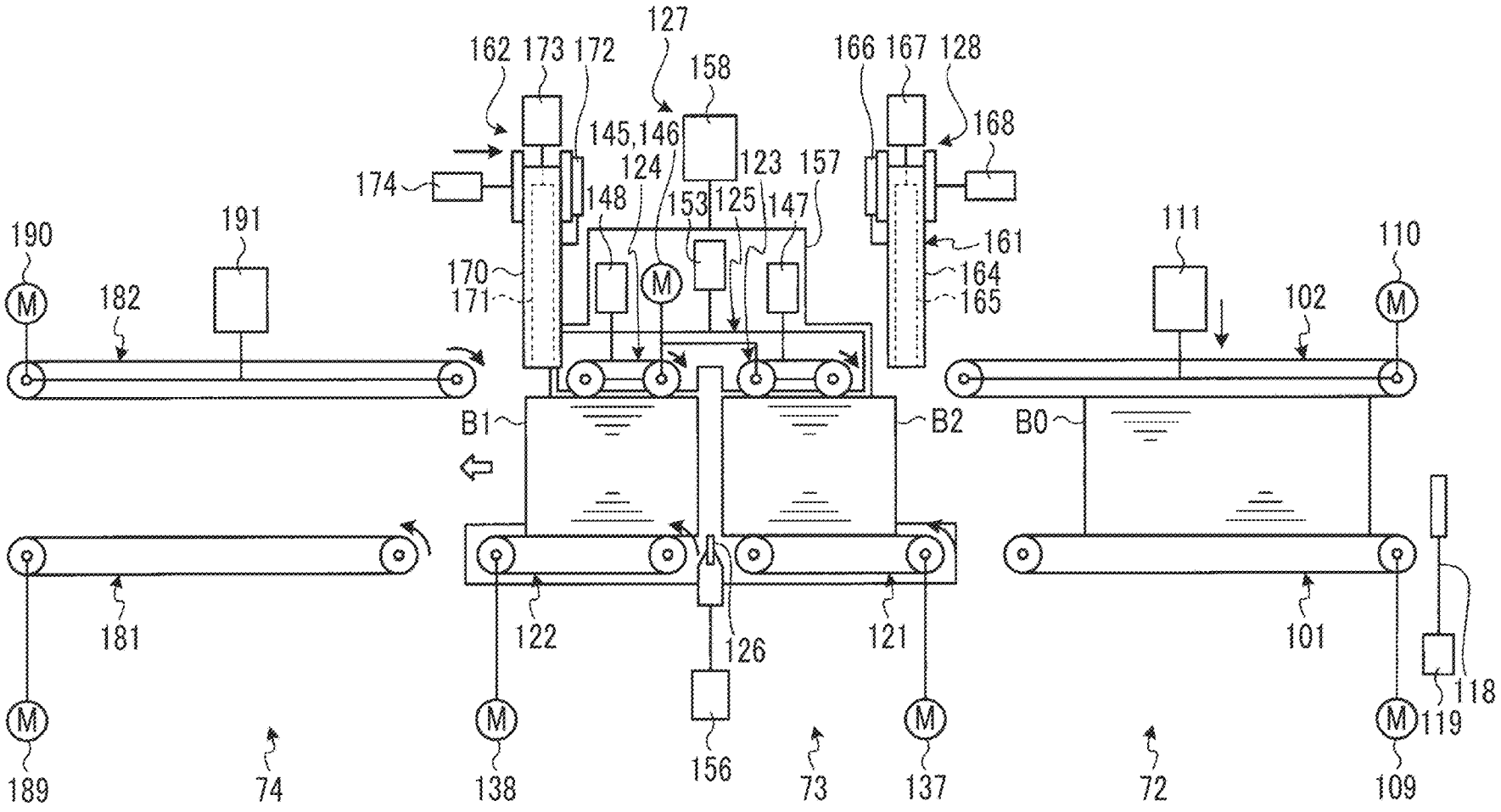
FIG. 25 is a schematic diagram illustrating the movement state of a downstream side positioning member.
Figure 26:
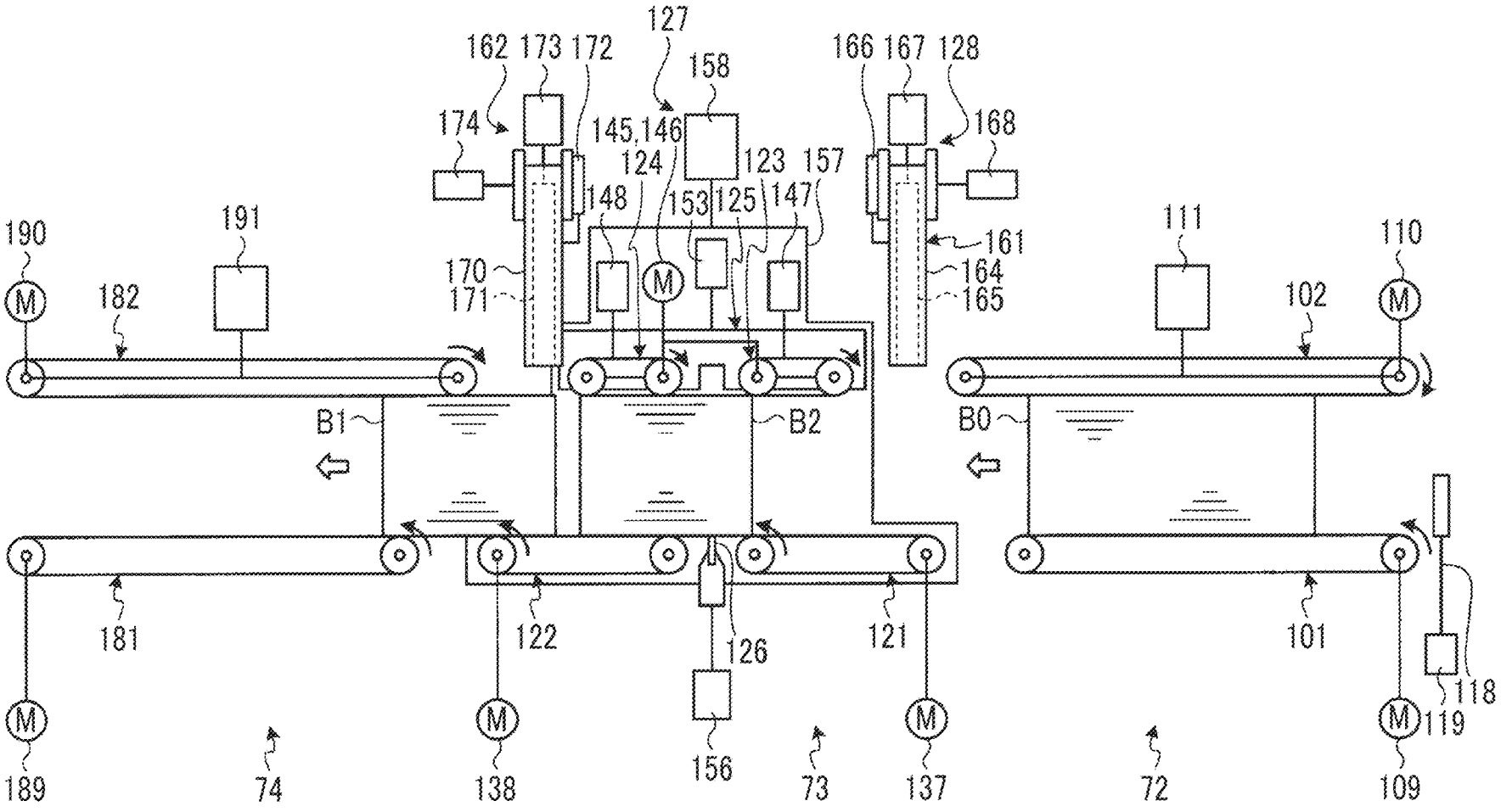
FIG. 26 is a schematic diagram illustrating the unloading state of the cardboard box.
Figure 27:
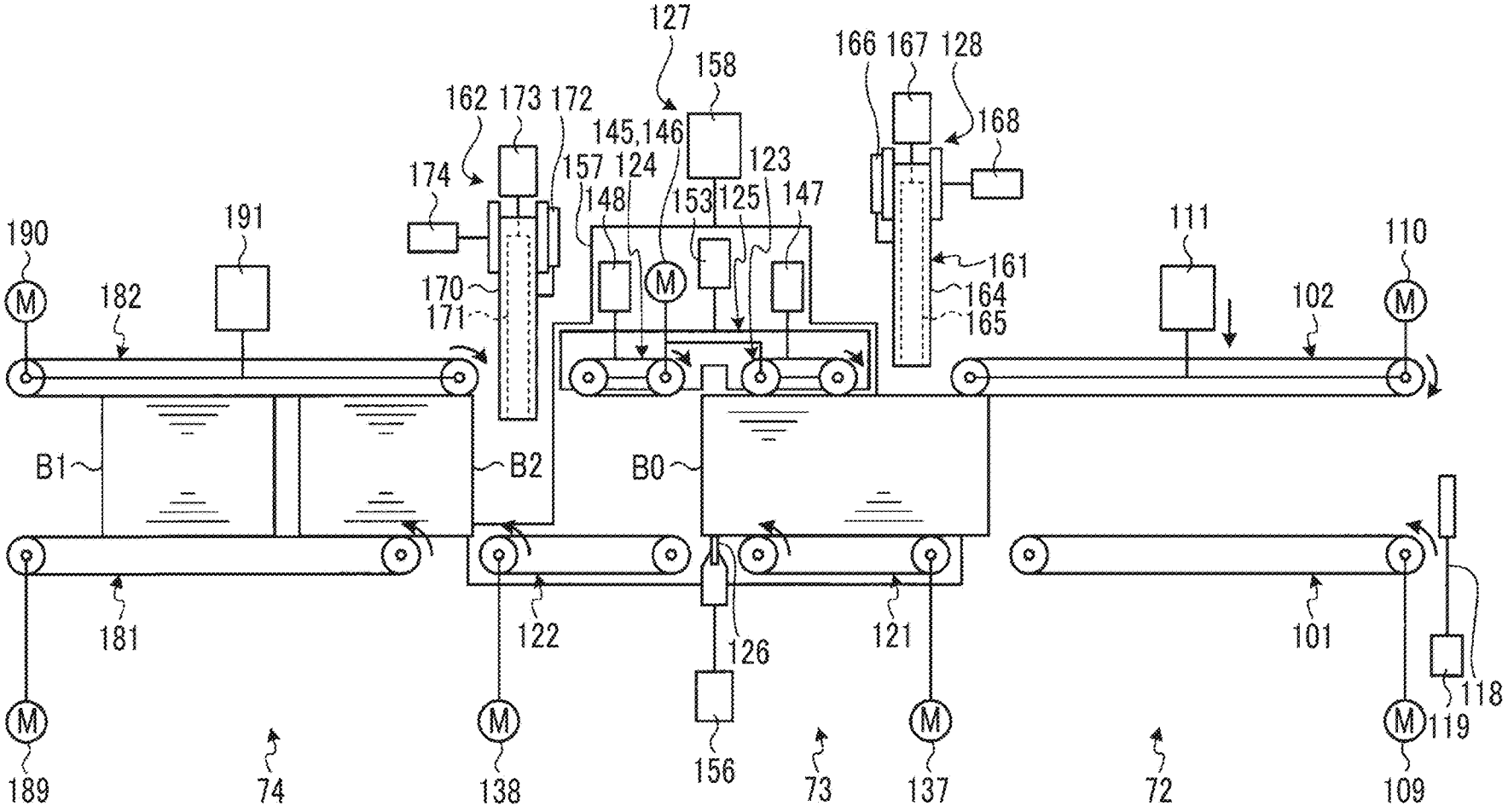
FIG. 27 is a schematic diagram illustrating the unloading state of the cardboard box and the loading state of the connected cardboard box body.

Next, the operation of the dividing device 71 in the cardboard box production device 10 of the present embodiment will be described in detail. FIG. 17 is a time chart illustrating operation in the cardboard box dividing device, FIG. 18 is a schematic diagram illustrating the loading state of the connected cardboard box body, FIG. 19 is a schematic diagram illustrating the retreat state of the upper conveyor, FIG. 20 is a schematic diagram illustrating the state of positioning by the positioning member, FIG. 21 is a schematic diagram illustrating the state of pressing by the pressing device, FIG. 22 is a schematic diagram illustrating the state of cutting by the lowering of the connected cardboard box body, FIG. 23 is a schematic diagram illustrating the lifting state of the cardboard box, FIG. 24 is a schematic diagram illustrating the support state of the upper conveyor, FIG. 25 is a schematic diagram illustrating the movement state of the downstream side positioning member, FIG. 26 is a schematic diagram illustrating the unloading state of the cardboard box, and FIG. 27 is a schematic diagram illustrating the unloading state of the cardboard box and the loading state of the connected cardboard box body.

As illustrated in FIGS. 2 and 17, the cut cardboard boxes B1 and B2 are unloaded until time t5. When this unloading is completed, the unloading lower conveyor 181 and the unloading upper conveyor 182 in the unloading device 74 stop the drive rotation of the respective drive motors 189 and 190 at time t5 and completely stop at time t6. The arrival detection sensor 232 is turned OFF from time t2 to t3, and the passage detection sensor 233 is turned OFF from time t3 to t4.

At time t1, the loading lower conveyor 101 and the loading upper conveyor 102 in the loading device 72 start to operate by the drive rotation of the respective drive motors 109 and 110. In addition, the inlet side lower conveyor 121, the outlet side lower conveyor 122, the inlet side upper conveyor 123, and the outlet side upper conveyor 124 in the cutting device 73 are in operation by the drive rotation of the respective drive motors 137, 138, 145, and 146. Accordingly, the connected cardboard box body B0 is loaded by the loading device 72 and supplied to the cutting device 73. In addition, the first drive device 172 is driven and lowering is performed with the inner cylinder 171 held in the outer cylinder 170 of the downstream side positioning member 162 from time t4 to t5, and the third drive device 174 is driven, the downstream side positioning member 162 moves to the downstream side in the transport direction Da, and the downstream side positioning member 162 stops at a paper alignment position from time t4 to t6.

Figure 18:
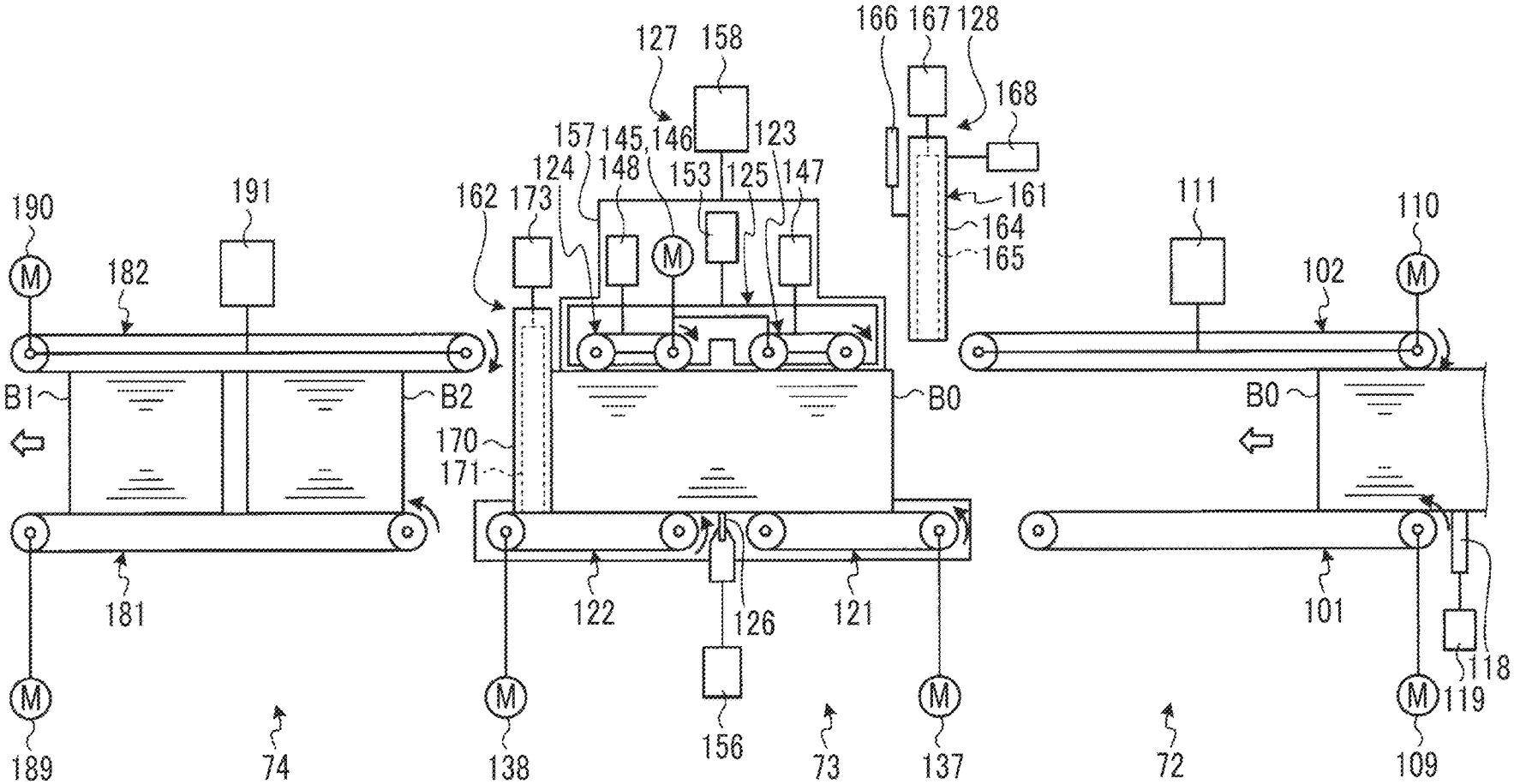
FIG. 18 is a schematic diagram illustrating the loading state of a connected cardboard box body.

As illustrated in FIGS. 17 and 18, when the connected cardboard box body B0 is supplied to a predetermined cutting position in the cutting device 73, the arrival detection sensor 232 detects the leading edge of the connected cardboard box body B0 and is turned ON from time t6 to t7. Then, the loading lower conveyor 101 and the loading upper conveyor 102 in the loading device 72 stop operating from time t7 to t8. In addition, the inlet side lower conveyor 121, the outlet side lower conveyor 122, the inlet side upper conveyor 123, and the outlet side upper conveyor 124 in the cutting device 73 stop operating from time t8 to t9.

As illustrated in FIGS. 17 and 19, when the connected cardboard box body B0 stops at a predetermined cutting position in the cutting device 73, the inlet side upper conveyor 123 and the outlet side upper conveyor 124 ascend from time t10 to t11 and the support of the upper portion of the connected cardboard box body B0 is released. In addition, the upstream side positioning member 161 descends from time t10 to t11 with the inner cylinder 165 held in the outer cylinder 164. Here, as illustrated in FIGS. 17 and 20, the left side portion alignment device 175 and the right side portion alignment device 176 operate (paper alignment execution) from time t11 to t12 and perform paper alignment in the width direction Db on the plurality of connected cardboard box bodies B0 stacked on the inlet side lower conveyor 121 and the outlet side lower conveyor 122. In addition, the outer cylinder 164 moves to the downstream side in the transport direction Da from time t13 to t14 and the upstream side positioning member 161 performs paper alignment in the transport direction Da on the plurality of connected cardboard box bodies B0 stacked on the inlet side lower conveyor 121 and the outlet side lower conveyor 122 together with the outer cylinder 170 of the downstream side positioning member 162.

Then, as illustrated in FIGS. 17 and 21, the upstream side positioning member 161 and the downstream side positioning member 162 exert a descending-direction stress on each of the inner cylinders 165 and 171 from time t16 to t17. The pressing device 125 performs pressing support on the plurality of connected cardboard box bodies B0 stacked on the inlet side lower conveyor 121 and the outlet side lower conveyor 122 by lowering the width direction pressing members 149 and 150 and the transport direction pressing members 151 and 152 from time t15 to t16. At this time, the control device 231 pre-calculates and stores an appropriate pressing height in the plurality of stacked connected cardboard box bodies B0 in the loading device 72, each of the pressing members 149, 150, 151, and 152 is lowered to the appropriate pressing height by the pressing drive device 153, and the plurality of connected cardboard box bodies B0 are pressed and supported.

The plurality of connected cardboard box bodies B0 are lowered by the lifting/lowering device 127 operating from time t16 to t17 as illustrated in FIGS. 17 and 22 when the plurality of connected cardboard box bodies B0 stacked on the inlet side lower conveyor 121 and the outlet side lower conveyor 122 are supported by the left side portion alignment device 175, the right side portion alignment device 176, the upstream side positioning member 161, the downstream side positioning member 162, the width direction pressing members 149 and 150, and the transport direction pressing members 151 and 152. Then, as a result of the lowering operation of the plurality of connected cardboard box bodies B0, the cutting blade 126 relatively ascends, cuts the plurality of connected cardboard box bodies B0 along the width direction Db, and turns the plurality of connected cardboard box bodies B0 into the plurality of cardboard boxes B1 and B2. When the plurality of connected cardboard box bodies B0 descend, the respective inner cylinders 165 and 171 of the upstream side positioning member 161 and the downstream side positioning member 162, which are respectively narrower in width than the outer cylinders 164 and 170, descend, and thus a gap is ensured between the plurality of connected cardboard box bodies B0. When the plurality of connected cardboard box bodies B0 are cut by the cutting blade 126, the plurality of cardboard boxes B1 are slightly movable in the range of the gap toward the downstream side in the transport direction Da and the plurality of cardboard boxes B2 are slightly movable in the range of the gap toward the upstream side in the transport direction Da.

When the plurality of connected cardboard box bodies B0 are cut into the plurality of cardboard boxes B1 and B2, the lifting/lowering device 127 operates from time t17 to t20 and the plurality of cardboard boxes B1 and B2 are lifted as illustrated in FIGS. 17 and 23. At this time, the left side portion alignment device 175 and the right side portion alignment device 176 operate (paper alignment release) from time t17 to t18 and move to the standby position separated from the cardboard boxes B1 and B2. In addition, the upstream side positioning member 161 and the downstream side positioning member 162 ascend from time t17 to t20. The upstream side positioning member 161 moves to the upstream side in the transport direction Da from time t17 to t21.

In addition, when the plurality of cardboard boxes B1 and B2 ascend, the pressing device 125 lifts the width direction pressing members 149 and 150 and the transport direction pressing members 151 and 152 from time t18 to t21 as illustrated in FIGS. 17 and 24, and the pressing support of the plurality of cardboard boxes B1 and B2 stacked on the inlet side lower conveyor 121 and the outlet side lower conveyor 122 is released as a result. Meanwhile, the inlet side upper conveyor 123 and the outlet side upper conveyor 124 descend from time t18 to t19 and support the upper portions of the cardboard boxes B1 and B2. In addition, as illustrated in FIGS. 17 and 25, the unloading lower conveyor 181 and the unloading upper conveyor 182 in the unloading device 74, the inlet side lower conveyor 121, the outlet side lower conveyor 122, the inlet side upper conveyor 123, and the outlet side upper conveyor 124 start operating at time t21. The downstream side positioning member 162 moves to the standby position on the upstream side in the transport direction Da from time t22 to t23. The passage detection sensor 233 detects the leading edge of the cardboard box B1 with unloading started and is turned ON from time t21 to t22.

Then, the plurality of cardboard boxes B1 and B2 are transferred from the cutting device 73 to the unloading device 74 as illustrated in FIGS. 17 and 26, and the plurality of cardboard boxes B1 and B2 are unloaded by the unloading device 74 as illustrated in FIGS. 17 and 27. Subsequently, the downstream side positioning member 162 descends.

As described above, the cardboard box dividing device of the present embodiment includes the lower conveyors 121 and 122 on which the plurality of connected cardboard box bodies B0 are stacked and transported, the pressing device 125 pressing the plurality of connected cardboard box bodies B0 stacked on the lower conveyors 121 and 122 from above, the cutting blade 126 disposed along the width direction Db of the connected cardboard box body B0 and dividing the plurality of connected cardboard box bodies B0 stacked on the lower conveyors 121 and 122 into the front and rear parts, the lifting/lowering device 127 relatively moving the plurality of connected cardboard box bodies B0 on the lower conveyors 121 and 122 and the cutting blade 126 along the up-down direction, and the control device 231 controlling the pressing device 125 on the basis of the lifting/lowering height of the loading upper conveyor 102 at a time when the pressing reaction force at a time when the loading upper conveyor (pressing measurement member) 102 presses the plurality of stacked connected cardboard box bodies B0 reaches the reference pressing reaction force.

Accordingly, the plurality of stacked connected cardboard box bodies B0 are mounted onto the lower conveyors 121 and 122 and transported, are pressed from above by the pressing device 125 at a predetermined cutting position stopped on the lower conveyors 121 and 122, and are cut and divided by the cutting blade 126 by the lifting/lowering device 127 relatively moving the plurality of connected cardboard box bodies B0 and the cutting blade 126 in that state. At this time, the control device 231 pre-obtains the lifting/lowering height of the loading upper conveyor 102 at a time when the loading upper conveyor 102 presses the plurality of stacked connected cardboard box bodies B0 and the pressing reaction force at this time reaches the reference pressing reaction force and controls the pressing device 125 on the basis of the lifting/lowering height of the loading upper conveyor 102, and the plurality of connected cardboard box bodies B0 are pressed with an appropriate pressure. As a result, the connected cardboard box body B0 is held at an appropriate pressure when cut, and thus the connected cardboard box body B0 can be stably cut and production precision can be improved.

The cardboard box dividing device of the present embodiment is provided with the height sensor 252, the height sensor 252 detects the lifting/lowering height of the loading upper conveyor 102 at a time when the pressing reaction force acting on the loading upper conveyor 102 from the plurality of stacked connected cardboard box bodies B0 reaches the reference pressing reaction force, and the control device 231 controls the pressing device 125 on the basis of the detection result of the height sensor 252. Accordingly, the lifting/lowering height of the loading upper conveyor 102 at a time when the pressing reaction force acting on the loading upper conveyor 102 from the connected cardboard box body B0 reaches the reference pressing reaction force can be detected with high precision by the height sensor 252, and thus the connected cardboard box body B0 can be held at an appropriate pressure when cut.

In the cardboard box dividing device of the present embodiment, the pressing members 149, 150, 151, and 152 supported so as to be capable of ascending and descending and the pressing drive device 153 lifting and lowering the pressing members 149, 150, 151, and 152 are provided as the pressing device 125, and the control device 231 adjusts the pressing position of the pressing members 149, 150, 151, and 152 by the pressing drive device 153 on the basis of the lifting/lowering height of the loading upper conveyor 102 at a time when the pressing reaction force from the connected cardboard box body B0 reaches the reference pressing reaction force. Accordingly, the connected cardboard box body B0 can be held at an appropriate pressure by the pressing members 149, 150, 151, and 152 when cut.

In the cardboard box dividing device of the present embodiment, the loading lower conveyor 101 is disposed upstream of the lower conveyors 121 and 122 in the transport direction Da of the connected cardboard box body B0, the loading upper conveyor 102 is disposed so as to face the loading lower conveyor 101 from above, and the loading upper conveyor 102 is a pressing measurement member. Accordingly, it is possible to obtain an appropriate pressing position of the connected cardboard box body B0 by the pressing device 125 in the loading device 72 before the cutting blade 126 of the cutting device 73 cuts the connected cardboard box body B0, and it is possible to expedite the cutting work of the connected cardboard box body B0.

In the cardboard box dividing device of the present embodiment, the loading upper conveyor 102 as a pressing measurement member has a configuration in which the lower frame (lower pressing member) 261 and the upper frame (upper pressing member) 262 are allowed to approach and separate from each other and are urged and supported in the direction of separation by the air cylinder (urging member) 264, the upper frame 262 is allowed to move along the up-down direction by the loading upper conveyor moving device (pressing member moving device) 111, and the control device 231 controls the pressing device 125 on the basis of the lifting/lowering height of the lower frame 261 at a time when the pressing reaction force acting on the lower frame 261 from the connected cardboard box body B0 reaches the reference pressing reaction force. Accordingly, the plurality of stacked connected cardboard box bodies B0 are pressed by the lower frame 261 by the loading upper conveyor moving device 111 lowering the lower frame 261 and the upper frame 262, the lower frame 261 moves to the upper frame 262 side against the urging support force of the air cylinder 264 at this time, and the pressing reaction force reaches the reference pressing reaction force. As a result, it is possible to easily detect that the pressing reaction force reaches the reference pressing reaction force by the movement of the lower frame 261 and structural simplification can be achieved.

In the cardboard box dividing device of the present embodiment, the air cylinder (fluid pressure cylinder) 264 is provided as an urging member, the lower frame 261 can be lifted and lowered with respect to the upper frame 262, and the lower frame 261 is urged downward and supported with respect to the upper frame 262. Accordingly, the air cylinder 264 is capable of functioning as a device for lifting and lowering the lower frame 261 and functioning as a device for detecting the pressing reaction force. Device size reduction can be achieved by the urging member having the plurality of functions.

In the cardboard box dividing device of the present embodiment, the electropneumatic converter 272 is provided as an urging support force adjusting device adjusting the urging support force of the lower frame 261 by the air cylinder 264. Accordingly, the urging support force of the lower frame 261 by the air cylinder 264 is adjusted by the electropneumatic converter 272, and thus it is possible to adjust the reference pressing reaction force in accordance with the type of the connected cardboard box body B0, and it is possible to obtain an appropriate pressing position of the connected cardboard box body B0 by the pressing device 125 regardless of the type of the connected cardboard box body B0.

In the cardboard box dividing device of the present embodiment, the control device 231 lowers the loading upper conveyor 102 when the pressing reaction force acting on the loading upper conveyor 102 from the connected cardboard box body B0 is yet to reach the reference pressing reaction force with the connected cardboard box body B0 loaded on the loading lower conveyor 101 and controls the pressing device 125 on the basis of the lifting/lowering height at a time when the pressing reaction force acting on the loading upper conveyor 102 from the connected cardboard box body B0 reaches the reference pressing reaction force. Accordingly, the connected cardboard box body B0 is pressed by the loading upper conveyor 102 being lowered when the height of the connected cardboard box body B0 loaded on the loading lower conveyor 101 is low and the pressing device 125 is controlled on the basis of the lifting/lowering height at a time when the pressing reaction force acting on the loading upper conveyor 102 reaches the reference pressing reaction force, and thus it is possible to obtain an appropriate pressing position of the connected cardboard box body B0 by the pressing device 125 even when the height of the connected cardboard box body B0 is low.

In the cardboard box dividing device of the present embodiment, the control device 231 lifts the loading upper conveyor 102 when the pressing reaction force acting on the loading upper conveyor 102 from the connected cardboard box body B0 reaches the reference pressing reaction force with the connected cardboard box body B0 loaded on the loading lower conveyor 101 and controls the pressing device 125 on the basis of the lifting/lowering height at a time when the pressing reaction force acting on the loading upper conveyor 102 from the connected cardboard box body B0 falls below the reference pressing reaction force. Accordingly, the loading upper conveyor 102 is lifted and separated from the connected cardboard box body B0 when the height of the connected cardboard box body B0 loaded on the loading lower conveyor 101 is high and the pressing device 125 is controlled on the basis of the lifting/lowering height at a time when the pressing reaction force acting on the loading upper conveyor 102 falls below the reference pressing reaction force, and thus it is possible to obtain an appropriate pressing position of the connected cardboard box body B0 by the pressing device 125 even when the height of the connected cardboard box body B0 is high.

In the cardboard box dividing device of the present embodiment, the loading upper conveyor 102 disposed so as to face the loading lower conveyor 101 from above is a pressing measurement member. Accordingly, there is no need to separately prepare a pressing measurement member, and it is possible to suppress an increase in structural complexity.

In addition, the cardboard box production device of the present embodiment includes the sheet feeding section 11 supplying the double box sheet S0, the slotter creaser section 31 performing creasing line processing on the surface of the double box sheet S0 and performing grooving, the folding section 51 forming the connected cardboard box body B0 by folding the double box sheet S0 and bonding the end portions, the counter-ejector section 61 discharging a predetermined number of the connected cardboard box bodies B0 at a time after stacking the connected cardboard box bodies B0 while counting the connected cardboard box bodies B0, and the dividing device 71 for cutting and dividing the connected cardboard box body B0 along the width direction Db intersecting with the transport direction Da.

Accordingly, the creasing line processing and the grooving are performed on the double box sheet S0 from the sheet feeding section 11 by the slotter creaser section 31, the connected cardboard box body B0 is formed by the double box sheet S0 being folded by the folding section 51 and the end portions being bonded, the box bodies are stacked while being counted by the counter-ejector section 61, the connected cardboard box body B0 is cut by the dividing device 71, and the cardboard boxes B1 and B2 are produced as a result. At this time, the control device 231 pre-obtains the lifting/lowering height of the loading upper conveyor 102 at a time when the loading upper conveyor 102 presses the plurality of stacked connected cardboard box bodies B0 and the pressing reaction force at this time reaches the reference pressing reaction force and controls the pressing device 125 on the basis of the lifting/lowering height of the loading upper conveyor 102, and the plurality of connected cardboard box bodies B0 are pressed with an appropriate pressure. As a result, the connected cardboard box body B0 is held at an appropriate pressure when cut, and thus the connected cardboard box body B0 can be stably cut and production precision can be improved.

Figure 29:
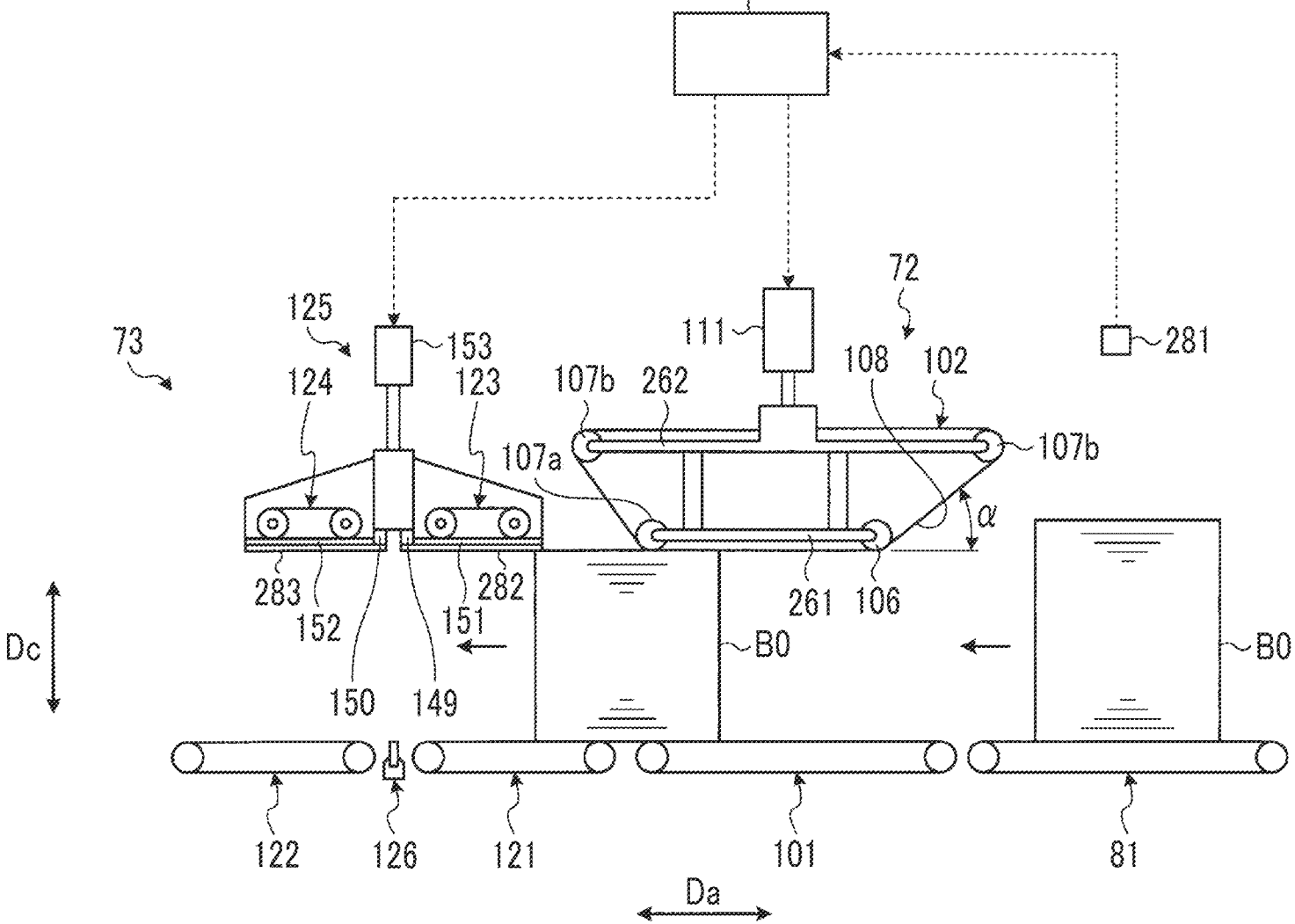
FIG. 29 is a schematic configuration diagram illustrating the loading side in a cardboard box dividing device according to another embodiment.

It should be noted that the cardboard box dividing device of the present invention is not limited to the above-described embodiment. FIG. 29 is a schematic configuration diagram illustrating the loading side in a cardboard box dividing device according to another embodiment. It should be noted that the basic configuration of this embodiment is the same as the basic configuration of the above-described embodiment, the basic configuration of this embodiment will be described with reference to FIG. 2, and members having the same functions as in the above-described embodiment will be denoted by the same reference numerals with detailed description thereof omitted.

In the cardboard box production device of this embodiment, the dividing device 71 has the loading device 72, the cutting device 73, and the unloading device 74 as illustrated in FIG. 2. Here, the loading device 72, the cutting device 73, and the unloading device 74 are substantially the same as in the above-described embodiment. As for the dividing device 71, the transport conveyor (connected cardboard box body transport conveyor) 81 is disposed upstream of the loading device 72 in the transport direction Da. The transport conveyor 81 supplies the loading device 72 with the plurality of connected cardboard box bodies B0 discharged from the counter-ejector section 61 (see FIG. 1).

As illustrated in FIG. 29, the loading device 72 has the loading lower conveyor 101 and the loading upper conveyor 102, and the loading upper conveyor 102 is supported by the loading upper conveyor moving device 111 so as to be movable up and down. A height sensor (connected body height detector) 281 is provided above the transport conveyor 81. The height sensor 281 detects the height of the plurality of stacked connected cardboard box bodies B0 above the transport conveyor 81. This height sensor 281 is, for example, a laser sensor. The control device 231 controls the loading upper conveyor moving device 111 on the basis of the detection result of the height sensor 281.

In other words, the loading upper conveyor 102 has a configuration in which the lower frame 261 and the upper frame 262 are provided with the driving roller 106 and the plurality of driven rollers 107*a* and 107*b* and the transport belt 108 is wound around the driving roller 106 and each of the driven rollers 107*a* and 107*b*. At this time, it is desirable that an angle α of the transport belt 108 on the loading side in the loading upper conveyor 102 is set to, for example, 45 degrees or less. The angle α of the transport belt 108 on the loading side is the angle of the transport belt 108 between the driving roller 106 and the driven roller 107*b* with respect to the horizontal direction.

Further, the plurality of connected cardboard box bodies B0 on the transport conveyor 81 are merely stacked, and thus the stacking height varies with the thickness of the material or the like. Accordingly, the height sensor 281 detects the height of the plurality of connected cardboard box bodies B0 on the transport conveyor 81, and the control device 231 adjusts the height of the loading upper conveyor 102 by means of the loading upper conveyor moving device 111 on the basis of the height of the plurality of connected cardboard box bodies B0 on the transport conveyor 81. It is desirable to adjust the height of the loading upper conveyor 102 such that the uppermost position of the plurality of connected cardboard box bodies B0 on the transport conveyor 81 is the position of the transport belt 108 between the driving roller 106 and the driven roller 107*b* in the loading upper conveyor 102.

In addition, as illustrated in FIG. 2, the control device 231 obtains the lifting/lowering height of the loading upper conveyor 102 at a time when the pressing device 125 presses the plurality of stacked connected cardboard box bodies B0 stacked on the loading upper conveyor 102 and the pressing reaction force at this time reaches the reference pressing reaction force, controls the pressing device 125 on the basis of the lifting/lowering height of the loading upper conveyor 102, and sets an appropriate pressing force of the plurality of connected cardboard box bodies B0. Then, the control device 231 lowers the plurality of connected cardboard box bodies B0 on the inlet side lower conveyor 121 and the outlet side lower conveyor 122 with respect to the cutting blade 126 by means of the lifting/lowering device 127. As a result, the plurality of connected cardboard box bodies B0 are cut by the cutting blade 126, divided into the front and rear parts, and turned into the cardboard boxes B1 and B2. At this time, the control device 231 performs control so as to gradually reduce the pressing force of the plurality of connected cardboard box bodies B0 by the pressing device 125 at a time when the cutting blade 126 divides the plurality of connected cardboard box bodies B0 into the front and rear parts.

In other words, the plurality of connected cardboard box bodies B0 on the inlet side lower conveyor 121 and the outlet side lower conveyor 122 are pressed from above by the pressing device 125 and supported by the left side portion alignment device 112 and the right side portion alignment device 113 so as not to move in the width direction Db. The plurality of connected cardboard box bodies B0 are lowered in this state and cut by the cutting blade 126, and thus cutting resistance is generated between the connected cardboard box body B0 and the cutting blade 126. When this cutting resistance is high, the cutting blade 126 may move the connected cardboard box body B0 in the width direction Db and may strongly press the alignment devices 112 and 113. Then, the alignment devices 112 and 113 may be damaged. Accordingly, when the cutting blade 126 cuts a large number of the connected cardboard box bodies B0, the control device 231 presses the connected cardboard box body B0 with a set pressing force. On the other hand, when the cutting blade 126 cuts a small number of the connected cardboard box bodies B0, the control device 231 presses the connected cardboard box body B0 with a pressing force lower than the set pressing force.

In this case, it is desirable that the control device 231 smoothly and steplessly reduces the pressing force of the pressing device 125 as the number of the connected cardboard box bodies B0 to be cut by the cutting blade 126 decreases. However, the control device 231 may decrease the pressing force of the pressing device 125 in stages as the number of the connected cardboard box bodies B0 to be cut by the cutting blade 126 decreases.

It should be noted that the pressing device 125 has the width direction pressing members 149 and 150 and the transport direction pressing members 151 and 152. The width direction pressing members 149 and 150 and the transport direction pressing members 151 and 152 can be reduced in weight by a resin material being adopted and are provided with friction resistance members 282 and 283 on the lower surface where the connected cardboard box body B0 is pressed. Accordingly, as for the pressing device 125, the width direction pressing members 149 and 150 and the transport direction pressing members 151 and 152 press the connected cardboard box body B0 via the friction resistance members 282 and 283, and thus it is possible to suppress a deviation at a time when the connected cardboard box body B0 is cut.

As described above, in the cardboard box dividing device of this embodiment, the height sensor 281 detecting the height of the plurality of stacked connected cardboard box bodies B0 is provided on the transport conveyor 81 and the control device 231 controls the loading upper conveyor moving device 111 on the basis of the detection result of the height sensor 281.

Accordingly, the loading upper conveyor 102 can be moved up and down in accordance with the height of the plurality of connected cardboard box bodies B0 transported to the loading lower conveyor 101 and the loading upper conveyor 102, and the loading lower conveyor 101 and the loading upper conveyor 102 are capable of stably receiving the plurality of connected cardboard box bodies B0 regardless of the height of the plurality of connected cardboard box bodies B0.

In the cardboard box dividing device of this embodiment, the control device 231 gradually reduces the pressing force of the plurality of connected cardboard box bodies B0 by the pressing device 125 at a time when the cutting blade 126 divides the plurality of connected cardboard box bodies B0 into the front and rear parts.

Accordingly, the pressing force of the connected cardboard box body B0 is reduced as the number of the connected cardboard box bodies B0 divided by the cutting blade 126 decreases, the reaction force acting on the cutting blade 126 from the connected cardboard box body B0 becomes an appropriate value, and damage during the division of the connected cardboard box body B0 can be suppressed.

It should be noted that the present invention is not limited to the configuration of the above-described embodiment in which the pressing position setting device 251 is disposed at the position of the loading device 72. For example, the pressing position setting device 251 may be disposed at the position of the cutting device 73 with the upper conveyors 123 and 124 applied as pressing measurement members. In addition, a dedicated pressure measurement member may be separately provided although the loading upper conveyor 102 is applied as a pressing measurement member.

In addition, the present invention is not limited to the configuration of the above-described embodiment in which the urging member (air cylinder 264), the height detector (height sensor 252), the detection piece 253, or the like is provided for detecting the pressing reaction force at a time when the pressing measurement member presses the plurality of stacked connected cardboard box bodies B0. For example, a load detection sensor such as a pressure measurement member load cell may be provided.

In addition, the present invention is not limited to the above-described embodiment in which the carton-forming machine 10A produces the connected cardboard box body B0 by processing the double box sheet S0 and the dividing device 71 produces the cardboard boxes B1 and B2 by cutting the connected cardboard box body B0. For example, a carton-forming machine may produce a connected cardboard box body by processing a triple box sheet and a dividing device may produce a cardboard box by cutting the connected cardboard box body into three pieces. In this case, the produced cardboard boxes may have the same size or different sizes. In other words, it is possible to produce the connected cardboard box bodies B0 that are different in size by shifting the stop position (cutting position) of the connected cardboard box body B0 in the cutting device 73 in the transport direction Da.

In addition, the connected cardboard box body B0 may be cut by being lifted with respect to the cutting blade 126 or the connected cardboard box body B0 may be cut by the cutting blade 126 being lifted or lowered with respect to the connected cardboard box body B0 although the connected cardboard box body B0 in the embodiment described above is cut by being lowered with respect to the cutting blade 126.

In addition, although the inlet side lower conveyor 121 and the outlet side lower conveyor 122 are provided as the lower conveyors and the inlet side upper conveyor 123 and the outlet side upper conveyor 124 are provided as the upper conveyors in the embodiment described above, the back-and-forth division may be replaced with integrated provision. In addition, an electric motor, a hydraulic motor, a hydraulic cylinder, an air cylinder, and so on may be used as the various drive devices.

In addition, the present invention is not limited to the configuration of the above-described embodiment in which the sheet feeding section 11, the printing section 21, the slotter creaser section 31, the die cutting section 41, the folding section 51, and the counter-ejector section 61 constitute the carton-forming machine 10A. For example, the printing section 21 may be omitted in a case where the cardboard sheet S or the connected cardboard box body B0 requires no printing. In addition, the die cutting section 41 may be omitted in a case where, for example, the cardboard sheet S or the connected cardboard box body B0 does not require punching of a hand hole or the like.

REFERENCE SIGNS LIST

10: Cardboard box production device
10A: Carton-forming machine
11: Sheet feeding section
21: Printing section
31: Slotter creaser section
41: Die cutting section
51: Folding section
61: Counter-ejector section
71: Cardboard box dividing device (dividing device)
72: Loading device
73: Cutting device
74: Unloading device
81: Transport conveyor (connected cardboard box body transport conveyor)
101: Loading lower conveyor
102: Loading upper conveyor (pressing measurement member)
109, 110: Drive motor
111: Loading upper conveyor moving device (pressing member moving device)
112: Left side portion alignment device
113: Right side portion alignment device
118: Opening-closing door
119: Drive cylinder
121: Inlet side lower conveyor (lower conveyor)
122: Outlet side lower conveyor (lower conveyor)
123: Inlet side upper conveyor (upper conveyor)
124: Outlet side upper conveyor (upper conveyor)
125: Pressing device
126: Cutting blade
127: Lifting/lowering device
128: Positioning device
137, 138, 145, 146: Drive motor
147: Inlet side upper conveyor moving device
148: Outlet side upper conveyor moving device
149, 150: Width direction pressing member

151, 152: Transport direction pressing member
153: Pressing drive device
156: Cutting blade drive device
157: Lifting/lowering base
158: Lifting/lowering drive device
161: Upstream side positioning member
162: Downstream side positioning member
163, 169: Supporting cylinder
164, 170: Outer cylinder
165, 171: Inner cylinder
166, 172: First drive device (positioning drive device)
167, 173: Second drive device (positioning drive device)
168, 174: Third drive device (positioning drive device)
175: Left side portion alignment device
176: Right side portion alignment device
181: Unloading lower conveyor
182: Unloading upper conveyor
189, 190: Drive motor
191: Unloading upper conveyor moving device
231: Control device
232: Arrival detection sensor
233: Passage detection sensor
251: Pressing position setting device
252: Height sensor (height detector)
261: Lower frame (lower pressing member)
262: Upper frame (upper pressing member)
264: Air cylinder (urging member, fluid pressure cylinder)
272: Electropneumatic converter (urging support force adjusting device)
273: Rotary encoder
274: Inlet sensor
275: Loading device arrival sensor
281: Height sensor (connected body height detector)
S: Cardboard sheet
S1, S2: Single box sheet
S0: Double box sheet
B, B1, B2: Cardboard box
B0: Connected cardboard box body

The invention claimed is:

1. A cardboard box dividing device for cutting and dividing, along a width direction intersecting with a transport direction, a connected cardboard box laminate in which a plurality of connected cardboard box bodies continuous along the transport direction are stacked in a thickness direction, the cardboard box dividing device comprising:

a lower conveyor on which the plurality of connected cardboard box bodies are stacked and transported;

a pressing device pressing, from above, the plurality of connected cardboard box bodies stacked on the lower conveyor;

a cutting blade disposed along a width direction of the connected cardboard box body and dividing the plurality of connected cardboard box bodies stacked on the lower conveyor into a front part and a rear part;

a lifting/lowering device relatively moving the plurality of connected cardboard box bodies on the lower conveyor and the cutting blade along an up-down direction;

a pressing measurement member independently movable from the pressing device; and a control device controlling the pressing device based on a lifting/lowering height of the pressing measurement member at a time when a pressing reaction force acting on the pressing measurement member that presses the plurality of stacked connected cardboard box bodies reaches a preset reference pressing reaction force.

2. The cardboard box dividing device according to claim 1, wherein a height detector detecting the lifting/lowering height of the pressing measurement member at the time when the pressing reaction force acting on the pressing measurement member from the plurality of stacked connected cardboard box bodies reaches the reference pressing reaction force is provided and the control device controls the pressing device based on a detection result of the height detector.

3. The cardboard box dividing device according to claim 1, wherein the pressing device has a pressing member supported so as to be capable of ascending and descending and a pressing drive device lifting and lowering the pressing member and the control device adjusts a pressing position of the pressing member by the pressing drive device based on the lifting/lowering height of the pressing measurement member at the time when the pressing reaction force from the connected cardboard box body reaches the reference pressing reaction force.

4. The cardboard box dividing device according to claim 1, wherein a loading lower conveyor is disposed upstream of the lower conveyor in a transport direction of the connected cardboard box body and the pressing measurement member is disposed so as to face the loading lower conveyor from above.

5. The cardboard box dividing device according to claim 4, wherein the pressing measurement member has a configuration in which an upper pressing member and a lower pressing member are allowed to approach and separate from each other and are urged and supported in a direction of separation by an urging member, the upper pressing member is allowed to move along an up-down direction by a pressing member moving device, and the control device controls the pressing device based on the lifting/lowering height of the lower pressing member at the time when the pressing reaction force acting on the lower pressing member from the connected cardboard box body reaches the reference pressing reaction force.

6. The cardboard box dividing device according to claim 5, wherein the urging member is a fluid pressure cylinder, the lower pressing member is capable of ascending and descending with respect to the upper pressing member, and the lower pressing member is urged downward and supported with respect to the upper pressing member.

7. The cardboard box dividing device according to claim 6, wherein an urging support force adjusting device adjusting an urging support force of the lower pressing member by the fluid pressure cylinder is provided.

8. The cardboard box dividing device according to claim 4, wherein the control device lowers the pressing measurement member when the pressing reaction force acting on the pressing measurement member from the connected cardboard box body is yet to reach the reference pressing reaction force in a case where the connected cardboard box body is loaded on the loading lower conveyor and controls the pressing device based on the lifting/lowering height of the pressing measurement member at the time when the pressing reaction force acting on the pressing measurement member from the connected cardboard box body reaches the reference pressing reaction force.

9. The cardboard box dividing device according to claim 4, wherein the control device lifts the pressing measurement member when the pressing reaction force acting on the pressing measurement member from the connected cardboard box body reaches the reference pressing reaction force in a case where the connected cardboard box body is loaded on the loading lower conveyor and controls the pressing device based on the lifting/lowering height of the pressing measurement member at a time when the pressing reaction force acting on the pressing measurement member from the connected cardboard box body falls below the reference pressing reaction force.

10. The cardboard box dividing device according to claim 4, wherein the pressing measurement member is a loading upper conveyor disposed so as to face the loading lower conveyor from above.

11. The cardboard box dividing device according to claim 4, further comprising:

a loading upper conveyor disposed so as to face the loading lower conveyor from above and supporting upper portions of a plurality of stacked connected cardboard box bodies;

a loading upper conveyor moving device moving the loading upper conveyor up and down;

a connected cardboard box body transport conveyor disposed upstream of the loading lower conveyor in a transport direction of the connected cardboard box body; and a connected body height detector detecting a height of a plurality of the connected cardboard box bodies stacked on the connected cardboard box body transport conveyor, wherein the control device controls the loading upper conveyor moving device based on a detection result of the connected body height detector.

12. The cardboard box dividing device according to claim 1, wherein the control device gradually reduces a pressing force of the plurality of connected cardboard box bodies by the pressing device at a time when the cutting blade divides the plurality of connected cardboard box bodies into front and rear parts.

13. A cardboard box production device comprising:

a sheet feeding section supplying a double box sheet;

a slotter creaser section performing creasing line processing on a surface of the double box sheet and performing grooving;

a folding section forming a connected cardboard box body by folding the double box sheet and bonding end portions;

a counter-ejector section discharging a predetermined number of the connected cardboard box bodies at a time after stacking the connected cardboard box bodies while counting the connected cardboard box bodies; and the cardboard box dividing device according to claim 1 for cutting and dividing the connected cardboard box body along the width direction intersecting with the transport direction.

* * * * *